US006692237B1

(12) United States Patent
Komatsu et al.

(10) Patent No.: US 6,692,237 B1
(45) Date of Patent: Feb. 17, 2004

(54) ROTARY PISTON CYLINDER DEVICE WITH RADIALLY EXTENDING CYLINDER CHAMBERS INTERSECTING AT A ROTARY AXIS

(75) Inventors: Fumito Komatsu, Nagano (JP); Kenji Muramatsu, Nagano (JP); Yuki Nakamura, Nagano (JP); Tomohiro Takeuchi, Nagano (JP)

(73) Assignee: Kabushiki Kaisha Sankyo Seiki Seisakusho, Nagano (JP)

( * ) Notice: Subject to any disclaimer, the term of this patent is extended or adjusted under 35 U.S.C. 154(b) by 0 days.

(21) Appl. No.: 10/009,812

(22) PCT Filed: Jun. 16, 2000

(86) PCT No.: PCT/JP00/03971

§ 371 (c)(1),
(2), (4) Date: Dec. 11, 2001

(87) PCT Pub. No.: WO00/79101

PCT Pub. Date: Dec. 28, 2000

(30) Foreign Application Priority Data

| | | |
|---|---|---|
| Jun. 18, 1999 | (JP) | 11-172994 |
| Jun. 24, 1999 | (JP) | 11-177749 |
| Feb. 29, 2000 | (JP) | 2000-054503 |
| Feb. 29, 2000 | (JP) | 2000-054972 |

(51) Int. Cl.[7] ..... F04B 27/04

(52) U.S. Cl. ..... 417/273; 417/462; 417/466; 91/495; 91/494; 277/367; 277/410

(58) Field of Search ..... 417/462, 460, 417/273; 91/495, 494; 277/367, 410

(56) References Cited

U.S. PATENT DOCUMENTS

| | | | | |
|---|---|---|---|---|
| 1,642,103 A | * | 9/1927 | Daubenmeyer | 180/253 |
| 3,799,035 A | * | 3/1974 | Lamm | 91/493 |
| 3,971,259 A | * | 7/1976 | Schottler | 74/25 |
| 6,212,994 B1 | * | 4/2001 | Estrabrooks | 91/493 |

FOREIGN PATENT DOCUMENTS

| | | | | |
|---|---|---|---|---|
| JP | 57-87184 | | 11/1980 | |
| JP | 58-92486 | | 6/1983 | |
| JP | 03213645 A | * | 9/1991 | F02F/5/00 |
| JP | 10-281052 | | 10/1998 | |
| JP | 11-013647 | | 1/1999 | |

* cited by examiner

*Primary Examiner*—Cheryl J. Tyler
*Assistant Examiner*—Emmanual Sayoc
(74) *Attorney, Agent, or Firm*—Notaro & Michalos P.C.

(57) ABSTRACT

A rotary cylinder apparatus which prevents a fluid from leaking from a contact portion of a piston and a cylinder member and consequently enables efficient rotation. The rotary cylinder apparatus comprises: a rotary cylinder member 2 which has cylinder chambers 22 and 23 formed thereto so as to pass through a rotary shaft center O and rotates around the rotary shaft center O; pistons 3 and 4 demonstrating reciprocating linear motion in the cylinder chambers 22 and 23; a piston holding member 5 which holds the pistons 3 and 4 and rotates around a rotation center X eccentric from the rotary shaft center O of the rotary cylinder member 2; and a casing 6 which rotatably supports the rotary cylinder member 2 and has at least one inlet 61 and at least one outlet 62, wherein the pistons 3 and 4 are rotatably supported at a position away from the rotation center X of the piston holding member 5 by a fixed distance and with that position at the center thereof.

21 Claims, 47 Drawing Sheets

2
3
4
5
9
22a
22b
23a
23b
25
28a
28b
61b
62b 2
3
4
5
22a
22b
23a
23b
24
25
61
61a
61b
62
62a
62b
64

2
3
4
5
9
22a
22b
23a
23b
24
25
28a
28b

ROTARY PISTON CYLINDER DEVICE WITH RADIALLY EXTENDING CYLINDER CHAMBERS INTERSECTING AT A ROTARY AXIS

FIELD OF THE INVENTION

The present invention relates to a cylinder apparatus which can be used as, for example, a pump, a compressor or a fluid motor, and more particularly to a rotary cylinder apparatus in which a piston moves into or from a cylinder chamber by the rotary motion.

TECHNICAL TERMS

A term "rotary cylinder apparatus" used in this specification includes a device which performs a mechanical task by using fluid energy as well as a device which compresses and thrusts a fluid by using rotational energy. That is, the term "rotary cylinder apparatus" means devices that generically designate a rotary pump, a rotary compressor, a fluid motor and others.

DESCRIPTION OF THE RELATED ART

As a pump which is of a type for rotating a rotor and thrusting a fluid by a displacement effect, there is known a rotary pump using a gear type rotor. In case of this pump, however, the tooth profile of the rotor is hard to be machined, which results in increase of the cost. Thus, in order to eliminate this problem, the present applicant has developed a rotary cylinder apparatus having a structure in which an intake and discharge mechanism does not require a gear component (see Japanese Patent Application Laid-open No. 118501/1981, Japanese Utility Model Application Laid-open No. 87184/1982, and Japanese Utility Model Application No. 92486/1983).

The rotary cylinder apparatus disclosed in Japanese Patent Application Laid-open No. 118501/1981 has, as shown in FIGS. 67 and 68, a circular cylinder member 102 fixed to the inside of a casing 101 by press fitting and the like, and a support member 104 which rotates in a circular hollow portion 103 formed at a central part of this cylinder member 102. To the cylinder portion 102 are formed six cylinder chambers 105*a*, 105*b*, 105*c*, 105*d*, 105*e* and 105*f* which are radially arranged and respectively communicate with the central hollow portion 103. The respective cylinders 105*a* to 105*f* are provided so as to sequentially communicate with a suction opening 106 which communicates with the outside of the casing 101 to take a fluid into the cylinder apparatus and a discharge opening 107 which applies a pressure to the taken fluid to discharge it, as the support member 104 rotates.

The support member 104 is a discoid member fixed to one end of a shaft 108 rotatably supported by a hole 101*a* formed to the casing 101, and a lunate valve sheet 109 is attached on a surface opposite to the shaft 108. This valve sheet 109 is arranged so as to be capable of rotating in the appressed manner in an area corresponding to substantially the semicircle of an inner wall portion 103*a* of the cylinder member 102 and provided so as to cause the hollow portion 103 to selectively communicate with an arbitrary cylinder chamber. It is to be noted that a hole 104*a* for communicating with the discharge opening 107 is provided to the support member 104.

A shaft 110 is fixed at an eccentric position of the support member 104, and a rotary piston member 111 is rotatably supported by this shaft 110. Both ends of the shaft 110 are fixed to the discoid support member 104 and an auxiliary plate member 113 which are arranged so as to be opposed to each other with the valve sheet 109 therebetween. A hole 113*a* for communicating with the suction opening 106 is provided to the auxiliary plate member 113. This auxiliary plate member 113 integrally rotates with the support member 104. The rotary piston member 111 is constituted by a rotation center portion 112*a* and pistons 111*a*, 111*b* and 111*c* radially extending in three directions from the rotation center portion 112*a*. The rotary piston member 111 moves around a shaft center o1 of the cylinder member 102 as the support member 104 rotates.

As shown in FIGS. 68A to 68D, when the respective pistons 111*a*, 111*b* and 111*c* rotate (revolution) around shaft center o1 in a direction indicated by an arrow B1 while rotating (autorotation) around the shaft 110 in a direction indicated by an arrow A1 as the support member 104 rotates, the three pistons 111*a* to 111*c* sequentially move into or from the respective fixed cylinder chambers 105*a* to 105*f* so that the outside air is sequentially taken from the suction opening 106 into the respective cylinder chambers 105*a* to 105*f* and discharged from the discharge opening 107 to the outside. This pump operation is repeated. According to this apparatus, since the advanced tooth profile finishing technique is not required, manufacture is facilitated.

However, since the respective pistons 111*a* to 111*c* move into or from the cylinder chambers 105*a* to 105*f* while rolling, they must have a structure that their end portions are sharpened and the dimension of each of the pistons in the widthwise direction has a margin when they enter the cylinder chambers 106*a* to 105*f* in order to smooth and facilitate the operation of each piston. Accordingly, a gap is thereby formed between the pistons 111*a* to 111*c* and the cylinder chambers 105*a* to 105*f*. As a result, a fluid tends to flow from the gap portion, and the pump efficiency is thereby disadvantageously lowered.

Further, the rotary cylinder apparatus disclosed in Japanese Utility Model Application Laid-open No. 87184/1982 and Japanese Utility Model Application Laid-open No. 92486/1983 is the same as the counterpart disclosed in Japanese Patent Application Laid-open No. 118501/1981 mentioned above in the basic structure, namely, that the radially arranged pistons relatively rotationally move along the radially arranged cylinder chambers while rotating to obtain the pump effect. However, this rotary cylinder apparatus is different from the former apparatus in that the cylinder member 102 rotates by rotation of the rotary piston member 111, the valve sheet 109 is fixed to the case and does not rotate, and a rotation supporting point of the rotary piston member 111 does not swivel.

In case of the type that the cylinder chamber rotates together with the rotary piston member, therefore, the piston is formed into a substantially circular disc shape whose outer diameter is nearly equal to a width of the cylinder chamber, as different from the above-described type that the cylinder chamber is fixed. That is because the smooth operation is enabled even if there is substantially no gap between the pistons and the cylinder chambers when the pistons move into or from the cylinder chambers since the cylinder member also rotates in the same direction as the rotary piston member. However, in case of this type, since the contact surface between the piston and the cylinder chamber is constituted by an outer peripheral surface of the circular disc-like piston and the inner wall of the linear cylinder chamber, an area of this contact surface is so small that this part can not withstand a pressure of a fluid. Consequently, the fluid leaks, and the pump effect lowers when the pressure is increased.

It is an object of the present invention to provide a rotary cylinder apparatus which can prevent a fluid from leaking from the contact portion between the piston and the cylinder member and thereby convert the fluid energy into the rotary motion or the rotary motion into the fluid energy with small losses.

SUMMARY OF THE INVENTION

To achieve this aim, according to the present invention, there is provided a rotary cylinder apparatus comprising: a rotary cylinder member which has a cylinder chamber formed thereto so as to pass through a rotary shaft center and rotates around the rotary shaft center; a piston which demonstrates the reciprocating linear motion in surface contact with the inside of the cylinder chamber; a piston holding member which supports the piston and rotates around a rotation center eccentric from the rotary shaft center of the rotary cylinder member; and a casing which rotatably supports the rotary cylinder member and the piston holding member and has at least one fluid inlet and at least one fluid outlet, wherein the piston is held at a position away from the rotation center of the piston holding member by a fixed distance and held so as to be capable of swiveling around that position.

Therefore, when rotation is inputted to the rotary cylinder portion or the piston holding member from the outside, or when a fluid having a pressure is led from the fluid inlet so that the pressure acts on the piston in the cylinder chamber, the piston rotates (revolution) around the rotation center of the piston holding member while rotating around the center of autorotation by rotation of the rotary cylinder member and the piston holding member or movement of the piston itself, thereby causing the reciprocating motion of the piston in the cylinder chamber.

At this moment, the rotary cylinder member and the piston holding member can rotate while being respectively supported by the casing, and the piston can also rotate by itself. Thus, the piston can perform the linear motion in the cylinder chamber while rotating around the autorotation center and changing its position. As a result, even if the piston is configured to be in surface contact with the cylinder chamber, each member can demonstrate the smooth rotary motion. For example, even if the piston has a block-like shape, each member can smoothly perform the rotary motion. As a result, the piston can be readily manufactured, thereby facilitating improvement in the accuracy of the piston. Here, it is preferable to configure the apparatus in such a manner that a ratio of the rotation number of the rotary cylinder member, the rotation number of the piston holding member and the number of times of reciprocation of the piston in the cylinder becomes 1:2:1. In this case, the respective members can assuredly rotate without any trouble, and vibrations or noises during the rotation can be reduced.

Moreover, a contact area between the piston and the cylinder chamber can be enlarged, and the fluid resistance in the contact surface is large as compared with a prior art in which the contact surface is formed by so-called line contact, thereby preventing the fluid from leaking from the contact surface portion. As a result, it is possible to convert the fluid energy into the rotary motion or the rotary motion into the fluid energy with the small losses.

In addition, since the piston demonstrates the reciprocating linear motion in the cylinder chamber, the piston operation becomes smooth and stable, thereby obtaining the structure by which vibrations or noises during rotation can be reduced. Additionally, the tolerance of the component accuracy can be increased, and the components can be easily fabricated. On the contrary, in case of the component accuracy level which is similar to that in the prior art, the air-tightness/reliability can be improved. Therefore, in case of a pump, a compressor, or a fluid motor, realization of the high performance can be facilitated.

Further, in the rotary cylinder apparatus according to the present invention, when the rotary shaft center of the rotary cylinder member is a drive shaft for leading rotation from the outside, the piston and the piston holding member can be driven and operated by swiveling this rotary cylinder member. By doing so, the rotary cylinder apparatus can be utilized as a compressor for sucking, compressing and discharging gas or a pump for sucking and discharging a liquid. Furthermore, a so-called center drive specification is enabled. When the drive shaft and the motor shaft are directly connected to each other in the coaxial direction, the settlement as a product is good, which is advantageous in terms of vibrations or assembling.

For example, in case of constituting as a rotary compressor, the piston is moved by relatively rotating the rotary cylinder member and the piston holding member by a rotational drive source, and a fluid sucked from the fluid inlet is discharged from the outlet. At this moment, the fluid inlet is formed so as to extend from a position which is slightly closer to the inner side from a position to which the piston has moved on the outmost periphery with rotation of the rotary cylinder member to a position to which the piston has moved in the vicinity of the hollow portion. On the other hand, it is preferable that the outlet is provided at a position which is slightly distanced in the frontward position from a position to which the piston has moved on the outmost periphery with rotation of the rotary cylinder member. Furthermore, it is preferable to provide a check valve to the outlet which is a discharge opening. In this case, since the respective cylinder chambers are sequentially opposed to the outlet as the rotary cylinder member rotates, the fluid can be prevented from flowing backwards when the pressure is lowered due to the action of the check valve even if the pressure of the fluid discharged from the outlet pulsates. Moreover, it is preferable to connect an input shaft for relatively rotating the rotary cylinder member and the piston holding member with the rotary cylinder member or the piston holding member through a carrier plate. In this case, for example, even if the center of the input shaft deviates from the center of the rotary cylinder member when rotation of the input shaft is transmitted to the rotary cylinder member, this deviation can be absorbed between the cylinder member and the carrier plate to transmit the turning force. Similarly, even if the center of the input shaft deviates from the center of the piston holding member when rotation of the input shaft is transmitted to the piston holding member, the carrier plate can absorb this deviation to transmit the turning force.

Further, when the rotary cylinder member and the piston holding member are rotated when the pressure fluid is led into the cylinder chamber to move the piston by using the pressure of the fluid, it is possible to constitute a fluid rotating machine capable of taking out rotation with at least one of the rotary cylinder member and the piston holding member being used as an output shaft. Furthermore, in case of the fluid rotating machine, it is preferable to open the fluid inlet so as to communicate with the cylinder chamber when the piston is at a substantially outer peripheral position of the rotary cylinder member as the rotary cylinder member rotates as seen from the rotary shaft center of the rotary cylinder member and so as to close the cylinder chamber when the piston has passed the substantially central position of the rotary cylinder member, and form the fluid outlet so as to communicate with the cylinder chamber before the piston reaches the substantially central position of the rotary cylinder member as the rotary cylinder member rotates as seen from the rotary shaft center of the rotary cylinder member and so as to close the cylinder chamber at the substantially outer peripheral position of the rotary cylinder member. Incidentally, when constituting the rotary cylinder apparatus as a rotary compressor, it is preferable to form the fluid inlet so as to communicate with the cylinder chamber when the piston reaches the substantially outer peripheral position of the rotary cylinder member as the rotary cylinder member rotates as seen from the rotary shaft center of the rotary cylinder member and so as to close the cylinder chamber at the substantially central position of the rotary cylinder member, and form the fluid outlet so as to communicate with the cylinder chamber when the piston reaches the substantially central position of the rotary cylinder member as the rotary cylinder member rotates as seen from the rotary shaft center of the rotary cylinder member and so as to close the cylinder chamber at the substantially outer peripheral position of the rotary cylinder member.

Moreover, when constituting the rotary cylinder apparatus as such fluid rotating machines, it is preferable that the rotary cylinder apparatus is provided with a lubricant circulation mechanism. In this case, lubrication on sliding surfaces of the piston, the piston holding member, the rotary cylinder member and the like enables the high-speed rotation.

In addition, a fluid electric generator may be constituted by connecting an electric generation mechanism to the output side of the above-described fluid rotating machine. In this case, the above-mentioned fluid rotating machine can be used to generate electricity.

Additionally, in the rotary cylinder apparatus according to the present invention, a guide portion for guiding the piston in the sliding direction is formed to the cylinder chamber, and a guide engagement portion engaging with the guide portion is formed to the piston. Therefore, the reciprocating linear motion of the piston is smoothed when this motion is performed while the guide engagement portion is guided by the guide portion.

Further, in the rotary cylinder apparatus according to the present invention, the fluid inlet is provided to the casing in any one of areas divided by a line connecting the rotary shaft center of the rotary cylinder member and the rotation center of the piston holding member so as to communicate with the cylinder chamber, and the fluid outlet is provided to the casing in the other one of the areas divided by the line connecting the rotary shaft center of the rotary cylinder member and the rotation center of the piston holding member so as to communicate with the cylinder chamber. In this case, the inlet and the outlet can be arranged so as to be sufficiently distanced from each other. Even if a difference between the pressure of the fluid on the inlet side and the pressure of the fluid on the outlet side is large, the fluid can be prevented from directly flowing from the inlet toward the outlet or from the outlet toward the inlet without passing through the cylinder chamber. In particular, it is preferable to provide the inlet and the outlet of the fluid at positions opposed to the outer peripheral surface side of the rotary cylinder member of the casing. By providing them in this manner, each cylinder chamber, the inlet and the outlet can be configured so that each cylinder chamber can communicate with the outer peripheral surface of the rotary cylinder member, which results in the excellent settlement of the product.

Furthermore, in the rotary cylinder apparatus according to the present invention, it is preferable that a surface of the piston opposed to the piston holding member is a flat surface. In this case, the movement of the piston is smoothed with respect to the piston holding member. Moreover, it is possible to prevent a gap from being formed between the piston and the piston holding member, thereby avoiding leakage of the fluid.

In addition, in the rotary cylinder apparatus according to the present invention, it is preferable that the lateral cross-sectional shape of the piston and the lateral cross-sectional shape of the cylinder chamber are like shapes by which a small gap for enabling sliding is formed. In this case, it is possible to prevent a gap from being generated between the rotary cylinder member and the piston, thereby avoiding leakage of the fluid. Here, the shape of the piston does not have to be a special shape as long as it matches with the cross-sectional shape of the cylinder chamber. For example, even if the piston has a block shape such that all the entire surfaces are formed by the flat surfaces, each member can demonstrate the smooth rotary motion. As a result, the piston can be readily manufactured, the high accuracy of the piston can be easily obtained. Additionally, on the side surface of the piston may be provided a flat surface which is in surface contact with at least one of the flat side surfaces of the cylinder chamber, or preferably both of the side surfaces, or most preferably all the four surfaces including the surfaces configured by the piston holding member or the casing. Further, the lateral cross-sectional shape of the piston is not restricted to a rectangular shape and may be a different shape. The lateral cross-sectional shape of the cylinder chamber may be matched with the shape of the piston. In this case, since both of the side surfaces of the cylinder chamber on which the piston slides do not have to be vertically formed with respect to the bottom surface, the cylinder chamber can be readily processed. For example, when both corner portions on the bottom surface of the piston are rounded, the corner portions of the cylinder chamber on which the piston slides can be rounded, thereby further facilitating processing of the cylinder chamber.

Furthermore, in the rotary cylinder chamber according to the present invention, it is preferable to provide on these slide surfaces back pressure releasing means for reducing the back pressure which can be the resistance of the relative rotation of the rotary cylinder member and the piston holding member. In this case, when the piston operates and the rotary cylinder member and the piston holding member rotates, the back pressure which disturbs the movement of these members is generated, but the back pressure releasing means reduces the back pressure, thereby smoothing the movement of the rotary cylinder member and the piston holding member. For example, the back pressure releasing means may be piston back-and-forth movement back pressure releasing means for releasing the back pressure which acts in the moving direction of the piston, or cylinder side back pressure releasing means for releasing the back pressure generated between the rotary cylinder member and the casing, or piston holding member side back pressure releasing means for releasing the back pressure generated between the piston holding member and the casing. Further, all of these means may be provided.

Moreover, in the rotary cylinder apparatus according to the present invention, it is preferable that the rotary cylinder member and the piston holding member are rotatably supported by a bearing member which simultaneously bears the thrust load and the radial load. In this case, the structure of a part rotatably supporting the rotary cylinder member and the piston holding member becomes simple, thereby reducing the size and the cost of the apparatus.

In addition, in the rotary cylinder apparatus according to the present invention, the rotary cylinder member is rotatably supported by a bearing plate and the bearing plate is constituted so as to be adjustable by an adjusting pushing screw and an adjusting drawing screw in some cases. In this case, varying a quantity of screwing of the pushing screw and the drawing screw can adjust the tilt of the bearing plate supporting the rotary cylinder member. Consequently, the component accuracy of the rotary cylinder member in the thrust direction can be mollified.

Further, in the rotary cylinder apparatus according to the present invention, the piston holding member is rotatably supported by the bearing plate and the bearing plate is constituted so as to be adjustable by an adjusting pushing screw and an adjusting drawing screw in some cases. In this case, varying a quantity of screwing of the pushing screw and the drawing screw can adjust the tilt of the bearing plate supporting the piston holding member. As a result, the component accuracy of the piston holding member in the thrust direction can be mollified.

Furthermore, in the rotary cylinder apparatus according to the present invention, a magnetic fluid can be arranged at a gap formed between the piston and the cylinder chamber and a magnet for holding the magnetic fluid at the gap can be provided in the vicinity of a contact part between the piston and the cylinder chamber. In this case, the magnetic fluid held by the magnet is filled in the gap between the piston and the rotary cylinder member. Therefore, the small gap at a part where the piston is opposed to the cylinder member is further assuredly sealed, thereby further securely preventing the fluid from leaking from the contact part.

Moreover, in the rotary cylinder apparatus according to the present invention, a plurality of pistons and a plurality of cylinder chambers are formed, and it is preferable that a plurality of the cylinder chambers are formed so as to pass through and cross the rotary shaft of the rotary cylinder member. In this case, the rotary cylinder apparatus which rotates by a plurality of the pistons is provided.

In addition, in the rotary cylinder apparatus according to the present invention, the cylinder chambers are arranged to the rotary cylinder member at positions equally distributed in the circumferential direction. Therefore, the balance of rotation of the rotary cylinder member is improved, and vibrations or noises can be prevented from occurring, thereby providing the rotary cylinder apparatus suitable for the high-speed rotation.

Additionally, in the rotary cylinder apparatus according to the present invention, a length of a part where a plurality of the cylinder chambers cross each other in the moving direction of the piston is shorter than a length of the piston. Therefore, the piston demonstrating the reciprocating linear motion is guided by the wall surfaces of the cylinder chamber which is moving when the piston passes the part where the cylinder chambers cross each other, and crosses other crossing cylinder chambers. Thus, the piston can smoothly pass without colliding with other cylinder chambers.

Further, in the rotary cylinder apparatus according to the present invention, it is preferable that a chamfer portion is formed at the part where a plurality of the cylinder chambers cross each other. In this case, the piston can further smoothly pass the part where the cylinder chambers cross each other.

BRIEF DESCRIPTION OF THE DRAWINGS

FIGS. 18A and 18B are views showing a third example of the back pressure releasing means, in which FIG. 18A is a plane view depicting the fluid rotating machine from which the upper case and the piston holding member are removed and FIG. 18B is a cross-sectional view taken along the line B—B in FIG. 18A;

FIGS. 19A and 19B are views showing the fluid rotating machine to which a fourth example of the back pressure releasing means is applied, in which FIG. 19A is a plane view showing the fluid rotating machine from which the upper case and the piston holding member are removed and FIG. 19B is a cross-sectional view taken along the line B—B in FIG. 19A;

BEST MODE FOR CARRYING OUT THE INVENTION

The structure of the present invention will now be described in detail based on the illustrative best mode hereinafter.

An embodiment of a rotary cylinder apparatus according to the present invention will now be explained with reference to FIGS. 1 to 3. Incidentally, although the present invention will be described as a rotary pump apparatus for supplying gas in a fixed direction in each embodiment, a medium to be supplied is not restricted to the gas and it may be any fluid including a liquid. Further, the present invention is not restricted to the pump apparatus and is suitable for various apparatuses constituted by utilizing the rotary motion of a rotary cylinder member, for example, an air compressor, an air motor and others.

Figure 1:
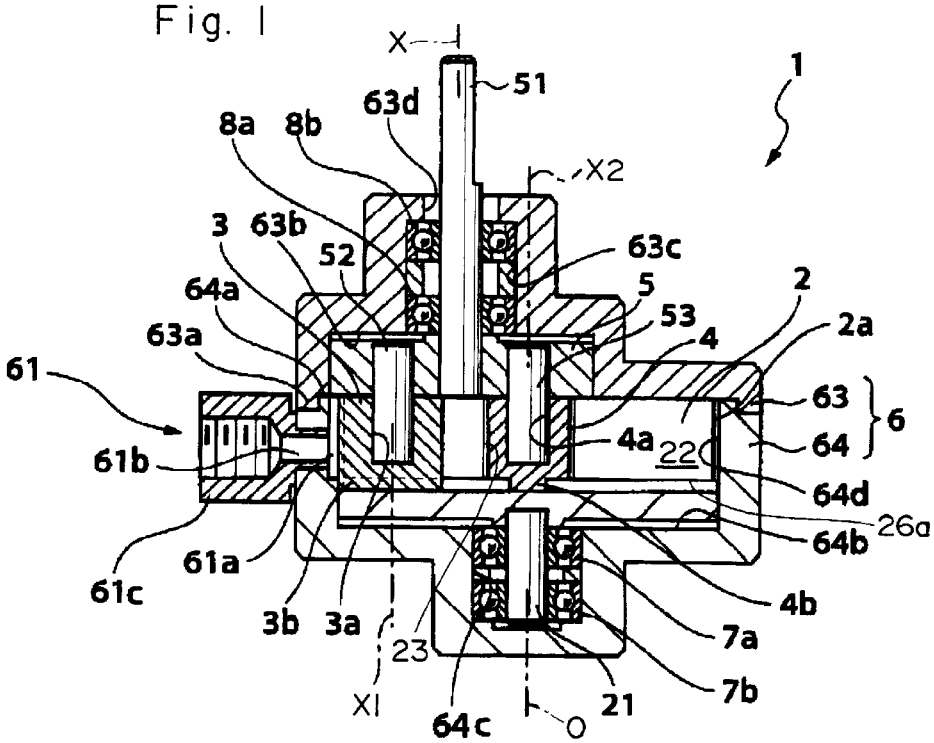
FIG. 1 is a vertical cross-sectional view showing a first embodiment of a rotary cylinder apparatus according to the present invention.
Figure 2:
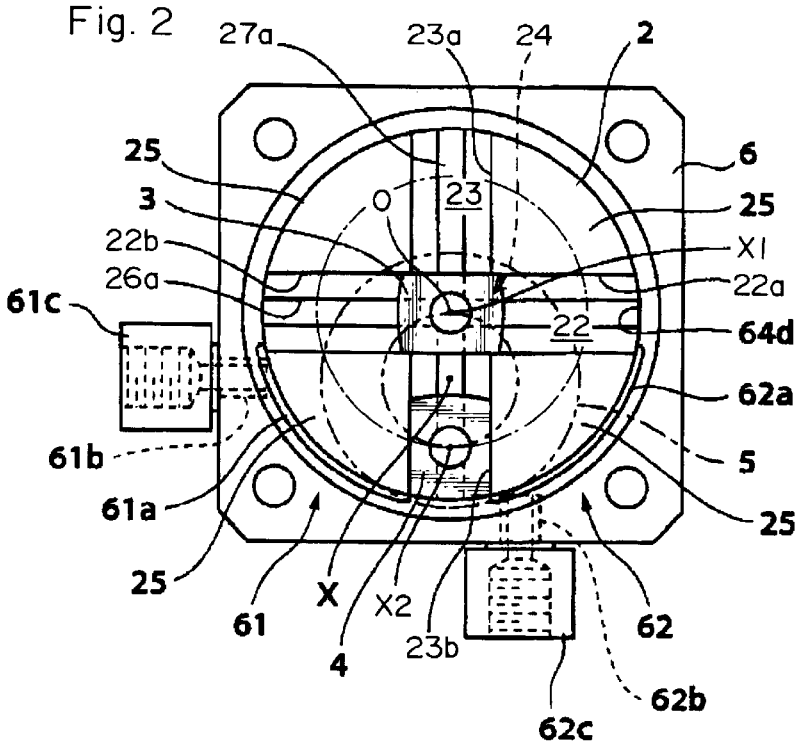
FIG. 2 is a plane view showing the rotary cylinder apparatus of FIG. 1 from which an upper case and a piston holding member are removed.

As shown in FIGS. 1 and 2, the rotary cylinder apparatus 1 is mainly constituted by: rotary cylinder member 2 which has a plurality of radially arranged cylinder chambers 22 and 23 and rotates around a rotary shaft center O; pistons 3 and 4 which are in surface contact with the inside of each of the cylinder chambers 22 and 23 and demonstrate the reciprocating linear motion; a piston holding member 5 which holds the pistons 3 and 4 and is eccentric from the rotary cylinder member 2 to rotate around a rotation center X; and a casing 6 which rotatably supports the rotary cylinder member 2 and the piston holding member 5 and has at least one inlet 61 for a fluid and at least one outlet 62 for the fluid. The rotary cylinder apparatus 1 is held so as to be capable of swiveling around shaft centers X1 and X2 provided at positions where the pistons 3 and 4 are separated from the rotation center of the piston holding member 5 by a fixed distance. Specifically, the rotary cylinder apparatus 1 includes: the rotary cylinder member 2 having a circular shape; the piston holding member 5 which holds the pistons 3 and 4 at the two eccentric autorotation central positions X1 and X2 apart from each other by 180 degrees so as to be capable of swiveling and rotates with a position eccentric from the rotary shaft center O of the rotary cylinder member 2 as the rotation central position X; and the casing 6 which rotatably supports both the rotary cylinder member 2 and the piston holding member 5 as the rotation members. Incidentally, although the cylinder chambers 22 and 23 and the pistons 3 and 4 are adopted for the rotary cylinder member 2 in this embodiment, the present invention is not restricted thereto, and having at least one cylinder chamber and one piston can suffice.

Figure 3:
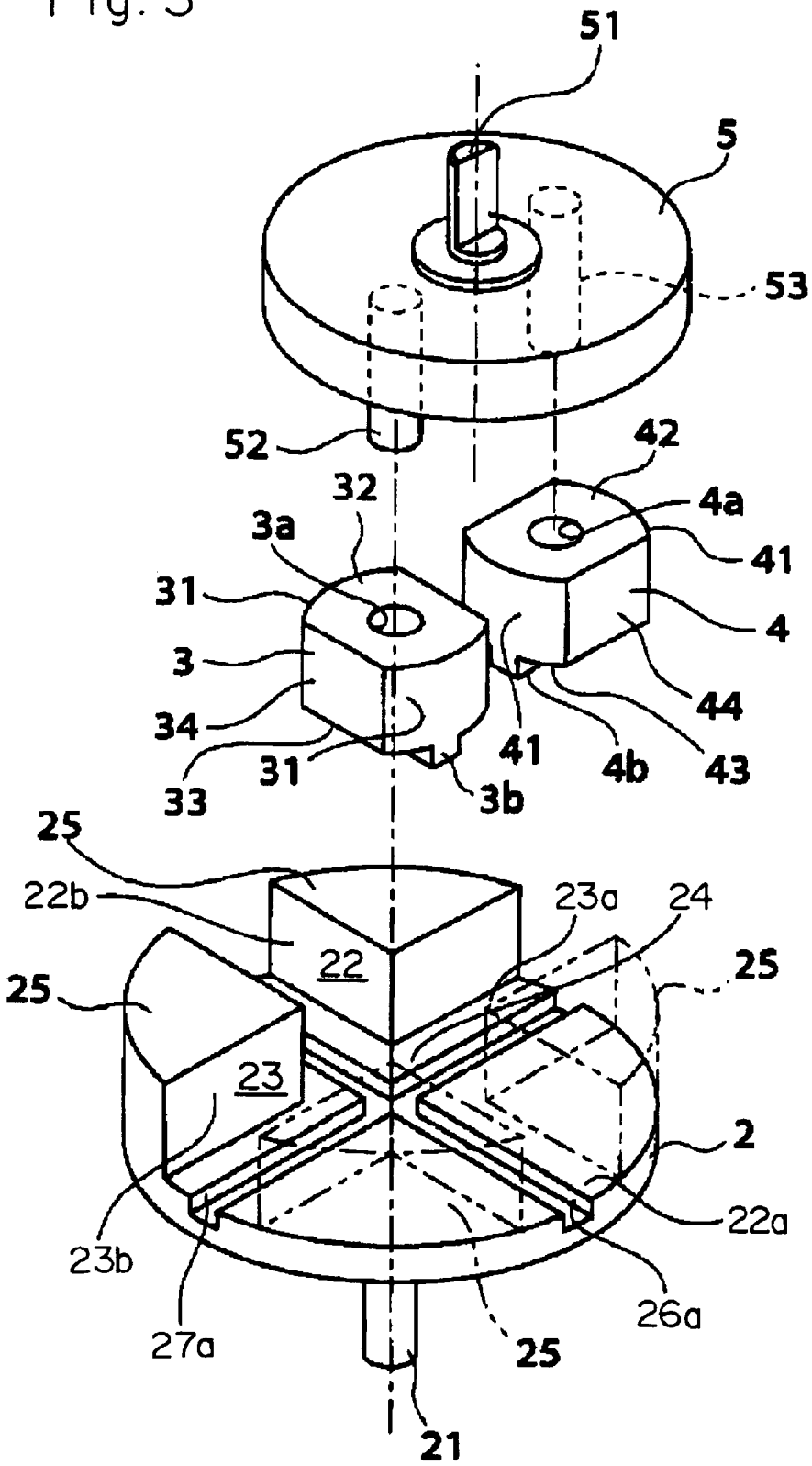
FIG. 3 is an exploded perspective view showing a rotary cylinder member, a piston holding member, and a piston of the rotary cylinder apparatus of FIG. 1.

As shown in FIGS. 1, 2 and 3, the rotary cylinder member 2 is formed into a circular shape having a predetermined thickness, and rotatably arranged in the inner space of the casing 6. One end of a shaft 21 is inserted and fixed by press fitting to one end surface of the rotary cylinder member 2, i.e., a concave portion of the end surface on the lower side surrounding the rotary shaft center O in FIGS. 1 and 3. The other end side of the shaft 21 is rotatably supported by two bearing members 7*a* and 7*b* which are arranged so as to overlap each other in the axial direction in the casing 6. Therefore, the rotary cylinder member 2 can rotate in the casing 6 around the shaft 21.

On the other end surface of the rotary cylinder member 2, i.e., the end surface of the upper side in FIGS. 1 and 3 is provided a space consisting of a cruciform groove formed by utilizing four sector base portions 25. This cruciform space is constituted by four cylinder portions 22*a*, 22*b*, 23*a* and 23*b* and a portion 24 at which these portions cross each other (which will be referred to as a hollow portion hereinafter). That is, on the end surface of the rotary cylinder member 2 on the other side is formed the hollow portion 24 which has a predetermined width around the rotary shaft center O and a bottom surface. Furthermore, the four cylinder portions 22*a*, 22*b*, 23*a* and 23*b* each having a rectangular cross section are radially provided around the rotary shaft center O in this hollow portion 24. The upper surface portion of each of the cylinder portions 22*a*, 22*b*, 23*a* and 23*b* is opened, and all of the remaining three surfaces of the same are formed by flat surfaces. The first cylinder portion 22*a*, the hollow portion 24 and the second cylinder portion 22*b* form the cylinder chamber 22, and the third cylinder portion 23*a*, the hollow portion 24 and the fourth cylinder portion 23*b* form the cylinder chamber 23. Incidentally, although the terms "upper" and "lower" are used for the sake of brief explanation, they are just used based on the drawings for the sake of convenience, and they do not mean absolute "upper" and "lower".

It is to be noted that the pistons 3 and 4 held by the piston holding member 5 are slidably fitted to the first to fourth cylinder portions 22*a* to 23*b*. The surfaces of the respective cylinder portions 22*a* to 23*b* opposed to the pistons 3 and 4 and the surfaces of the pistons 3 and 4 opposed to these portions are formed into flat surfaces. They are provided so that they are in contact with each other on the flat surfaces. As described above, since the contact surfaces of the respective pistons 3 and 4 and the respective cylinder portions 22*a* to 23*b* are formed into flat surfaces, the contact area is large, and the air-tightness of the fluid at the contact portions is high. Thus, it is hard for the fluid to pass and leak through the gap between the pistons 3 and 4 and the respective cylinder portions 22*a* to 23*b*.

It is to be noted that the cylinder chambers 22 and 23 formed as mentioned above pierce the rotary cylinder member 2 in the radial direction and are opened on the outer peripheral surface 2*a* of the rotary cylinder member 2. Therefore, the respective cylinder chambers 22 and 23 can communicate with a suction opening (inlet for the fluid) 61 and a discharge opening (outlet for the fluid) 62 formed to the casing 6.

Incidentally, when the rotary cylinder member 2 and the piston holding member 5 rotate by rotation of the piston holding member 5, the pistons 3 and 4 seemingly demonstrate the reciprocating linear motion in the cylinder chambers 22 and 23. Moreover, a length of the hollow portion 24, which is the portion where the respective cylinder chambers 22 and 23 cross each other, in the moving direction of the pistons 3 and 4 is shorter than a length of the contact surface (surface opposed to both side wall surfaces of the cylinder chambers 22 and 23) of each of the pistons 3 and 4.

It is to be noted that two thin guide grooves 26*a* and 27*a* are formed crosswise on the bottom surface of the hollow portion 24 and the bottom surfaces of the first to fourth cylinder portions 22*a* and 23*b* radially arranged with the hollow portion 24 at the center. On the other hand, convex pieces 3*b* and 4*b* as guide engagement portions which, are fitted into the above-described guide grooves 26*a* and 27*a* are provided on the bottom portions of the pistons 3 and 4. In addition, engaging the convex pieces 3*b* and 4*b* with the guide grooves 26*a* and 27*a* constitutes the guides for the linear motion. Therefore, the pistons 3 and 4 are caused to stably perform the reciprocating linear motion between a pair of the cylinder portions 22*a* and 22*b* or between 23*a* and 23*b* along the two guide grooves 26*a* and 27*a*.

On the other hand, the piston holding member 5 is formed into a circular shape having an outer diameter smaller than that of the rotary cylinder member 2. One end of the shaft 51 is inserted and fixed by press fitting to the rotation central position X of the piston holding member 5. It is to be noted that the rotation central position X of the piston holding member 5 is provided at a position eccentric from the rotary shaft center O of the above-described rotary cylinder member 2. In addition, the other end side of the shaft 51 is rotatably supported by bearing members 8*a* and 8*b* arranged in the casing 6, and the edge side of the shaft 51 protrudes to the outside of the casing 6. Connecting an output shaft (not shown) of a drive source such as a motor to this protruding portion causes the piston holding member 5 to be rotated and driven around the shaft 51 by the drive force of the drive source such as a motor at the eccentric position of the rotary cylinder member 2.

A support shaft 52 for holding the piston 3 so as to be capable of auto-rotating and a support shaft 53 for holding the piston 4 so as to be capable of auto-rotating are stood and fixed on the surface of the piston holding member 5 opposite to the surface on which the shaft 51 is fixed. Additionally, the pistons 3 and 4 are rotatably fitted to the support shafts 52 and 53.

Although the pistons 3 and 4 are formed in such a manner that surfaces 31, 31, 41, and 41 in the back-and-forth direction during the reciprocating linear motion are slightly rounded, other four surfaces, i.e., top surfaces 32 and 42, bottom surfaces 33 and 43, and both side surfaces 34, 34, 44 and 44 are formed to be flat in the state when the pistons are fitted in the cylinder chambers 22 and 23. Namely, each of the pistons 3 and 4 has a substantially rectangular parallelepiped block shape. The bottom surfaces 33 and 43 and the both side surfaces 34, 34, 44 and 44 among the respective surfaces formed to be flat in the pistons 3 and 4 except the top surfaces 32 and 42 become contact surfaces with the cylinder chambers 22 and 23 when fitted in the cylinder chambers 22 and 23. Further, holes 3*a* and 4*a* with bottoms to be rotatably fitted to the support shafts 52 and 53 are provided to the centers of the pistons 3 and 4, respectively. It is to be noted that the holes 3*a* and 4*a* may be through holes as long as they have such a length as that the support shafts 52 and 53 do not come into contact with the guide grooves 26*a* and 27*a*.

Figure 12:
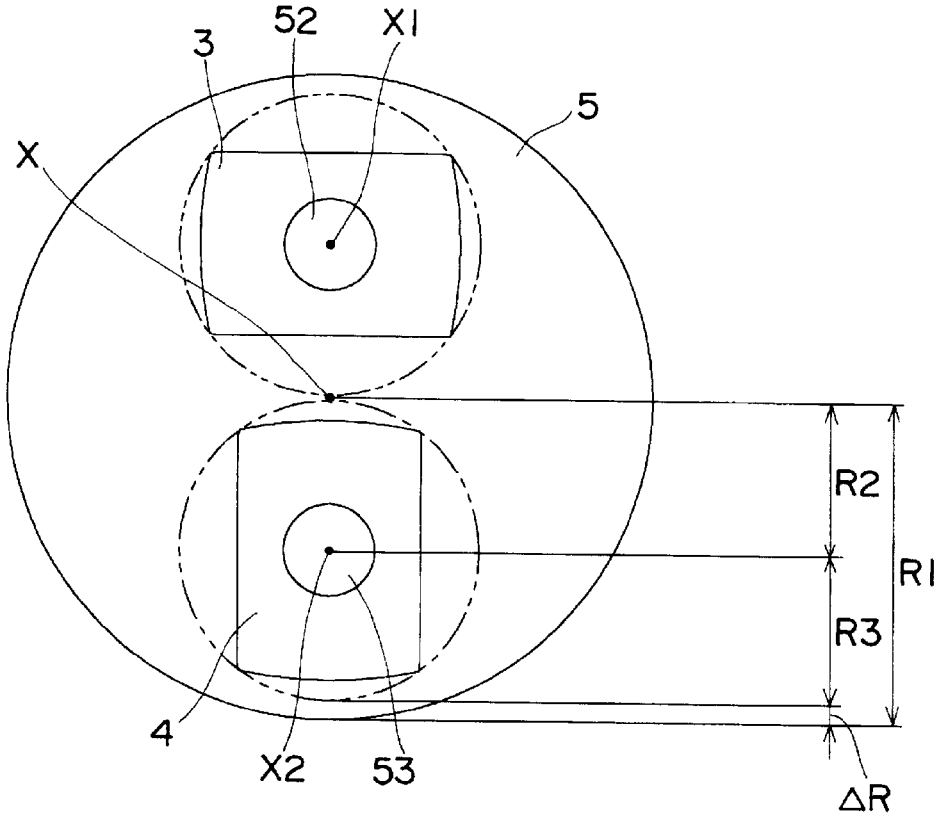
FIG. 12 is a conceptual view showing the relationship between the piston holding member and a trajectory of the piston during rotation.

FIG. 12 shows the relationship between the piston holding member 5 and the trajectories of the pistons 3 and 4 during rotation. The relationship between a radius R1 of the piston holding member 5, a distance R2 which is ½ of the gap between the support shafts 52 and 53 and a radius R3 of the outermost radial trajectory of each of the pistons 3 and 4 during the rotation is R1>(R2+R3), and there occurs a difference in radius ΔR. When the radius R1 is smaller than the distance R2+the radius R3, the outermost radial trajectory of the piston protrudes from the piston holding member 5 during the operation, and the processing accuracy for the components must be increased in order to assure the stability of rotation of the pistons 3 and 4 and the sealing property. On the contrary, when the relationship is changed to the radius R1>the distance R2+the radius R3 as described above, the stability of rotation of the pistons 3 and 4 and the sealing property can be readily assured even if the processing accuracy for the components is not very rigorous. However, this relationship is for assuring the sealing property and others, and the present invention is not restricted thereto. It is needless to say that the radius R1 can be substantially equal to or smaller than the distance R2+the radius R3.

The casing 6 is constituted by two case half bodies, namely, an upper case 63 for rotatably supporting the piston holding member 5 and a lower case 64 for rotatably supporting the rotary cylinder member 2. When fitting projections (projections for centering location) 63*a* and 64*a* of-the upper case 63 and the lower case 64 are fitted together and fixed by a screw and the like, both cases constitute the casing 6 for forming the sealed inner space. In this manner, when there is adopted the centering location structure for fitting the fitting projections 63*a* and 64*a* together, the upper case 63 and the lower case 64 can be accurately positioned to perform centering, and the displacement can be avoided.

The upper case 63 has the fitting projection 63*a* used for attachment to the lower case 64, and is constituted by a cup-like form having as an inner space a circular large space 63*b* for rotatably storing the piston holding member 5 and a circular small space 63*c* for press-fitting and fixing the two bearing members 8*a* and 8*b* rotatably supporting the shaft 51 fixed at the center of rotation of the piston holding member 5.

The fitting projection 63*a* is formed into a circular shape along the outer edge of the circular large space 63*b* and protrudes toward the lower case 64 side. It is to be noted that a protruding height of the fitting projection 63*a* is slightly lower than the protruding height of the fitting projection 64*a* formed to the lower case 64 and its radius is formed to be slightly larger than the radius of the fitting projection 64*a*. As a result, the fitting projection 63*a* of the upper case 63 is fitted to the fitting projection 64*a* so as to cover the outer side of the fitting projection 64*a* of the lower case 64.

Furthermore, an insertion hole 63*d* for inserting the shaft 51 is provided on the bottom surface of the small space 63*c* of the upper case 63. One end side of the shaft 51 protrudes toward the outside of the casing 6 from this insertion hole 63*d*.

On the other hand, the lower case 64 has the fitting projection 64*a* used for attachment to the upper case 63, and is constituted by a cup-like shape having as inner space a circular large space 64*b* for rotatably storing the rotary cylinder member 2 and a circular small space 64*c* for press-fitting and fixing the two bearing members 7*a* and 7*b* rotatably supporting the shaft 21 fixed to the rotary shaft center O of the rotary cylinder member 2.

The fitting projection 64*a* is circularly formed along the outer edge of the circular large space 64*b*, and protrudes toward the upper case 63 side. It is to be noted that a protruding height of the fitting projection 64*a* is slightly higher than the protruding height of the fitting projection 63*a* formed to the upper case 63 and its radius is formed to be slightly smaller than the radius of the fitting projection 63*a*.

The rotary cylinder member 2 is rotatably arranged in the large space 64*b* of the thus formed lower case 64. With this rotary cylinder member 2 being arranged, a suction opening 61 for sucking a fluid into the casing 6 from the outside and a discharge opening 62 for discharging the fluid sucked into the casing 6 to the outside are formed at positions opposed to the outer peripheral surface 2*a* of the rotary cylinder member 2, i.e., on the inner wall 64*d* of the large space 64*b*.

The suction opening 61 is constituted by a shallow concave portion 61*a* in an angle range of approximately 80 degrees formed on the inner wall 64*d* of the large space 64*b*, a communication hole 61*b* for causing the concave portion 61*a* to communicate with the outside of the casing 6, and a suction pipe 61*c* connected to the outer surface side of the casing 6 of the communication hole 61*b*. The concave portion 61*a* is connected with the respective cylinder portions 22*a* to 23*b* when the rotary cylinder member 2 rotates.

Furthermore, the discharge opening 62 is constituted by a shallow concave portion 62*a* formed in a range of approximately 80 degrees starting from a position distanced from the concave portion 61*a* of the suction opening 61 by about 10 degrees, a communication hole 62*b* for causing the concave portion 62*a* to communicate with the outside of the casing 6, and a discharge pipe 62*c* connected to the outer surface side of the casing 6 of the communication hole 62*b*. The concave portion 62*a* is connected with the respective cylinder portions 22*a* to 23*b* when the rotary cylinder member 2 rotates.

In the rotary cylinder apparatus 1 having the above-described structure, when the piston holding member 5 demonstrates the rotary motion at uniform angular velocity by drive of a motor and the like, each of the pistons 3 and 4 performs rotary motion around the rotation central position X, and the rotary cylinder member 2 also carries out the uniform angular velocity motion with this motion. By this operation, the pump operation is effected.

The operation of the rotary cylinder apparatus 1 according to the first embodiment of the present invention will now be described with reference to FIGS. 4A to 4D. Illustration of the guide grooves 26*a* and 27*a* constituting a part of the guiding means of the pistons 3 and 4 is omitted.

Figure 4A:
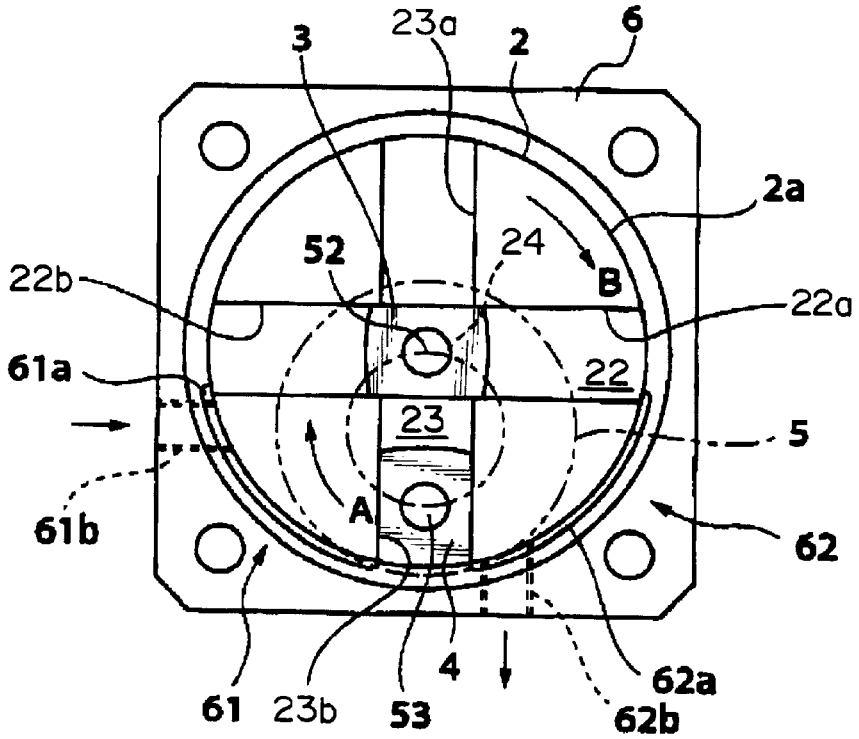
FIGS. 4A to 4D are views for illustrating the operation of the rotary cylinder apparatus of FIG. 1, showing the state in which the rotary cylinder member is rotated every 30 degrees in the clockwise direction.

In FIG. 4A, the piston 3 reciprocating in the cylinder chamber 22 is positioned at the hollow portion 24 of the rotary cylinder member 2. One end side of the piston 3 is slightly moved into the inlet of the cylinder portion 22*a* and the other end side of the same is slightly moved into the inlet of the cylinder member 22*b*. That is, both side surfaces 34 and 34 and the bottom surface 33, which are formed by flat surfaces, of the piston 3 are simultaneously brought into contact with both of the inner walls and the bottom surfaces, which are similarly formed into flat surfaces, of the cylinder portions 22*a* and 22*b* and the bottom surface of the hollow portion 24. At such an intermediate position, the piston 3 is simultaneously fitted to both cylinder portions 22*a* and 22*b* sandwiching the hollow portion 24, and the fluid taken from the suction opening 61 is filled in the cylinder portions 22*a* and 22*b*.

In the state shown in FIG. 4A, the outmost peripheral edge part of the cylinder portion 22*a* has just started to slightly communicate with the concave portion 62*a* of the discharge opening 62, and the cylinder portion 22*a* communicates with the discharge pipe 62*c* through the concave portion 62*a*. Moreover, the outmost peripheral edge part of the cylinder portion 22*b* is in the state immediately before completion of communication with the concave portion 61*a* of the suction opening 61, and the cylinder portion 22*b* communicates with the suction pipe 61*c* through the concave portion 61*a*. Incidentally, as described above, since the piston 3 is about to reach the hollow portion 24, all the cylinder portions 22*a* to 23*b* are separated and closed by this piston 3.

On the other hand, the piston 4 reciprocating in the cylinder portions 23*a* and 23*b* has reached the outmost peripheral edge part in the cylinder portion 23*b* of the rotary cylinder member 2.

In addition, the fluid is filled in the space of the cylinder portion 23*b* surrounded by the piston 4 and the piston 3. Additionally, although the cylinder portion 23*a* is insulated from other cylinder portions 22*a*, 22*b* and 23*b* by the piston 3, the fluid is also filled in the cylinder portion 23*a*. At this moment, the outmost peripheral edge part of the cylinder portion 23*b* is opposed to the position between the concave portion 61*a* of the suction opening 61 and the concave portion 62*a* of the discharge opening 62.

In the above-described state shown in FIG. 4A, when the piston holding member 5 is rotated in the clockwise direction (direction indicated by an arrow A) by drive of the motor or the like, the pistons 3 and 4 move in the direction of the arrow A together with the support shafts 52 and 53. The operation of the pistons 3 and 4 at this moment gives the turning force in the direction indicated by an arrow B (clockwise direction) to the rotary cylinder member 2, and the rotary cylinder 2 rotates in the direction indicated by the arrow B. Such relative rotation of the pistons 3 and 4 and the rotary cylinder member 2 causes the respective pistons 3 and 4 to reciprocate in the cylinder chambers 22 and 23.

The revolving rotary motion of the pistons 3 and 4 at this moment, namely, the rotary motion of the piston holding member 5 around the rotation central position X becomes the rotary motion whose rotation number is twice as high as the rotational speed-around the rotary shaft center O of the rotary cylinder member 2. That is because the radius of rotation of each of the pistons 3 and 4 is ½ of the radius of rotation of the rotary cylinder member 2 (cylinder reference circle) and the rotary motion of the pistons 3 and 4 is the cycloid motion with respect to the rotary motion of the rotary cylinder member 2. It is to be noted that the autorotation of the pistons 3 and 4, namely, rotation with the support shafts 52 and 53 at the rotation centers respectively is the uniform angular velocity motion whose number of rotation is equal to that of the rotary cylinder member 2. Therefore, the ratio of the rotation number of the rotary cylinder member 2, the rotation number of the piston holding member 5 and the rotation number of the pistons 3 and 4 with respect to the support shafts 52 and 53 its 12:1.

It is to be noted that the cylinder reference circle is a circle having a length from the rotary shaft center O of the rotary cylinder member 2 to the autorotation central position X2 as a radius.

Additionally, by this rotary motion, the pistons 3 and 4 in the cylinder chambers 22 and 23 give the turning force to the rotary cylinder member 2. While performing this operation, the piston 3 seemingly demonstrates the reciprocating linear motion between a pair of the cylinder portions 22*a* and 22*b*, and the piston 4 demonstrates the same between a pair of the cylinder portions 23*a* and 23*b*. Incidentally, the pistons 3 and 4 reciprocate between the cylinder portions 22*a* and 22*b* and between 23*a* and 23*b* once while the rotary cylinder member 2 makes one turn. The relationship between the number of times of reciprocating motion of the pistons 3 and 4 and the number of times of rotation of the rotary cylinder member 2 is 1:1.

Figure 4B:
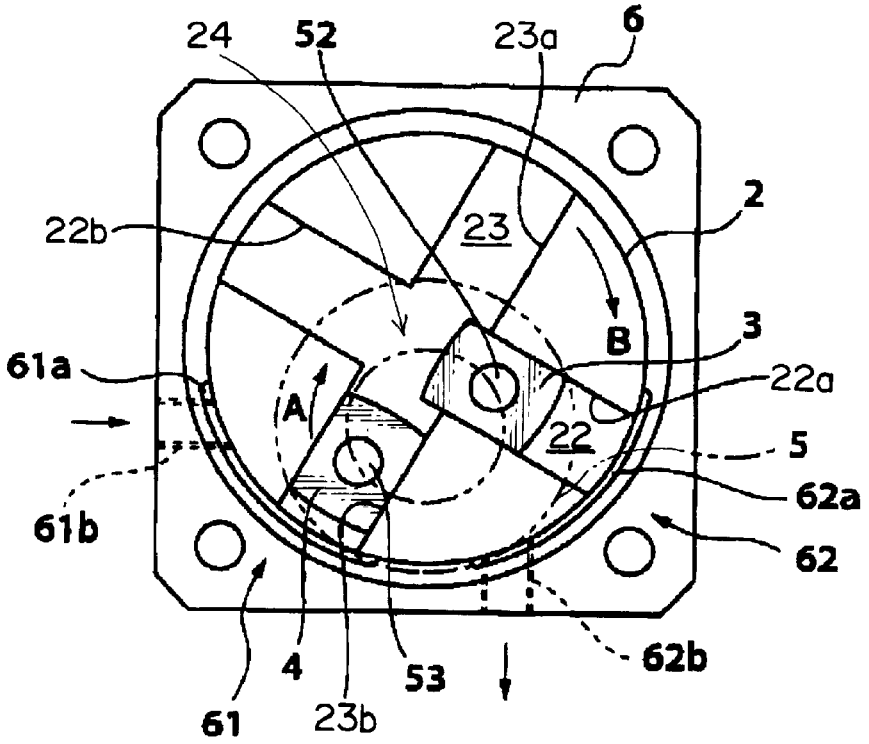

FIG. 4B shows the state that the piston holding member 5 turns 60 degrees from the state depicted in FIG. 4A and the cylinder member 2 thereby turns 30 degrees.

That is, by the operation from the state shown in FIG. 4A to the state illustrated in FIG. 4B, the piston 3 enters approximately ½ of the inside of the cylinder portion 22*a* from the state crossing the hollow portion 24. In this movement, since the piston 3 and the cylinder portion 22*a* are opposed to each other with their flat surfaces, the fluid hardly leaks from the contact surfaces. With this operation, the fluid in the cylinder portion 22*a* is effectively discharged to the discharge pipe 62*c* through the concave portion 62*a*. It is to be noted that the distance in the longitudinal direction of the cylinder chamber 22*a* is shorter than twofold of the entire length of the piston 3 and hence approximately ½ of that distance protrudes. However, the rear end part of the piston 3 still remains in the hollow portion 24.

On the other hand, the operation of the piston 3 toward the cylinder portion 22*a* causes the cylinder portions 22*b*, 23*a* and a part of the cylinder portion 23*b*, which are sealed by the piston 3, to become a series of spaces. The fluid flowing from the suction opening 61 to the respective cylinder portions 22*b*, 23*a* and 23*b* is filled in this series of spaces.

Further, the operation during this period causes the piston 4 to move from the innermost part of the cylinder portion 23*b* to the hollow portion 24 side by approximately ⅕ of the distance. Since the piston 4 is in contact with the cylinder portion 23*b* on the flat surfaces during this movement, the fluid hardly leaks between the contact surfaces (sliding surfaces). By this operation, the external fluid effectively flow from the concave portion 61*a* into the cylinder portion 23*b* through the suction pipe 61*c*. It is to be noted that the piston 4 has been completely entered the cylinder portion 23*b* at this moment.

Figure 4C:
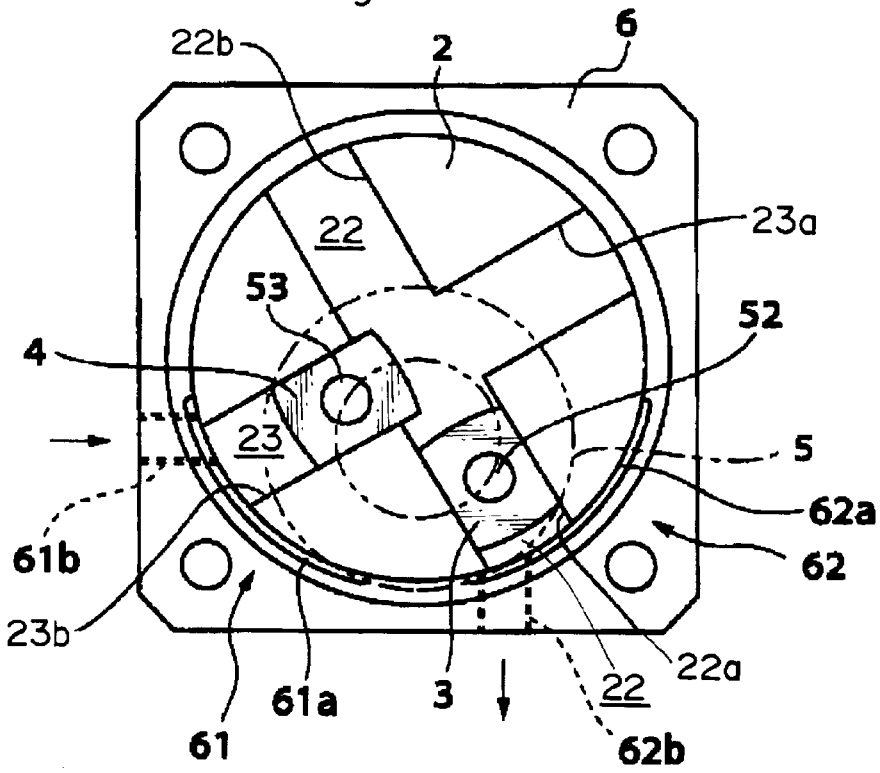

FIG. 4C shows the state that the piston holding member 5 further rotates 60 degrees from the state depicted in FIG. 4B and the cylinder member 2 thereby further rotates 30 degrees.

That is, the operation from the state shown in FIG. 4B to the state illustrated in FIG. 4C causes the piston 3 to further move to the inner side from the position which is approximately ½ of the distance of the inside of the cylinder portion 22*a*, more specifically, to the position which is approximately ⅘ of the length of the same. By this operation, the fluid remaining inside the cylinder portion 22*a* is efficiently discharged to the discharge pipe 62*c* through the concave portion 62*a*.

Furthermore, by the operation during this period, the piston 4 further moves toward the hollow portion 24 side in the cylinder portion 23*b*. With this operation, the external fluid flows into the cylinder portion 23*b* from the concave portion 61*a* through the suction pipe 61*c*. It is to be noted that the front end portion of the piston 4 has moved into the hollow portion 24 at this moment.

On the other hand, during this operation, the cylinder portions 22*b* and 23*a* and a part of the cylinder portion 22*a* form a series of spaces 20 through the hollow portion 24, and the fluid flowing from the suction opening 61 into the respective cylinder portions 22*b* and 23*a* is filled in this series of spaces.

Figure 4D:
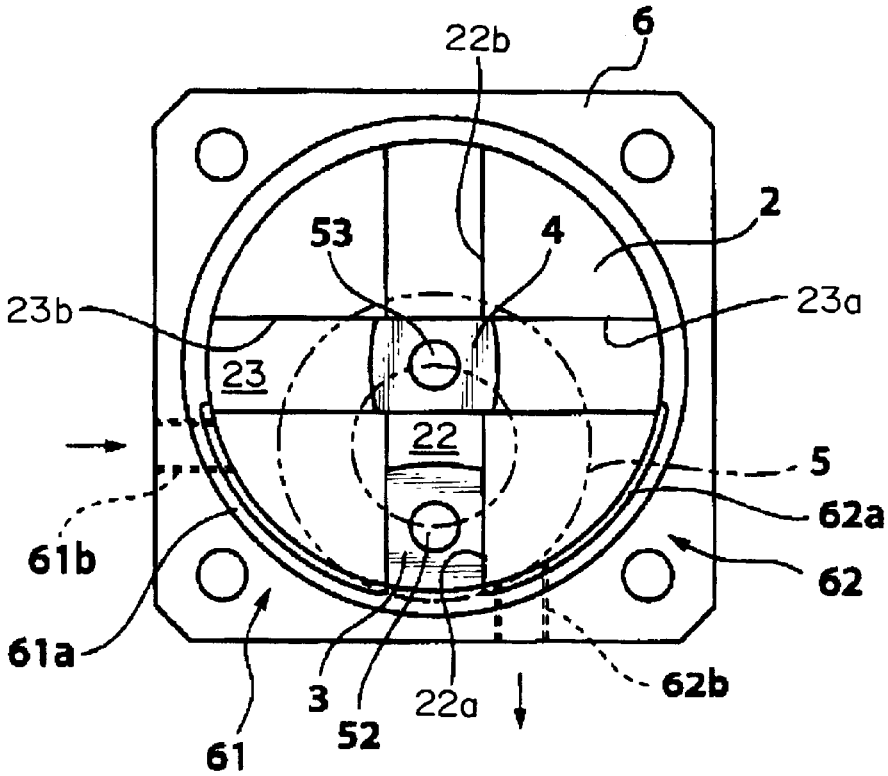

FIG. 4D shows the state that the piston holding member 5 further rotates 60 degrees from the state illustrated in FIG. 4C and the piston 4 thereby further rotates 30 degrees.

That is, by the operation from the state depicted in FIG. 4C to the state shown in FIG. 4D, the piston 3 further moves to the inner side from the position which is approximately ⅘ of the distance of the inside of the cylinder portion 22*a*, more specifically, to the outmost peripheral edge portion of the cylinder portion 22*a*. With this operation, the fluid remaining in the cylinder portion 22*a* is efficiently discharged to the discharge pipe 62*c* through the concave portion 62*a*. Incidentally, at this point in time, namely, in the state in which the rotary cylinder member 2 has rotated 90 degrees in the direction indicated by an arrow B from the initial state shown in FIG. 4A, the outmost peripheral edge portion of the cylinder portion 22*a* is opposed to the position between the concave portion 61*a* of the suction opening 61 and the concave portion 62*a* of the discharge opening 62, and the discharge operation has been already finished.

On the other hand, by the operation during this period, the piston 4 crosses the hollow portion 24 from the innermost portion side of the cylinder portion 23*b*, and further moves to a position from which its end portion enters the cylinder portion 23*a*. By the operation of the piston 4, one end side of the piston 4 has slightly entered the inlet of the cylinder portion 23*b* and, at the same time, the other end side of the same has slightly entered the inlet of the cylinder portion 23*a*. That is, the piston 4 is set at the intermediate position in the groove along which it reciprocates, and both side surfaces 44 and 44 and the bottom surface 43 which are formed to be flat have been simultaneously brought into contact with both of the inner walls and the bottom surfaces of the cylinder portions 23*a* and 23*b* and the bottom surface of the hollow portion 24 which are also formed to be flat.

At this moment, the outmost peripheral edge part of the cylinder portion 23*a* has just started to slightly communicate with the concave portion 62*a* of the discharge opening 62, and the cylinder chamber 23*a* is communicating with the discharge pipe 62*c* through the concave portion 62*a*. Moreover, the outmost peripheral edge part of the cylinder portion 23*b* is in the state immediately before completion of communication with the concave portion 61*a* of the suction opening 61, and the fluid suction operation of the cylinder portion 22*b* is substantially finished. Incidentally, as described above, since the piston 4 is about to reach the hollow portion 24, the respective cylinder portions 22*a* to 23*b* are again separated from each other and closed by the piston 4 at this moment.

The pistons 3 and 4 at this time are in the state that their positions in the state shown in FIG. 4A are switched each other. That is, when the piston holding member 5 rotates 180 degrees and the rotary cylinder member 2 simultaneously rotates 90 degrees, the pistons 3 and 4 move in or from one cylinder portion among the cylinder portions 22*a* to 23*b*, and they are counterchanged. The rotary cylinder apparatus 1 according to this embodiment performs the pump operation by repeating this operation. That is, when the piston holding member 5 further rotates 180 degrees, namely, rotates by 360 degrees from the initial point, the pistons 3 and 4 return to the initial positions shown in FIG. 4A. On the other hand, the rotary cylinder member 2 rotates 180 degrees during this operation.

Therefore, when the piston holding member 5 rotates twice, namely, rotates 720 degrees, the rotary cylinder member 2 rotates once, i.e., rotates 360 degrees. As a result, the pistons 3 and 4 seemingly demonstrate the reciprocating linear motion between the cylinder portions 22*a* to 23*b* forming each pair. That is, when the piston holding member 5 rotates twice, the pistons 3 and 4 complete a series of the reciprocating operation once and rotate once with respect to the support shafts 52 and 53.

It is to be noted that the respective pistons 3 and 4 are opposed to each other at their flat surfaces each having a large contact area with respect to the respective cylinder portions 22*a* to 23*b* during such an operation. Therefore, there is provided a structure that the fluid does not leak from the opposed surfaces or, in fact, from the gap between the surfaces which are substantially in contact with each other. Accordingly, the fluid is prevented from leaking between the respective spaces, and the pump with the high efficiency can be obtained.

Although the rotary cylinder apparatus 1 according to the first embodiment mentioned above has a structure that the number of the cylinder chambers is two (four cylinder portions) and the number of the pistons is two, the number of the piston and the cylinder chamber may be one. As in the second or third embodiment shown in FIGS. 5 and 6, the number of the cylinder chamber and the piston may be three.

Figure 5:
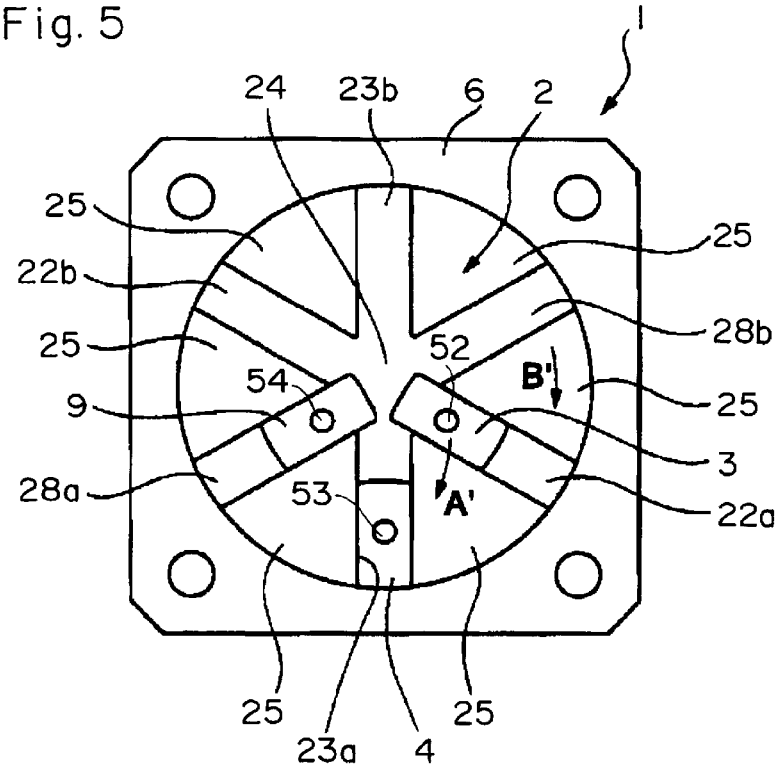
FIG. 5 is a plane view showing a second embodiment of a rotary cylinder apparatus according to the present invention and the relationship between the rotary cylinder member and the piston.

As similar to the rotary cylinder apparatus 1 according to the above-described first embodiment, in the rotary cylinder apparatus 1 shown in FIG. 5 as the second embodiment according to the present invention is rotatably provided a rotary cylinder member 2 including six cylinder portions 22*a*, 22*b*, 23*a*, 23*b*, 28*a* and 28*b* and six sector-like base portions 25 in a casing 6. That is, in this embodiment, the cylinder portions 22*a* and 22*b* and a hollow portion 24 form a cylinder chamber 22; the cylinder portions 23*a* and 23*b* and the hollow portion 24 form a cylinder chamber 23; and the cylinder portions 28*a* and 28*b* and the hollow portion 24 form a cylinder chamber 28. In addition, a piston holding member (not shown) is rotatably arranged at an eccentric position of the rotary cylinder member 2, and three pistons 3, 4 and 9 are rotatably held by this piston holding member. Incidentally, as similar to the rotary cylinder apparatus 1 according to the above-described embodiment, in regard to the ratio of rotation of both of the members arranged in the casing 6 of this rotary cylinder apparatus 1, the rotation number of the piston holding member is 2, whereas the rotation number of the rotary cylinder member 2 is 1.

In the rotary cylinder apparatus 1 having such a structure, when the respective pistons 3, 4 and 9 rotate in a direction indicated by an arrow A' by rotation of the piston holding member, the rotary cylinder member 2 rotates in a direction indicated by an arrow B' with this rotation. As a result, the piston 3 seemingly reciprocates in the cylinder chamber 22, the piston 4 seemingly reciprocates in the cylinder chamber 23, and the piston 9 seemingly reciprocates in the cylinder chamber 28, while they cross the hollow portion 24, respectively.

It is to be noted that a dimension of each of the pistons 3, 4 and 9 in the longitudinal direction is such that each piston can engage with the inner walls of the cylinder chambers on both sides of the hollow portion 24 when each piston crosses the hollow portion 24. Therefore, when each of the pistons 3, 4 and 9 crosses the, hollow portion 24, it simultaneously comes into contact with the cylinder chambers on both sides of the hollow portion 24. Meanwhile, it is needless to say that the respective pistons 3, 4 and 9 are designed so as not to collide with other pistons 3, 4 and 9 when they cross the hollow portion 24. Consequently, in the rotary cylinder apparatus 1, each of the pistons 3, 4 and 9 rotates and moves while constantly being guided by any of the cylinder chambers, and the respective pistons 3, 4 and 9 hence assuredly move in or from the respective cylinder chambers 22, 23 and 28, thus carrying out the pump operation.

Figure 6:
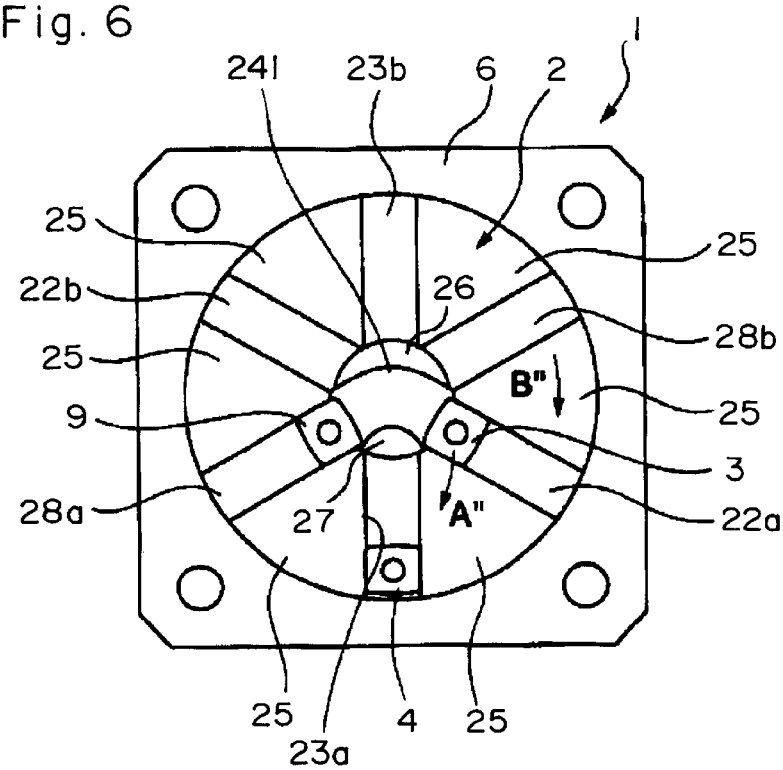
FIG. 6 is a plane view showing a third embodiment of a rotary cylinder apparatus according to the present invention and the relationship between the rotary cylinder member and the piston.

Additionally, as similar to the first and second embodiments mentioned above, in the rotary cylinder apparatus 1 shown in FIG. 6 as a third embodiment according to the present invention is rotatably arranged a rotary cylinder member 2 including six cylinder portions 22*a*, 22*b*, 23*a*, 23*b*, 28*a* and 28*b* and six sector-like base portions 25 in a casing 6, and a piston holding member (not shown) is rotatably arranged at an eccentric position of the rotary cylinder member 2. Further, three pistons 3, 4 and 9 are rotatably held by this piston holding member. Incidentally, as similar to the rotary cylinder apparatus 1 according to the embodiments shown in FIGS. 1 and 5, in regard to the ratio of rotation of both of the members arranged in the casing 6 of this rotary cylinder apparatus 1, the rotation number of the piston holding member is two, whereas the rotation number of the rotary cylinder member 2 and the rotation number of the pistons 3 and 4 are 1.

In the rotary cylinder apparatus 1 having such an arrangement, when the respective pistons 3, 4 and 9 rotate in a direction indicated by an arrow A" by rotation of the piston holding member, the rotary cylinder member 2 rotates in a direction indicated by an arrow B" with this operation. As a result, the piston 3 seemingly reciprocates in the cylinder chamber 22, the piston 4 seemingly reciprocates in the cylinder chamber 23 and the piston 9 seemingly reciprocates in the cylinder chamber 28 while they cross a hollow portion also serving as a passage 241.

It is to be noted that a guide member 26 having a semi-lunar cross section and a guide member 27 having a substantially semicircular cross section which are erected on the casing 6 are arranged on both sides of the hollow portion also serving as a passage 241, and these guide members 26 and 27 guide the respective pistons 3, 4 and 9 passing in the hollow portion also serving as a passage 241. In the rotary cylinder apparatus 1 shown in FIG. 6, each of the pistons 3, 4 and 9 is constituted by a substantially cubic block, and it is separated from any cylinder chamber when crossing the hollow portion also serving as a passage 241. Therefore, when each of the pistons 3, 4 and 9 crosses the hollow portion also serving as a passage 241, it passes while maintaining a predetermined posture by the guide members 26 and 27. In this connection, not only the guide members 26 and 27 are used, but a guiding small groove may be also provided on the bottom surface in the hollow portion also serving as a passage 241 as in the above-mentioned first embodiment so that the small groove can cooperate with the guide members 26 and 27 to guide the pistons 3, 4 and 9.

It is to be noted that, in the rotary cylinder apparatus 1 which is of a type having six cylinder chambers and three pistons as shown in FIGS. 5 and 6, suction and discharge are well balanced and the torque less fluctuates.

Figure 69:
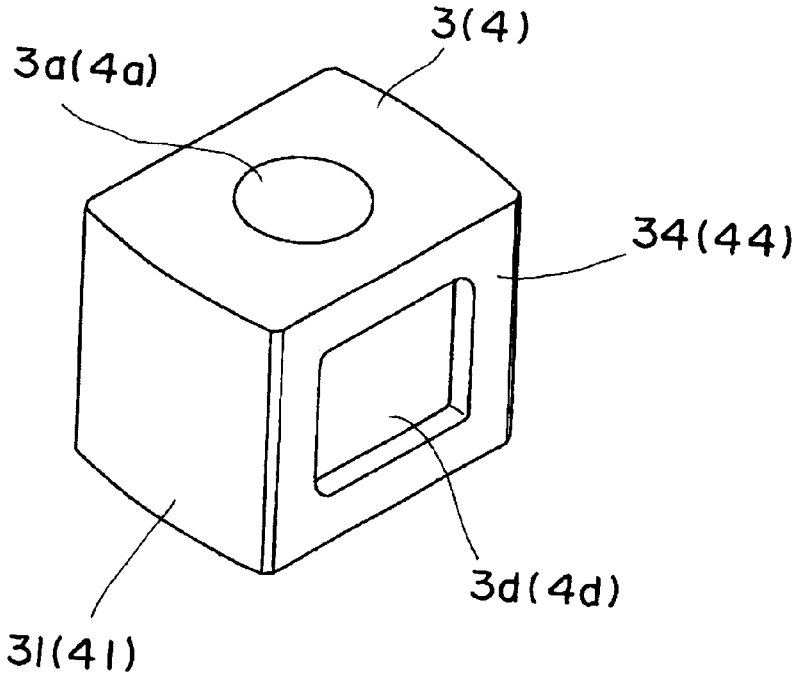

Further, in each of the foregoing embodiments, when each piston having the outer surfaces formed to be flat moves in or from each cylinder chamber having the inner walls formed into flat surfaces, the resistance force obtained by these flat surfaces being opposed to each other prevents the fluid from leaking between the respective spaces. However, a filling portion having viscous grease or the like may be provided at the position where the surface of each piston is opposed to the surface of each cylinder to increase the sealing property while maintaining the lubricity. In this case, concave portions may be provided on both side surfaces of the piston so that each concave portion functions as the filling portion. For example, as shown in FIG. 69, concave portions 3*d* and 4*d* may be formed on both side surfaces 34 and 44 of the pistons 3 and 4 as the filling portions and the above-mentioned viscous grease or the like may be filled in these concave portions 3*d* and 4*d*. It is to be noted that forming the concave portions 3*d* and 4*d* can alleviate the resistance caused by the reciprocating motion of the pistons 3 and 4 even if the lubricant is not used.

Figure 7:
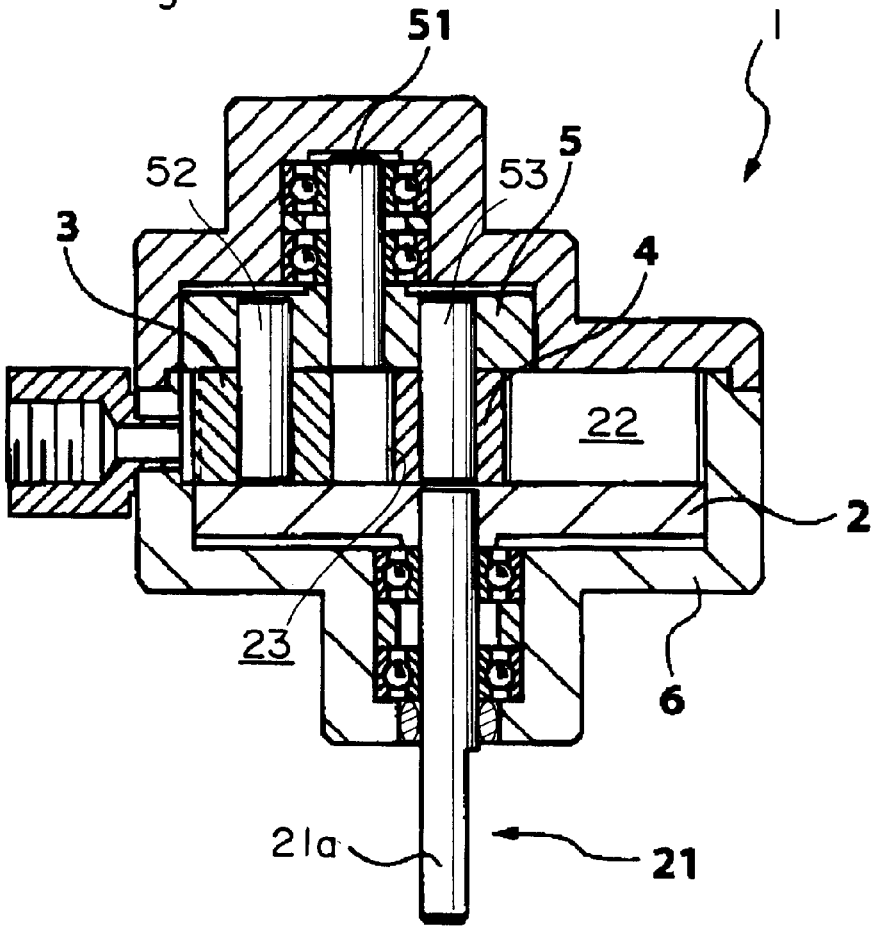
FIG. 7 is a vertical cross-sectional view showing a modification of the rotary cylinder apparatus according to the first embodiment of the present invention.
Figure 9:
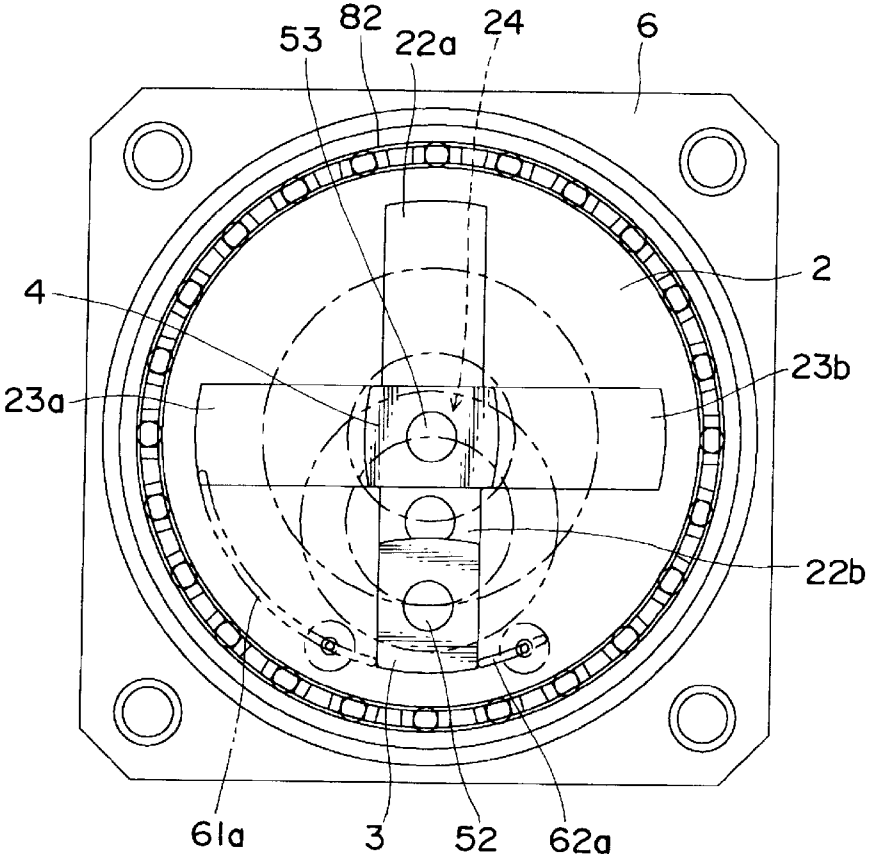
FIG. 9 is a plane view of the rotary cylinder apparatus of FIG. 8 from which a casing cover is removed.
Figure 8:
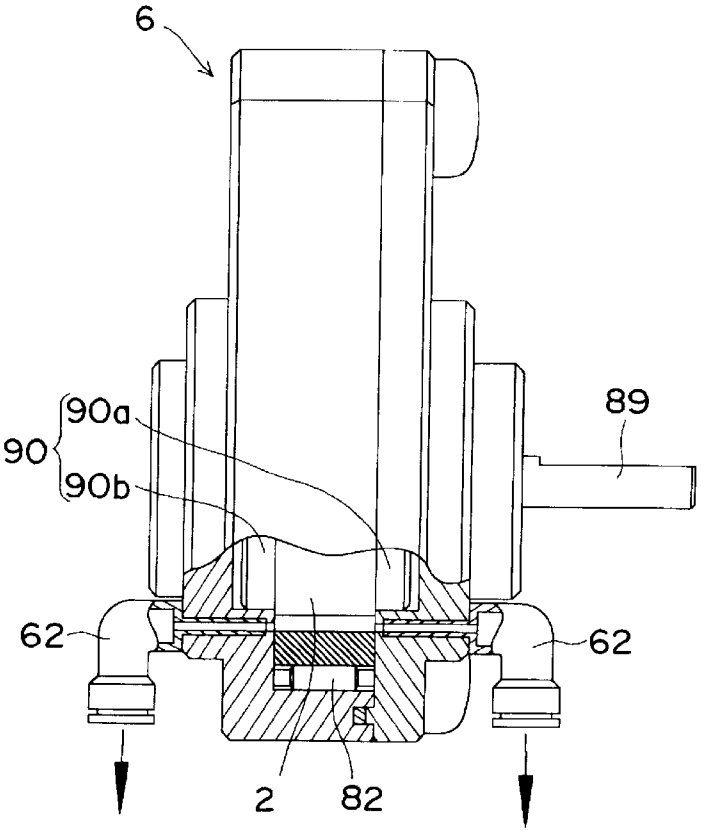
FIG. 8 is a side view of a fourth embodiment of a rotary cylinder apparatus according to the present invention, in which a part is notched.
Figure 10:
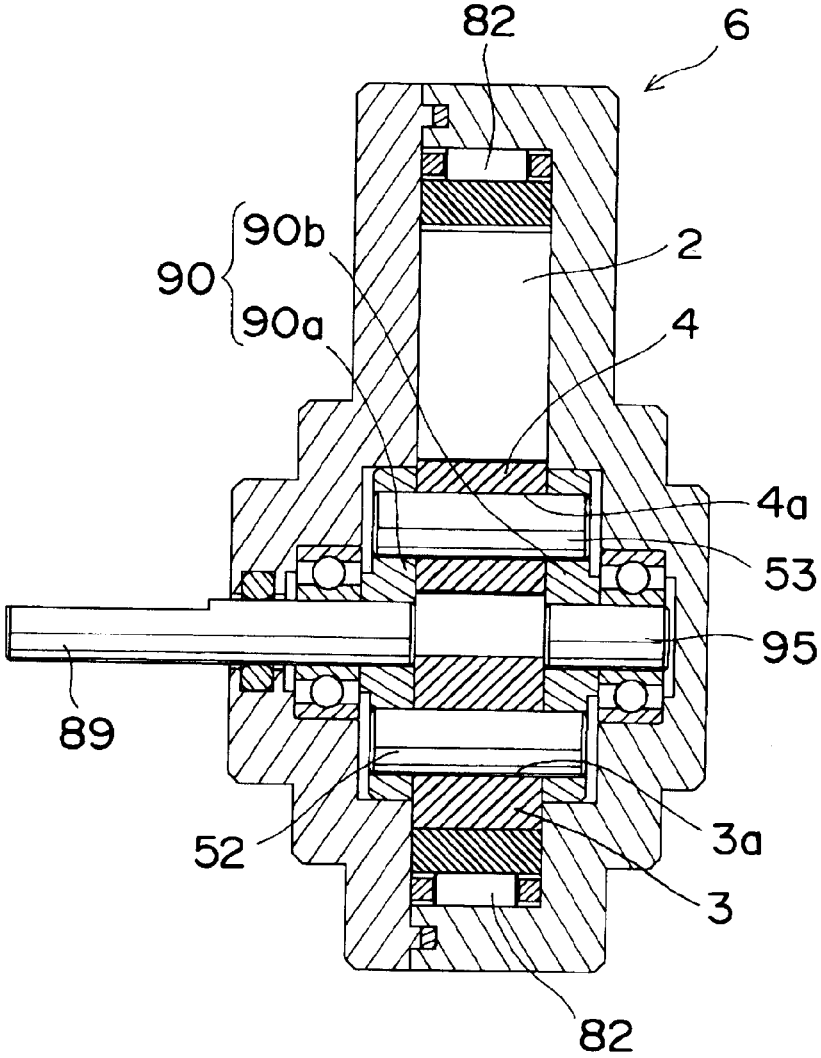
FIG. 10 is a vertical cross-sectional view of the rotary cylinder apparatus of FIG. 8.
Figure 11:
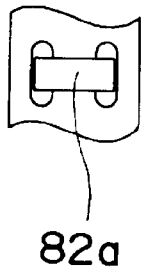
FIG. 11 is an enlarged view showing a part of a bearing.

Furthermore, in the first embodiment mentioned above, the shaft 51 of the piston holding member 5 protrudes from the casing 6, and connecting this protruding portion to the drive source rotates the piston holding member 5 and causes the rotary cylinder member 2 to follow this rotation. However, as in the rotary cylinder apparatus 1 shown in FIG. 7, on the contrary, the shaft 21 of the rotary cylinder member 2 may protrude from the casing 6, and connecting the end portion 21*a* of the shaft 21 to a drive source (not shown) such as a motor may determine the shaft 21 as an input side and cause the piston holding member 5 to follow the rotary cylinder member 2. With such a structure, a so-called center drive system is obtained, and the settlement as a product can be improved when the shaft 21 is directly connected to the motor.

Furthermore, in the first embodiment described above, both the concave portion 61*a* of the suction opening 61 and the concave portion 62*a* of the discharge opening 62 are configured to have a width of approximately 80 degrees. However, the width of each of the concave portions 61*a* and 62*a* can be arbitrarily set in accordance with applications. For example, if a high compression ratio is applied, i.e., the present invention is used in, e.g., an air compressor, when the concave portion 62*a* of the discharge opening 62 is formed to have a small capacity of approximately 10 degrees, the compression ratio can be increased. As a result, the fluid can be discharged from the discharge opening 62 to the outside at a burst.

Furthermore, in the above-described first embodiment, the suction opening 61 and the discharge opening 62 are provided at positions opposed to the outer peripheral surface of the rotary cylinder member 2 in the casing 6 so that suction and discharge are carried out from the outside of the rotary cylinder member 2. However, the suction opening 61 and the discharge opening 62 may be provided on both sides in the vertical direction of the rotary cylinder 2 or one side of the same.

Moreover, in the above-described first embodiment, the piston holding member 5 is arranged on one surface side of the rotary cylinder member 2, and the support shafts 52 and 53 protrude from the piston holding member 5 toward the inside of the cylinder portions 22*a*, 22*b*, 23*a* and 23*b* of the rotary cylinder member 2. Consequently, the pistons 3 and 4 held by the support shafts 52 and 53 are arranged in the cylinder chambers consisting of a cruciform space of the rotary cylinder member 2. However, as shown in FIGS. 8 to 11, the piston holding members 90 may be constituted by two discoid members 90*a* and 90*b* and may be arranged on both sides of the rotary cylinder member 2. This will now be described hereinafter as a fourth embodiment.

In the fourth embodiment, as shown in FIGS. 8 to 11, a bearing member 82 having an annular shape in which multiple needles 82*a* are arranged at equal intervals is provided on the inner wall of the circular space in the casing 6, and the rotary cylinder member 2 is rotatably supported inside the bearing member 82. To this rotary cylinder member 2 is formed a cruciform space that each end portion does not pierce toward the outer side in the radial direction but pierces on both of the sides in the axial direction. The central portion of this cruciform space corresponds to the hollow portion 24, and portions radially formed from the hollow portion 24 correspond to the cylinder portions 22*a*, 22*b*, 23*a* and 23*b*. In the thus formed cruciform space, a block-like piston 3 having a hole 3*a* at the center thereof and a block-like piston 4 having a hole 4*a* at the center thereof are slidably fitted.

One end of a drive shaft 89 protruding to the outside of the casing 6 and a piston holding member 90 fixed with a shaft 95 as a center of rotation are arranged on both sides of the rotary cylinder member 2 in the axial direction. That is, the piston holding member 90 is constituted by two discoid members 90*a* and 90*b* arranged with the rotary cylinder member 2 therebetween, and these members are connected to each other by two support shafts 52 and 53 to which the pistons 3 and 4 are inserted. In addition, when the protruding portion of the drive shaft 89 is connected to a drive source (not shown) such as a motor to rotate the piston holding member 90, the piston 3 moves in a cylinder chamber 22 composed of the cylinder portions 22*a* and 22*b* and the hollow portion 24 in the sliding manner, and the piston 4 moves in a cylinder chamber 23 composed of the cylinder portions 23*a* and 23*b* and the hollow portion 24 in the sliding manner. By this operation, the rotary cylinder member 2 rotates at a ½ speed of the speed of the piston holding member 90 in the same direction as that of the piston holding member 90, and the respective cylinder portions 22*a*, 22*b*, 23*a* and 23*b* communicate with a non-illustrated suction opening and a discharge opening 62.

It is to be noted that the operation in the fourth embodiment is similar to that in the first embodiment and the pump action is enabled by this operation. When this fourth embodiment is used as a pump, since the respective cylinder portions 22*a* to 23*b* do not communicate with the outer peripheral surface of the rotary cylinder member 2, a suction and discharge mechanism is provided at an outmost peripheral portion which enables communication with the respective cylinder portions 22*a* to 23*b* on both end surfaces or one end surface of the rotary cylinder member 2.

In each of the foregoing embodiments, any one of the rotary cylinder member and the piston holding member protrudes from the casing as the input side, and the other one is incorporated in the casing 6 as the following side. However, both shafts 21 and 51 may protrude from the casing 6, and one rotary cylinder apparatus may cope with both of the types. Additionally, in each of the foregoing embodiments, there is provided the apparatus performing the pump action by rotating the cylinder member by using drive force of the motor, but the apparatus may be configured to rotate both shafts 21 and 51 by feeding the fluid into the cylinder member so that outputs can be obtained from these shafts 21 and 51.

Figure 13:
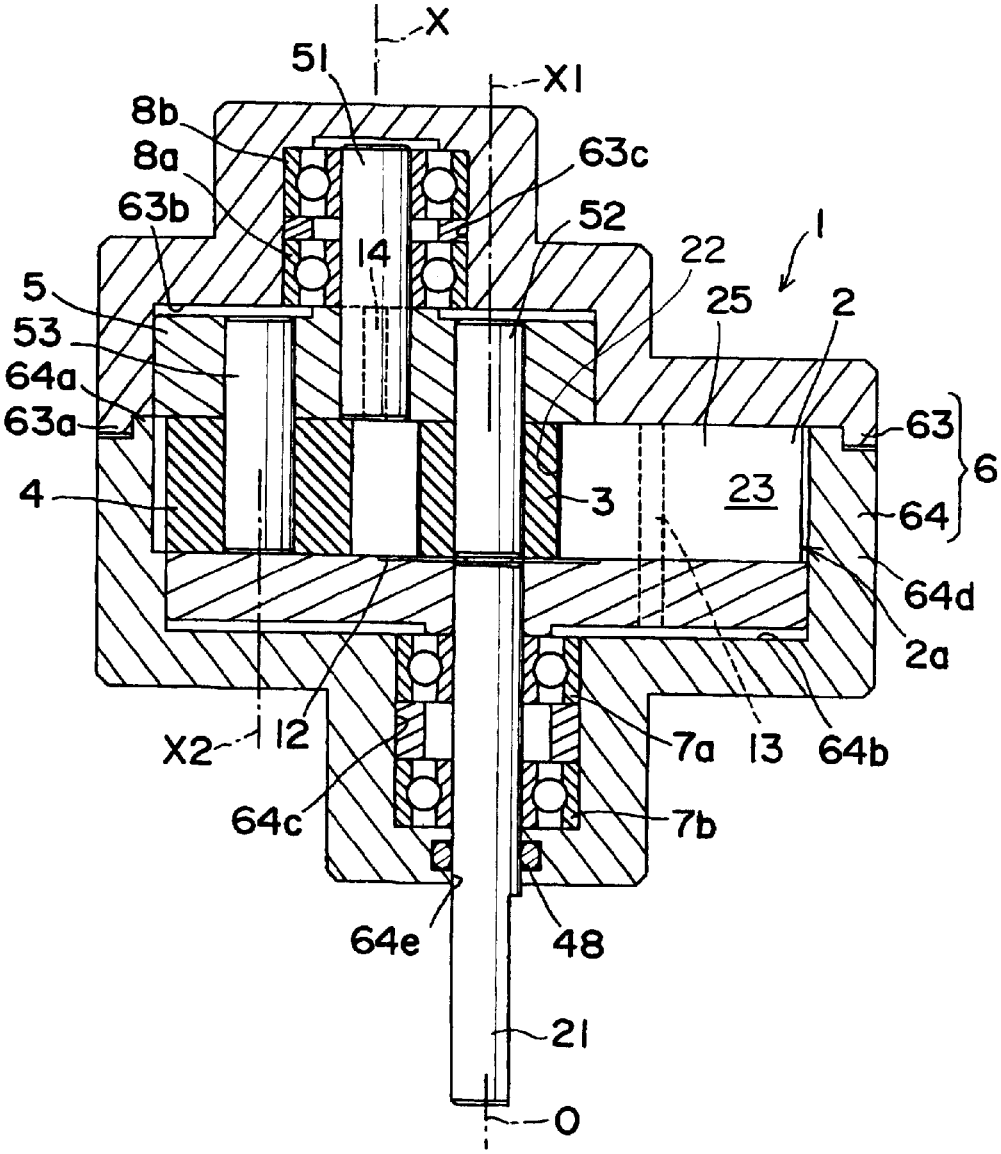
FIG. 13 is a vertical cross-sectional view showing an embodiment in which the rotary cylinder apparatus according to the present invention is configured as a fluid rotating machine.
Figure 14:
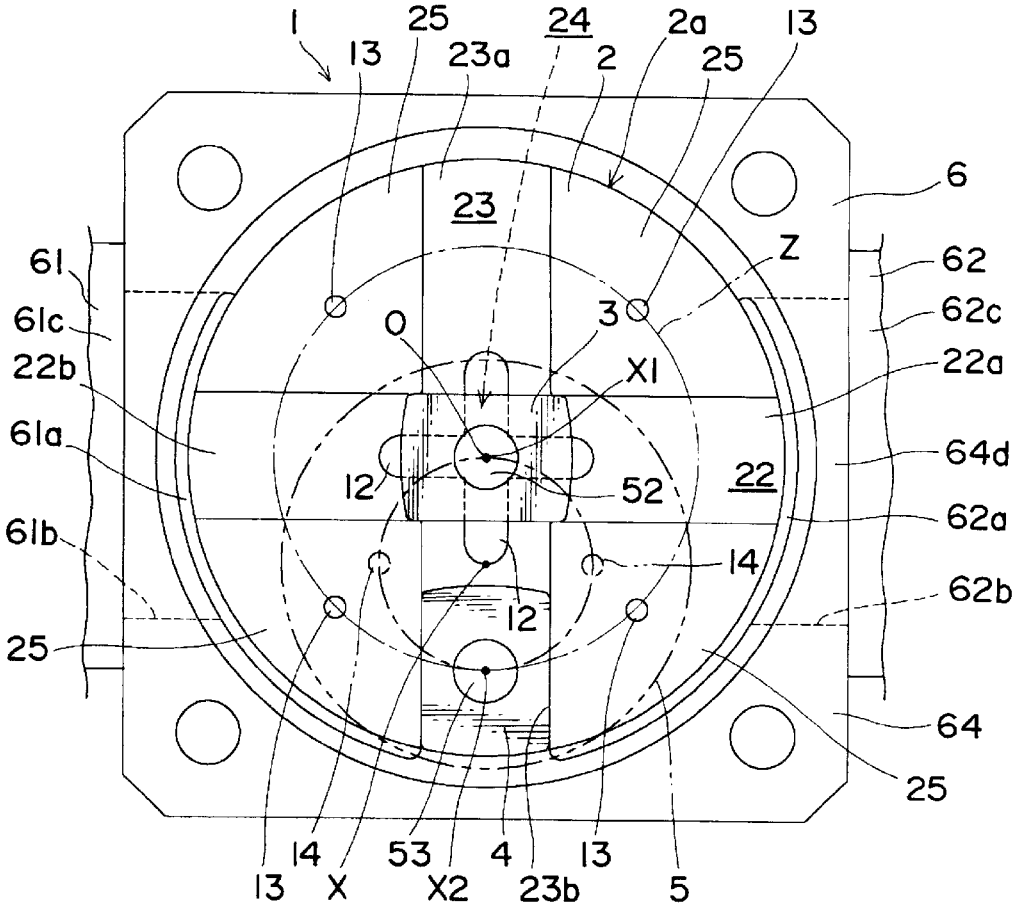
FIG. 14 is a plane view showing the fluid rotating machine of FIG. 13 from which the upper case and the piston holding member are removed.
Figure 15:
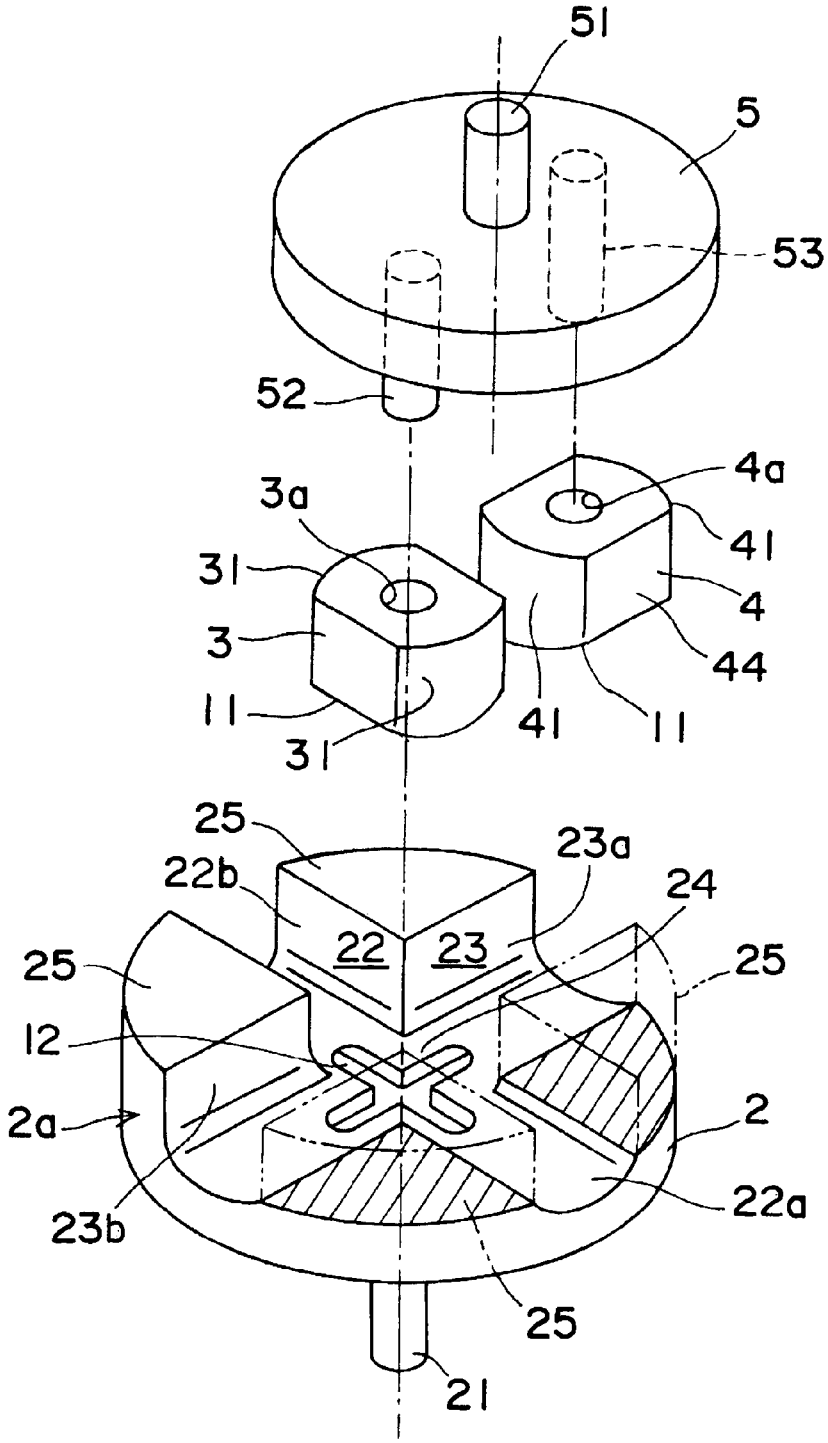
FIG. 15 is an exploded perspective view showing the rotary cylinder member, the piston holding member and the piston of the fluid rotating machine of FIG. 13.

FIGS. 13 to 15 show an embodiment in which the rotary cylinder apparatus according to the present invention is configured as a fluid rotating machine which obtains a rotation output by using energy of the fluid. It is to be noted that the fluid used as a drive source in this embodiment is not restricted to a liquid such as oil or water, and may be a gaseous body such as air or gas. Further, like reference numerals denote the structures/principles which are basically the same as those described in connection with the embodiments shown in FIGS. 1 to 4, thereby omitting their explanation.

In this embodiment, a shaft 21 which is a center of rotation of a rotary cylinder member 2 is determined as an output shaft, and its end protrudes to the outside from a casing 6. Furthermore, guiding means consisting of guide grooves 26*a* and 27*a* and convex pieces 3*b* and 4*b* is not formed between the pistons 3 and 4 and the cylinder member 2, but movement of each piston is guided by only three surfaces, i.e., both of the side surfaces of the cylinder chambers 22 and 23 and the bottom surface. That is, the lateral cross-sectional shape of the groove forming the cylinder chambers 22 and 23 matches with the lateral cross-sectional shape of the pistons 3 and 4 which will be described later in detail. Moreover, one end side (central side) of each of the cylinder portions 22*a* to 23*b* in the longitudinal direction communicates with the hollow portion 24.

It is to be noted that the bottom surface of the hollow portion 24 has a shape according to each of the cylinder portions 22*a* to 23*b*. That is, the lateral cross-sectional shape of each of the cylinder portions 22*a* to 23*b* is equal to the cross-sectional shape of the hollow portion 24 connected to these portions. By forming the cruciform groove to a thick circular plate material by, e.g., a cutting method, it is possible to form a cruciform groove consisting of the hollow portion 24 and the cylinder portions 22*a* to 23*b*. In addition, since both of the corner portions of the bottom surface of the cruciform groove manufactured by a cutting method or the like may have a rounded shape, its processing is very easy.

Figure 16A:
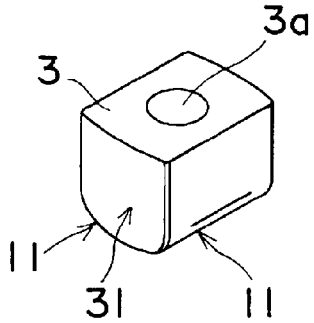
FIGS. 16A and 16B are a perspective view and a vertical cross-sectional view showing a first example of the shape of the piston.

Here, as shown in, e.g., FIG. 16A, each of the pistons 3 and 4 has a shape obtained by rounding both of the corner portions 11 of its bottom surface, and its lateral cross-sectional shape is matched with the lateral cross-sectional shape of each of the cylinder portions 22*a* to 23*b*. Additionally, a top surface of each of the pistons 3 and 4 (surface opposed to the piston holding member 5) is a flat surface. Therefore, the top surface, both of the side surfaces and the bottom surface of each of the pistons 3 and 4 are brought into contact with the surface of each of the cylinder portions 22*a* to 23*b* closed by the casing 6 and the piston holding member 5 over the entire length of each of the pistons 3 and 4, thereby assuring the air-tightness/liquid-tightness between the cylinder portions 22*a* to 23*b* and the pistons 3 and 4. That is, the fluid can be further assuredly prevented from leaking.

Additionally, an insertion hole 64*e* for inserting an output shaft 21 therethrough is provided on the bottom surface of a small space 64*c* of a lower case 64. An end of the output shaft 21 protrudes to the outside of the casing 6 from the insertion hole 64*e*. Further, providing a concave groove on the inner surface of the insertion hole 64*e* and further providing an O ring 48 at that groove can seal between the output shaft 21 and the lower case 64. As a result, the pressure can be prevented from being released.

An inlet 61 for a fluid is opened by rotation of the rotary cylinder member 2 so as to communicate with the cylinder portions 22*a* to 23*b* when the pistons 3 and 4 reach substantially outer peripheral positions of the rotary cylinder member 2 as seen from the rotary shaft center O of the rotary cylinder member 2, and is closed so as not to communicate with the cylinder portions 22*a* to 23*b* when the pistons 3 and 4 are at a position of substantially 45 degrees of the rotary cylinder member 2.

Furthermore, an outlet 62 for a fluid communicates with a shallow concave portion 62*a* formed on the inner wall 64*d* of a large space 64*b*. That is, the outlet 62 for a fluid is opened by rotation of the rotary cylinder member 2 so as to communicate with the cylinder portions 22*a* to 23*b* when the pistons 3 and 4 reach a position of approximately 45 degrees of the rotary cylinder member 2 as seen from the rotary shaft center O of the rotary cylinder member 2, and is closed so as not to communicate with the cylinder members 22*a* to 23*b* when the pistons 3 and 4 reach a substantially outer peripheral position of the rotary cylinder member 2.

The fluid inlet 61 and the fluid outlet 62 are formed so as to reduce the flow resistance relative to a flow of a fluid and carry out the continuous rotary operation. For example, the fluid inlet 61 and the fluid outlet 62 are formed at positions opposed to each other with the rotary cylinder member 2 therebetween in such a manner that the fluid can flow straight without changing its direction in the casing 6. A concave portion 61*a* of the fluid inlet 61 and a concave portion 62*a* of the fluid outlet 62 are formed in a wide area with respect to a rotating direction of the rotary cylinder member 2. For example, the concave portion 61*a* is formed across an area from a position passing the cylinder portion (cylinder portion 23*b* in FIG. 14) with the pistons 3 and 4 having moved to the outmost side to a position where a communication hole 61*b* is formed, with respect to a rotating direction of the rotary cylinder member 2. Furthermore, the concave portion 62*a* is formed across an area from a position where a communication hole 62*b* starts to a position immediately before the cylinder portion (cylinder portion 23*b* in FIG. 14) with the pistons 3 and 4 having moved to the outmost side. Moreover, each of the communication hole 61*b* of the fluid inlet 61 and the communication hole 62*b* of the fluid outlet 62 has a passage area which is sufficiently larger than each of the cylinder portions 22*a* to 23*b*. In this manner, the fluid inlet 61 and the fluid outlet 62 are formed at opposed positions, each of the concave portions 61*a* and 62*a* is formed in a wide area, and each of the communication holes 61*b* and 62*b* is formed to have a large passage area. Thus, the flow resistance of the fluid becomes small.

As shown in FIG. 14, the concave portion 61*a* of the fluid inlet 61 and the concave portion 62*a* of the fluid outlet 62 are formed so as to be line symmetric with a line running through the rotary shaft center O of the rotary cylinder member 2 and the rotation central position X of the piston holding member 5 therebetween. A position of the concave portion 61*a* on the lower end side in FIG. 14 is formed to the vicinity of the line running through the rotary shaft center O and the rotation central position X. More specifically, it is a position close to a substantially half of the distance from the line to the piston 4 (or 3), i.e., the fluid inlet side. Furthermore, a position of the concave portion 61*a* on the upper end side in FIG. 14 corresponds to a position obtained when a substantially 135-degree turn is made from the line running through the rotary shaft center O and the rotation central position X in the clockwise direction and further another turn corresponding to a substantially half of the width of the piston 4 (or 3) is made in the counterclockwise direction. Moreover, since a flow path cross sectional area of each of the concave portions 61*a* and 62*a* can be controlled by a value in a depth direction, it is set so as to decrease the fluid resistance.

This fluid rotating machine 1 is provided with back pressure releasing means. The back pressure releasing means is constituted by, for example, piston back-and-forth movement back pressure releasing means 12, cylinder side back pressure releasing means 13 and a piston holding member side back pressure releasing means 14.

The piston back-and-forth movement back pressure releasing means 12 is, for example, a cruciform groove formed at the center of the bottom surface of the hollow portion 24. The cruciform groove 12 as this piston back-and-forth movement back pressure releasing means is formed so as to be slightly longer than the length of each of the pistons 3 and 4. As shown in FIG. 14, even if the pistons 3 and 4 are positioned in the hollow portion 24, it can cause the respective cylinder portions 22*a* to 23*b* to communicate. Therefore, even if a non-compressible liquid is used as a fluid, the pistons 3 and 4 are not locked by the liquid pressure and the smooth operation is enabled. Incidentally, the passage cross sectional area of the cruciform groove 12 is sufficiently smaller than the lateral cross sectional area of each of the pistons 3 and 4. Since the pressure of the fluid flowing into the cylinder portions 22*a* to 23*b* from the fluid inlet 61 practically acts on the pistons 3 and 4, the efficiency as the fluid rotating machine 1 is not deteriorated. However, the cruciform groove 12 as the piston back-and-forth movement back pressure releasing means may be eliminated when gas is used as the fluid, for example.

Figure 17:
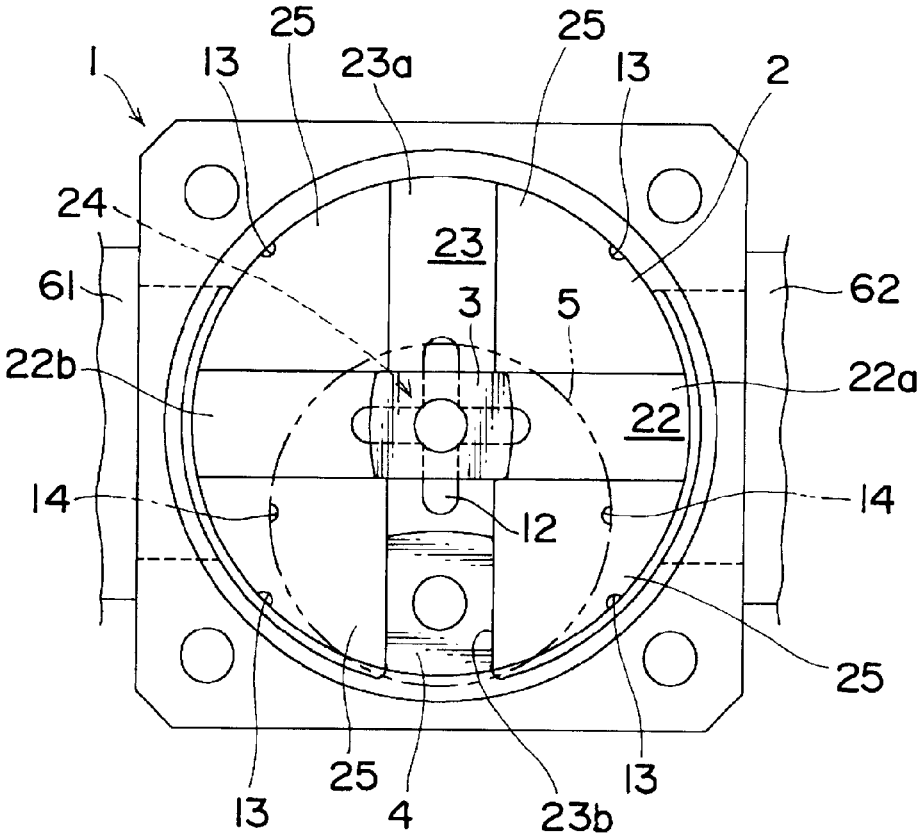
FIG. 17 shows a second example of back pressure releasing means and is a plan view illustrating the fluid rotating machine from which the upper case and the piston holding member are removed.
Figure 18B:
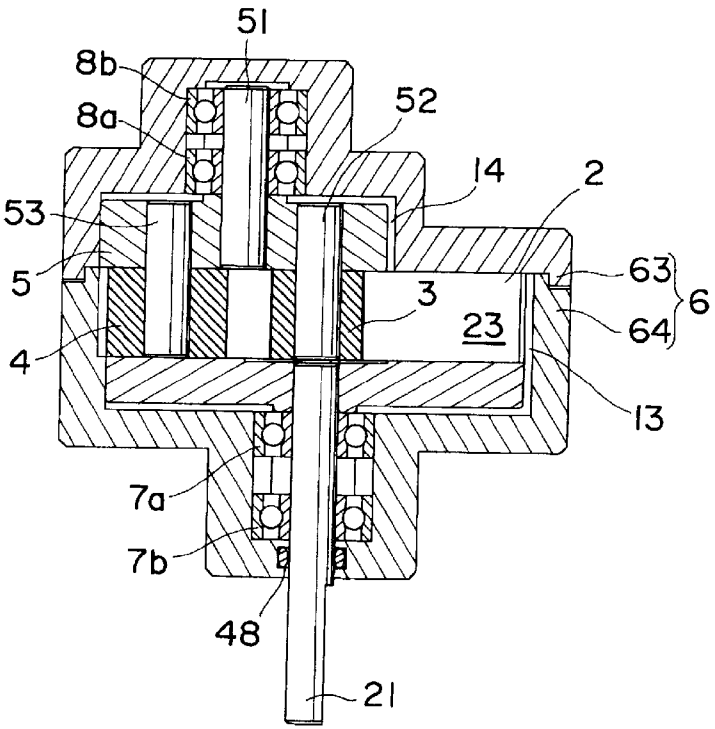
Figure 18A:
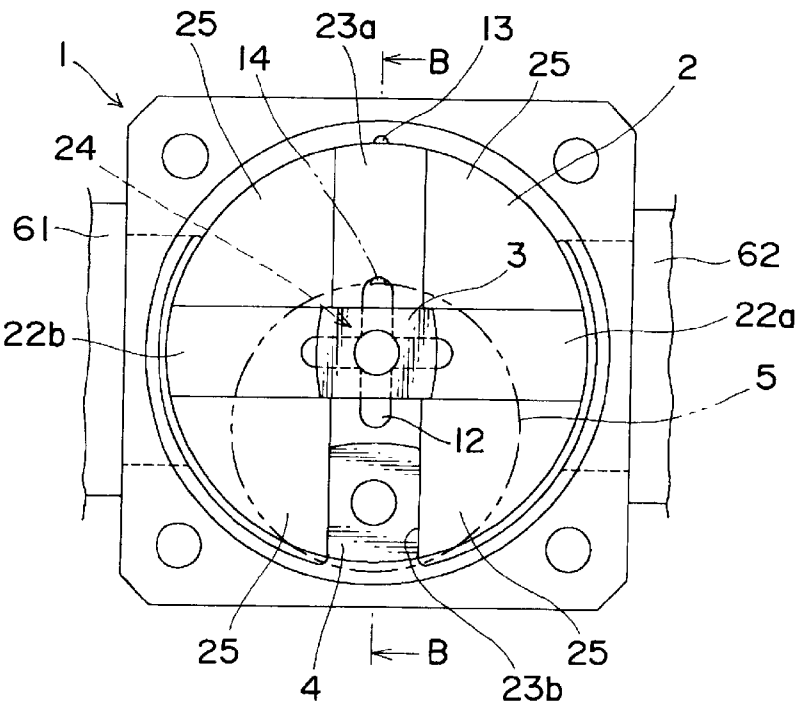
Figure 19B:
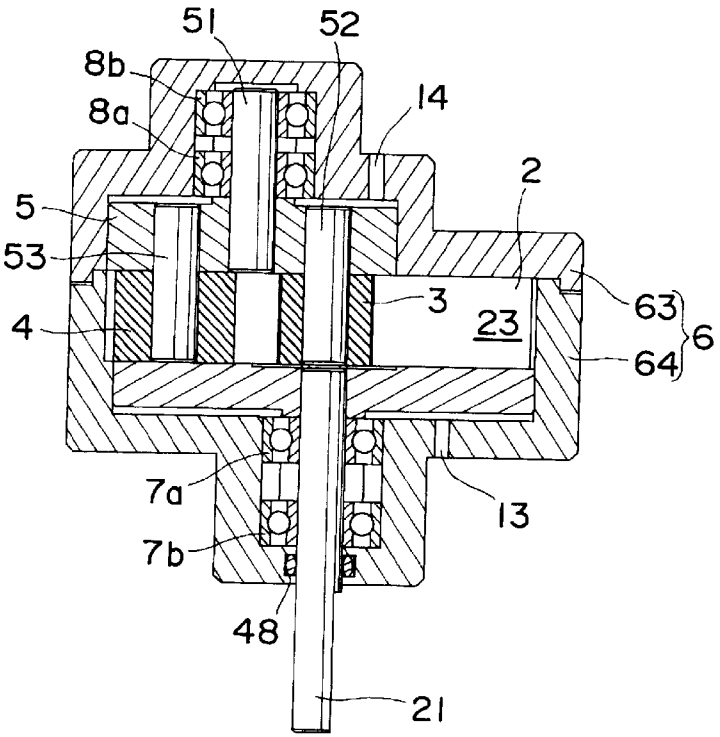
Figure 19A:
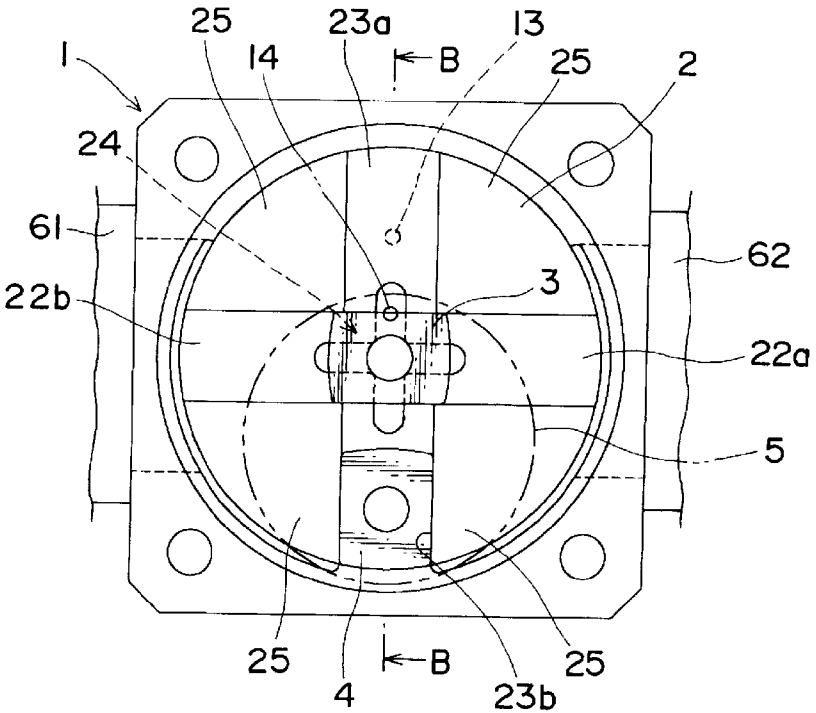
Figure 38:
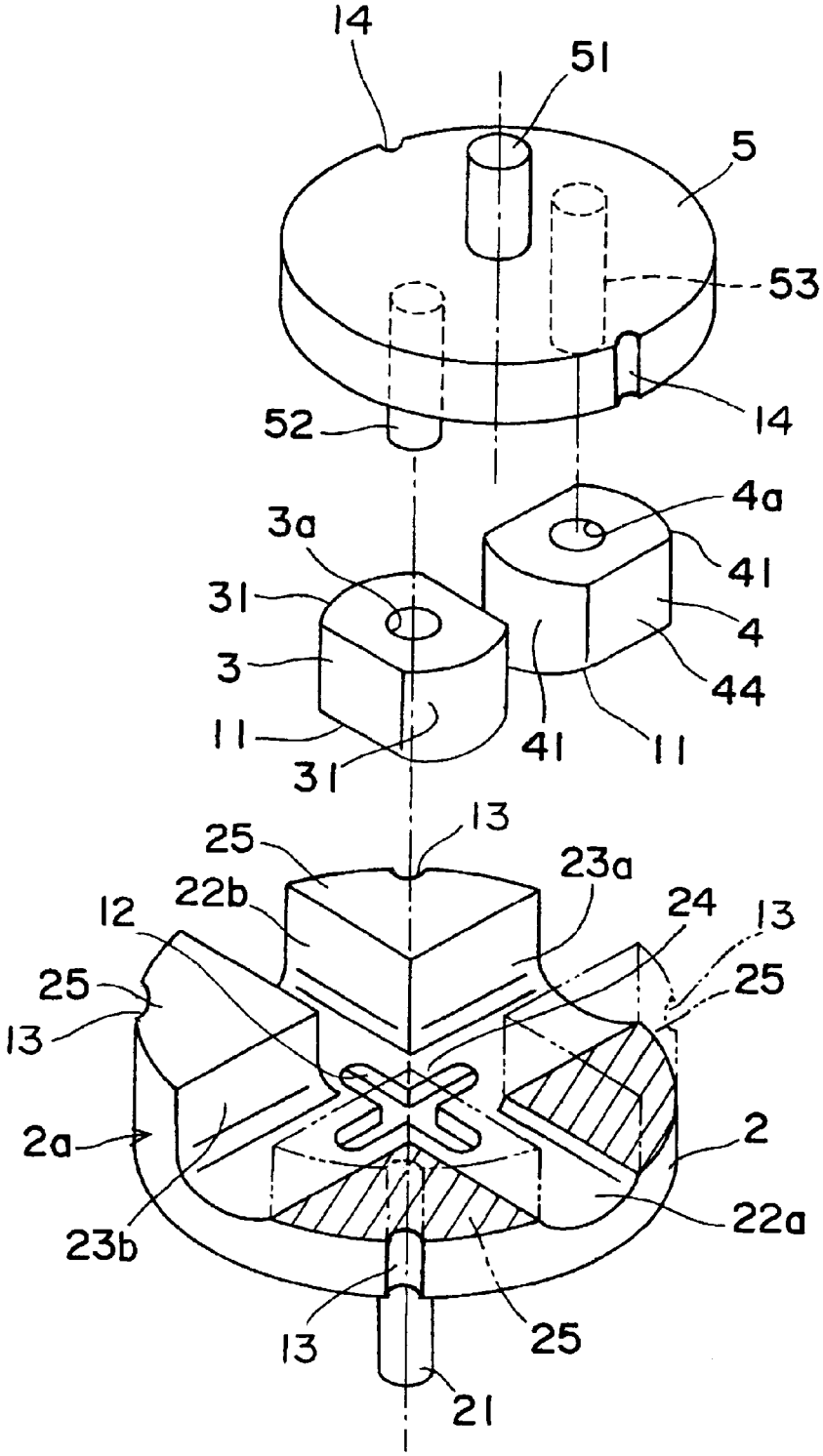
FIG. 38 is an exploded perspective view showing the rotary cylinder member, the piston holding member and the piston of the fluid rotating machine in which the second example of the back pressure releasing means depicted in FIG. 17 is applied.

The cylinder side back pressure releasing means 13 is used for releasing the back pressure generated between the rotary cylinder member 2 and the lower case 64 during the operation of the fluid rotating machine 1 and smoothing rotation of the rotary cylinder member 2 and the like, and it is, for example, a hole 13 (FIG. 14) piercing the four base portions 25. However, the cylinder side back pressure releasing mean is not restricted to the hole 13 piercing the base portions 25, and for example it may be a groove 13 formed on an outer peripheral surface of the rotary cylinder member 2 as shown in FIGS. 17 and 38, or it may be a groove 13 formed on an inner wall 64*d* of the lower case 64 as shown in FIGS. 18A and 18B. These three types of the cylinder side back pressure releasing means 13 have a structure for releasing the back pressure by uniformizing the pressures on both of the sides of the rotary cylinder member 2 and can prevent the fluid from leaking to the outside of the casing 6. Further, if it is possible to allow the fluid to leak to the outside of the casing 6, as shown in FIGS. 19A and 18B, for example, the through hole 13 is formed to the lower case 64 as the cylinder side back pressure releasing means so that the back pressure is released to the outside of the casing 6.

The piston holding member side back pressure releasing means 14 is used for releasing the back pressure generated between the piston holding member 5 and the upper case 63 to smooth rotation of the piston holding member 5 during the operation of the fluid rotating machine 1, and it is, for example, a hole 14 (FIG. 14) piercing the piston holding member 5. However, the piston holding member side back pressure releasing means is not restricted to the hole 14 piercing the piston holding member 5, and it may be a groove 14 formed on an outer peripheral surface of the piston holding member 5 as shown in FIGS. 17 and 38, or it may be a groove 14 formed on an inner peripheral surface of the upper case 63 as shown in FIGS. 18A and 18B. These three types of piston holding member side back pressure releasing means 14 have a structure for releasing the back pressure by uniformizing the pressure on both of the sides of the piston holding member 5 and can prevent the fluid from leaking to the outside of the casing 6. Furthermore, if it is possible to allow the fluid to leak to the outside of the casing 6, for example, a through hole 14 may be formed to the upper case 63 as the piston holding member side back pressure releasing means so that the back pressure is released to the outside of the casing 6, as shown in FIGS. 19A and 19B.

Figure 21:
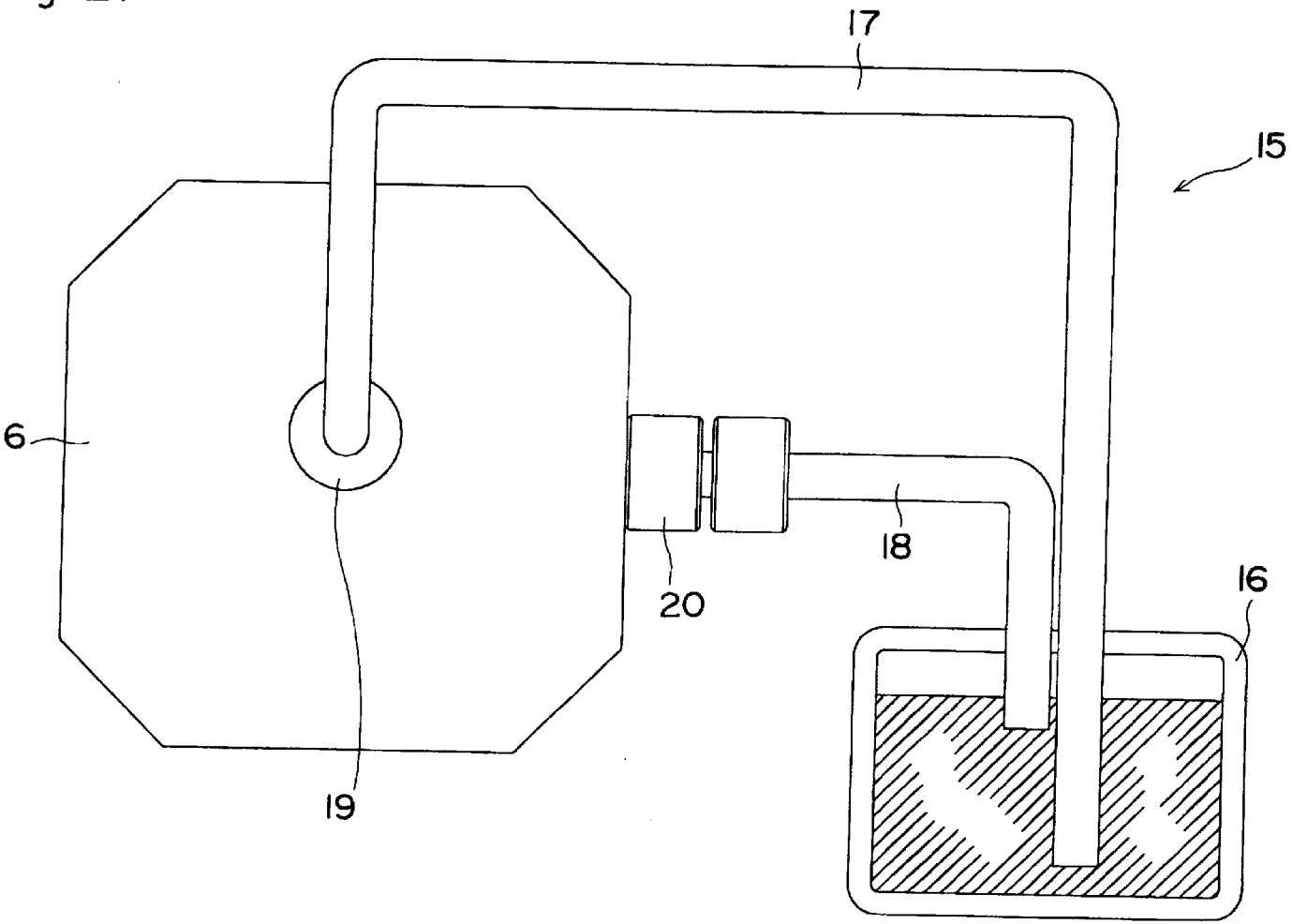
FIG. 21 is a schematic block diagram showing a lubricant circulation mechanism.
Figure 22:
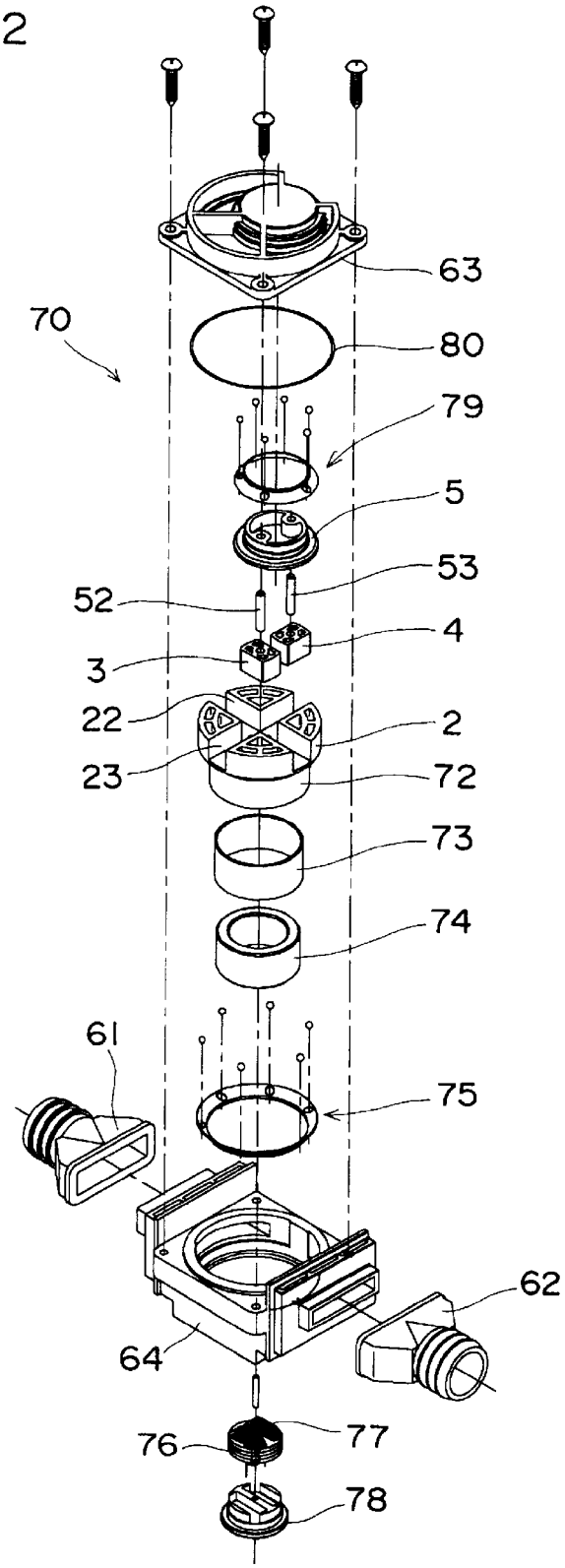
FIG. 22 is an exploded perspective view of a fluid electric generator in which the rotary cylinder apparatus according to the present invention is incorporated to a drive source.
Figure 23:
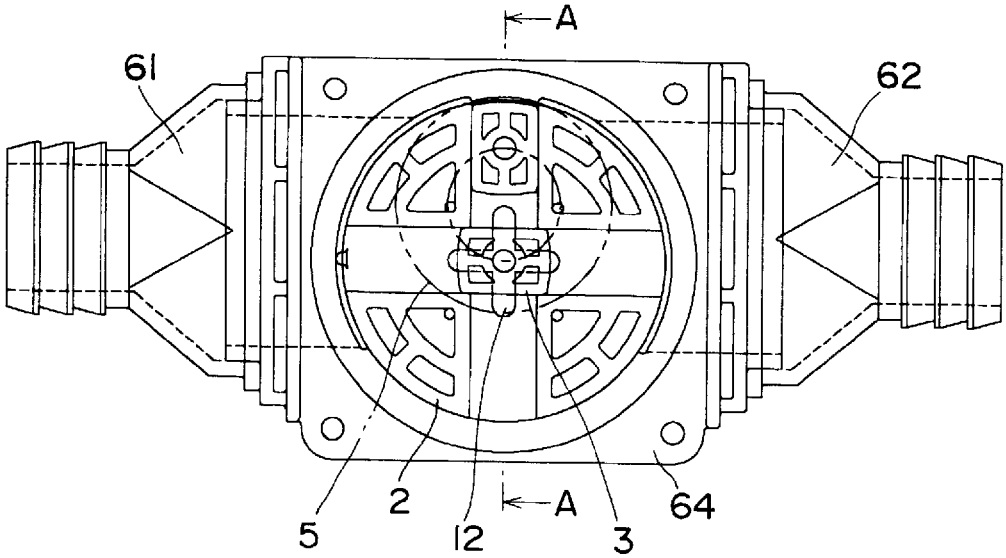
FIG. 23 is a plane view of the fluid electric generator from which the upper case and the piston holding member are removed.
Figure 24:
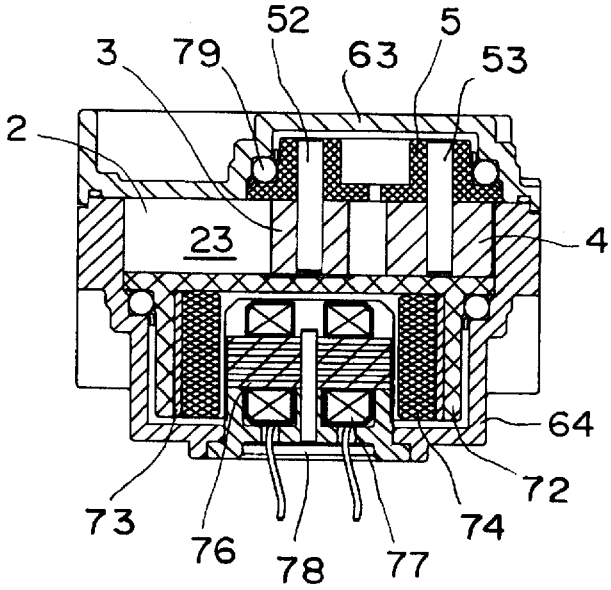
FIG. 24 is a cross-sectional view taken along the line A—A in FIG. 23.
Figure 25:
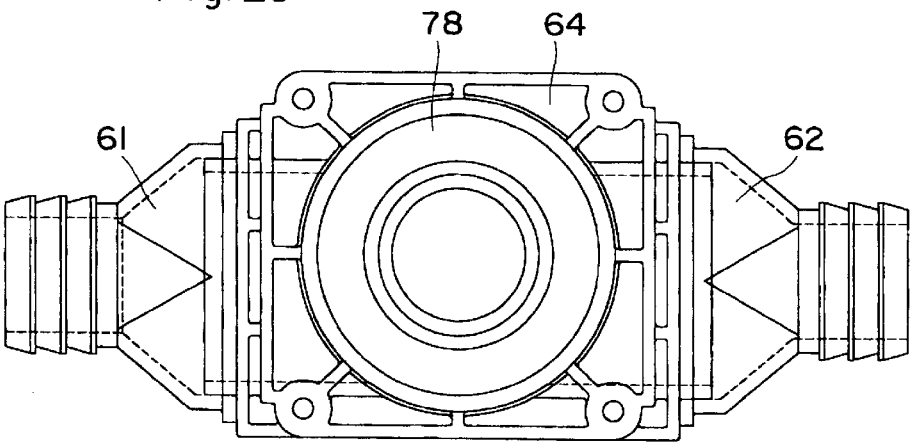
FIG. 25 is a bottom view of the fluid electric generator depicted in FIG. 22.
Figure 26:
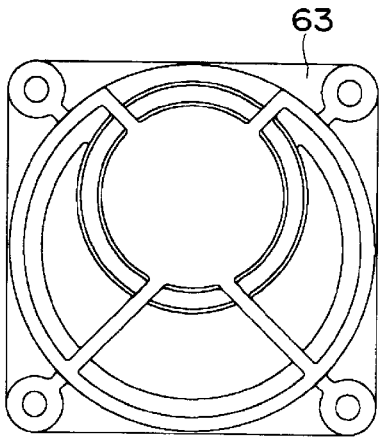
FIG. 26 is a plane view showing the upper case of the fluid electric generator depicted in FIG. 22.
Figure 27:
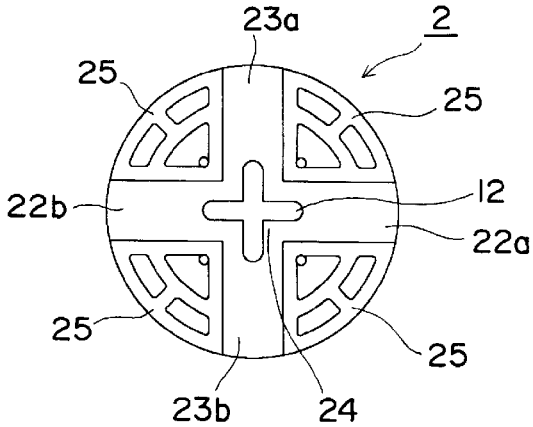
FIG. 27 is a plane view showing the rotary cylinder member of the fluid electric generator depicted in FIG. 22.
Figure 28:
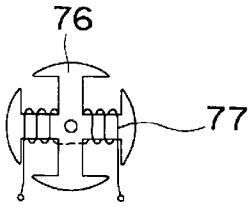
FIG. 28 is a plane view showing a yoke and a winding of the fluid electric generator illustrated in FIG. 22.
Figure 29A:
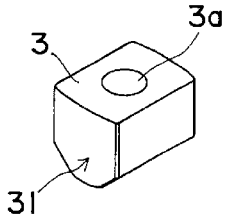
FIGS. 29A and 29B are a perspective view and a vertical cross-sectional view showing a second example of the shape of the piston.
Figure 29B:
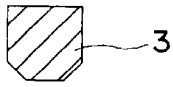
Figure 30A:
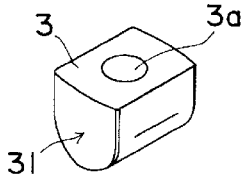
FIGS. 30A and 30B are a perspective view and a vertical cross-sectional view showing a third example of the shape of the piston.
Figure 30B:
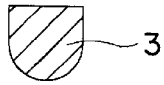
Figure 31A:
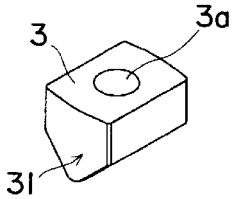
FIGS. 31A and 31B are a perspective view and a vertical cross-sectional view showing a fourth example of the shape of the piston.
Figure 31B:
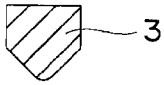
Figure 32A:
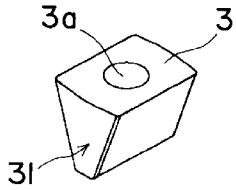
FIGS. 32A and 32B are a perspective view and a vertical cross-sectional view showing a fifth example of the shape of the piston.
Figure 32B:
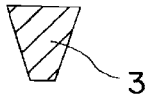
Figure 33A:
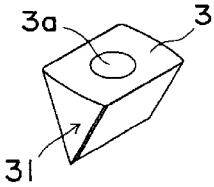
FIGS. 33A and 33B are a perspective view and a vertical cross-sectional view showing a sixth example of the shape of the piston.
Figure 33B:
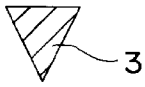

Moreover, the fluid rotating machine 1 is provided with a lubricant circulation mechanism 15. For example, as shown in FIG. 21, this lubricant circulation mechanism 15 includes: a lubricant tank 16; a lubricant inflow passage 17 which communicates with the back surface of the rotary cylinder member 2 and leads the lubricant from the lubricant tank 16 into the casing 6; and a lubricant outflow passage 18 which communicates with the back surface side of the piston holding member 5 and leads the lubricant to the lubricant tank 16. A non-illustrated filter is provided in the middle of the lubricant inflow passage 17. Incidentally, as the lubricant, any material having the lubricity such as lubrication oil, lubrication grease, water, gas or any other fluid can be used.

The lubricant inflow passage 17 is connected to a port 19 provided to the upper case 63. The lubricant led from the port 19 into the upper case 63 is transmitted through the gap between the respective members in the casing 6, the cylinder side back pressure releasing means 13, the piston holding member side back pressure releasing means 14 and others to lubricate the sliding surfaces. The lubricant then flows out from a port 20 provided to the lower case 64 to the lubricant outflow passage 18 and is circulated to the lubricant tank 16. This lubricant circulates to the lubricant tank 16, the lubricant inflow passage 17, inside of the casing 6, the lubricant outflow passage 18, and the lubricant tank 16 in the mentioned order by utilizing a difference in pressure generated by rotation of the rotary cylinder member 2 and the piston holding member 5.

The fluid rotating machine 1 having the above-described structure rotates by a pressure of the fluid. That is, when the fluid is supplied to the fluid inlet 61, the piston holding member 5 and the rotary cylinder member 2 and the like demonstrates the rotary motion, thereby taking out the turning force from the output shaft 21.

The operation of the fluid rotating machine 1 shown in FIGS. 13 to 15 will now be described with reference to FIGS. 20A to 20F.

Figures 20A, 20B, 20C, 20D, 20E, 20F:
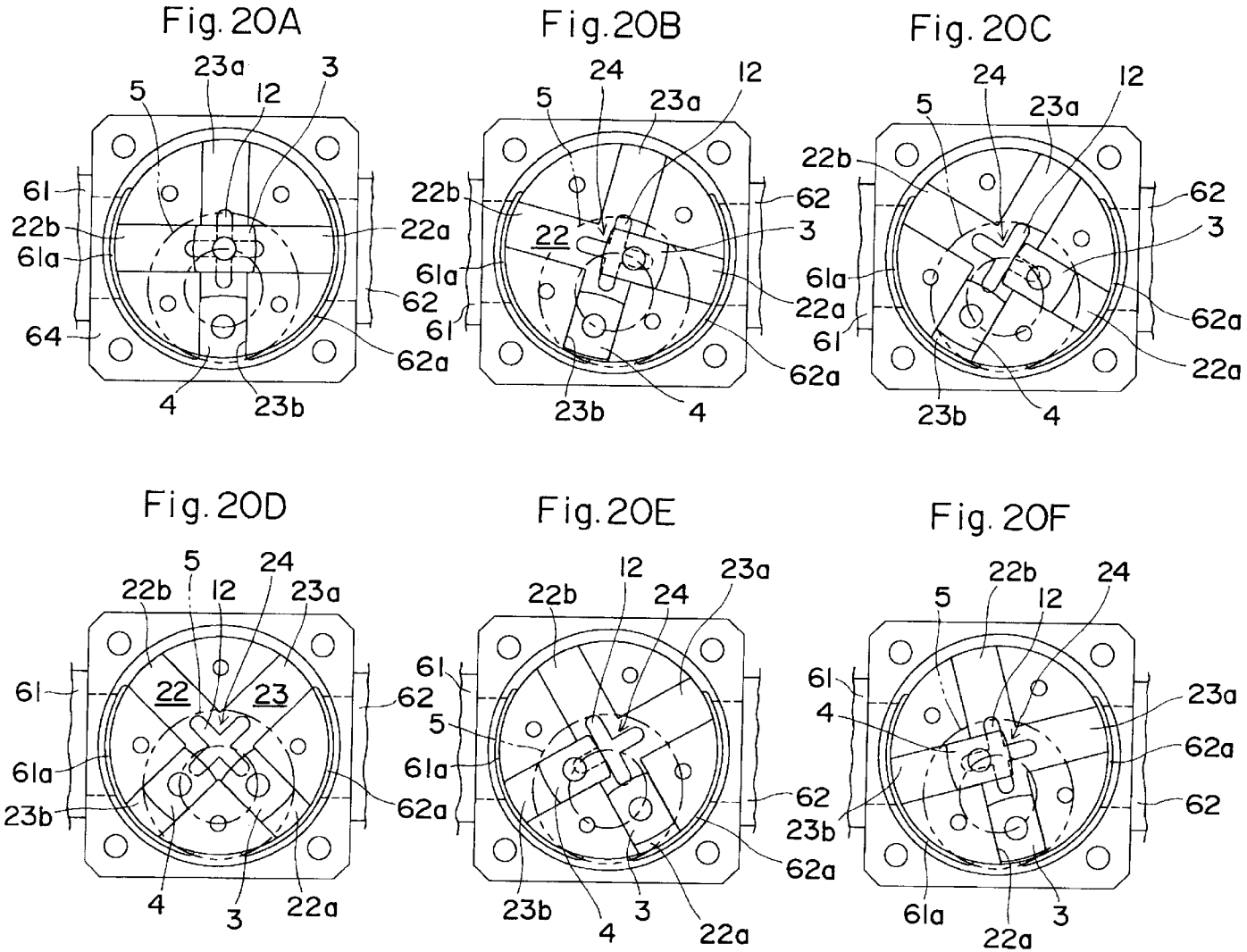
FIG. 20 is a view illustrating the operation of the fluid rotating machine and shows the state in which the rotary cylinder member is rotated every 15 degrees.

At first, in the state shown in FIG. 20A, the piston 3 seemingly reciprocating in the cylinder portions 22*a* and 22*b* is positioned at the hollow portion 24 of the rotary cylinder member 2. At this position, the piston 3 is simultaneously engaged with the cylinder portions 22*a* and 22*b*. On the other hand, the piston 4 seemingly reciprocating in the cylinder portions 23*a* and 23*b* has reached (pushed to) the outmost peripheral edge portion in the cylinder portion 23*b* of the rotary cylinder member 2.

In this state, the cylinder portion 22*b* is opposed to the concave portion 61*a* of the fluid inlet 61, and the cylinder portion 22*a* is opposed to the concave portion 62*a* of the fluid outlet 62. Moreover, the cylinder portions 23*a* and 23*b* are opposed in a space between the concave portion 61*a* and the concave portion 62*a*, i.e., a position at which the concave portions 61*a* and 62*a* are not formed.

In this state, when the fluid flows into the cylinder portion 22*b* from the fluid inlet 61, the pressure of the fluid pushes the piston 3 toward the cylinder portion 22*a*. Since the autorotation central position X1 is deviated from the rotation central position X, the proceeding force of the piston 3 becomes force for rotating the piston holding member 5 holding the piston 3 and rotates the piston holding member 5 around the rotation central position X. As a result, since the piston 3 rotates around the rotation central position X, which causes the rotary cylinder member 2 to rotate around the rotary shaft center O.

The piston 3 is pushed by the pressure of the fluid which has flowed into the cylinder portion 22*b* from the fluid inlet 61 while discharging the fluid in the cylinder portion 22*a* from the fluid outlet 62. On the other hand, as shown in FIG. 20B, as the piston holding member 5 rotates, the piston 4 in the cylinder portion 23*b* is returned toward the hollow portion 24. However, at this moment, the fluid between the pistons 3 and 4 flows from the cylinder portion 23*b* through the cruciform groove 12 to the other cylinder portions 22*a* to 23*a*, and rotation of the piston holding member 5 causes the cylinder portion 23*b* to start to overlap (be opposed to) the concave portion 61*a* of the fluid inlet 61. Thus, the fluid starts to flow into the cylinder portion 23*b* from the fluid inlet 61. That is, the movement of the pistons 3 and 4 is not prevented (not hydraulically locked) by the pressure of the fluid, and the pistons 3 and 4 smoothly move. In addition, the piston holding member 5 and the rotary cylinder member 2 smoothly rotate.

Additionally, the fluid which has flowed into the cylinder portion 22*b* from the fluid inlet 61 continuously rotates the piston holding member 5 and the rotary cylinder member 2 by pushing forward the piston 3. More specifically, the piston 3 proceeds from the position of the rotary shaft center O of the rotary cylinder member 2 to the outer periphery by the pressure of the fluid from the concave portion 61*a* of the fluid inlet 61 and tries to push out the fluid in the cylinder portion 22*a* on the communication hole 62*b* side.

Further, pushing the piston 3 by the fluid pressure can obtain the turning force of the piston holding member 5.

On the other hand, in this state, the piston 4 hardly contributes to rotation of the rotary cylinder member 2. That is, the piston 4 tries to move to the rotary shaft center O of the rotary cylinder member 2 by the fluid which has flowed to the cylinder portion 23*b* from the fluid inlet 61. However, since the front and back parts of the piston 4 are connected to the concave portion 61*a* and the pressure is balanced, rotation of the rotary cylinder member 2 is given by the piston 3 (FIG. 20C). In this state, the cylinder portion 22*b* and the cylinder portion 23*b* overlap the concave portion 61*a* of the fluid inlet 61. However, when the piston holding member 5 and the rotary cylinder member 2 further rotate and reach the position shown in FIG. 20D, only the cylinder portion 23*b* remains as the cylinder chamber overlapping the concave portion 61*a* of the fluid inlet 61, and thereafter the pressure of the fluid acts on the piston 4. That is, the fluid pressure pushes the piston 4, the piston 4 pushes the fluid in the cylinder portions 22*b* and 23*a* and the hollow portion 24, and the piston 3 is pushed, thereby maintaining the turning force. In other words, the piston under the fluid pressure is changed from the piston 3 to the piston 4, and the piston holding member 5 and the rotary cylinder member 2 keep rotating.

On the other hand, in this state, only the cylinder portion 22*a* remains as the cylinder chamber overlapping the concave portion 62*a* of the fluid outlet 62, and the fluid in the cylinder portion 22*a* is discharged from the fluid outlet 62. However, when the piston holding member 5 and the rotary cylinder member 2 further rotate and reach the position shown in FIG. 20E, the cylinder portion 23*a* also overlaps the concave portion 62*a* of the fluid outlet 62, and the piston 4 is under the fluid pressure from the concave portion 61*a*. Further, the piston holding member 5 is caused to rotate, and piston holding member 5 and the rotary cylinder member 2 rotate while discharging the fluid in the cylinder portion 22*a* and the fluid in the cylinder portion 23*a* from the fluid outlet 62 (FIG. 20F).

Furthermore, the positional relationship of the cylinder chambers relative to the concave portion 61*a* of the fluid inlet 61 and the concave portion 62*a* of the fluid outlet 62 is thereafter sequentially changed from the cylinder portion 22*b* to the cylinder portion 23*b*, the cylinder portion 22*a*, the cylinder portion 23*a* and the cylinder portion 22*b* in the mentioned order. Moreover, the piston mainly accepting the pressure of the fluid is alternately changed from the piston 3 to the piston 4 and the piston 3, and the piston holding member 5 and the rotary cylinder member 2 thereby continue to rotate. Therefore, the turning force is continuously outputted from the output shaft 21. That is, the present invention functions as a fluid motor.

In this fluid rotating machine 1, when the pistons 3 and 4 are returned from the outer positions of the cylinder portions 22*a* to 23*b* toward the hollow portion 24, namely, when the capacity in the cylinder portions 22*a* to 23*b* increases, the cylinder portions 22*a* to 23*b* overlap the concave portion 61*a* of the fluid inlet 61. In addition, when the pistons 3 and 4 are pushed toward the outer positions of the cylinder portions 22*a* to 23*b* from the hollow portion 24, namely, when the capacity in the cylinder portions 22*a* to 23*b* decreases, the cylinder portions 22*a* to 23*b* overlap the concave portion 62*a* of the fluid outlet 62. Therefore, the pistons 3 and 4 smoothly move. Further, as described above, the fluid inlet 61 and the fluid outlet 62 are formed at positions opposed to each other, the concave portions 61*a* and 62*a* are formed across the wide area, and each of the communication holes 61*b* and 62*b* is formed so as to have a large passage area. Thus, the flow resistance of the fluid is small. As a result of these facts, the pressure of the fluid is efficiently converted into the turning force for the rotary cylinder member 2, i.e., the output shaft 21, thereby obtaining the efficient fluid rotating machine 1.

In this fluid rotating machine 1, the revolving rotary motion of the pistons 3 and 4, i.e., the rotary motion of the piston holding member 5 around the rotation central position X becomes the angular velocity rotary motion having a velocity which is twice as high as the rotation angular velocity around the rotary shaft center O of the rotary cylinder member 2.

Furthermore, since the piston 3 reciprocates between the cylinder portions 22*a* and 22*b* once and makes one turn with respect to the support shaft 52 while the rotary cylinder member 2 makes one turn, the relationship between the rotation number of the piston 3 and the rotation number of the rotary cylinder member 2 is 1:1. That is, the ratio of the rotation number of the rotary cylinder member 2, the rotation number of the piston holding member 5 and the rotation number of the pistons 3 and 4 relative to the support shafts 52 and 53 is 1:2:1.

Moreover, as described above, since the lateral cross-sectional shape of each of the pistons 3 and 4 matches with the lateral cross-sectional shape of each of the cylinder portions 22*a* to 23*b*, when the fluid rotating machine 1 is assembled, the top surface, both of the side surfaces and bottom surface of each of the pistons 3 and 4 are brought into contact with the surfaces of the cylinder portions 22*a* to 23*b* over the entire length of each of the pistons 3 and 4, thereby assuring the air-tightness/liquid-tightness between the cylinder portions 22*a* to 23*b* and the pistons 3 and 4. That is, the fluid can be further assuredly prevented from leaking, thus obtaining the efficient fluid rotating machine.

Description will now be given as to an embodiment of a fluid electric generator using this fluid rotating machine 1. Incidentally, in this embodiment, since the fluid rotating machine 1 as the drive source basically has the same structure/principle as the structure described in connection with the embodiments shown in FIGS. 1 to 4 except electric generator commands, like reference numerals denote like or similar constituent parts, thereby omitting their explanation. FIGS. 22 to 28 show an example of this fluid electric generator 70. In this fluid electric generator 70, an electric generation mechanism is connected to the output side of the fluid rotating machine 1 and they are accommodated in a casing 6. The electric generator mechanism is configured to include a yoke 73, a magnet 74, a stator core 76 as an element on a fixed side, a winding 77, and a holder 78.

That is, a cylindrical portion 72 is integrally molded to a rotary cylinder member 2, and the yoke 73 and the magnet 74 are bonded and fixed to the cylindrical portion 72. The rotary cylinder member 2 is rotatably supported by a lower case 64 through a bearing 75 for simultaneously bearing a thrust direction and a radial direction. On the other hand, the stator core 76 and the winding 77 opposed to the magnet 74 are set in the holder 78 attached to the lower case 64.

Figure 39:
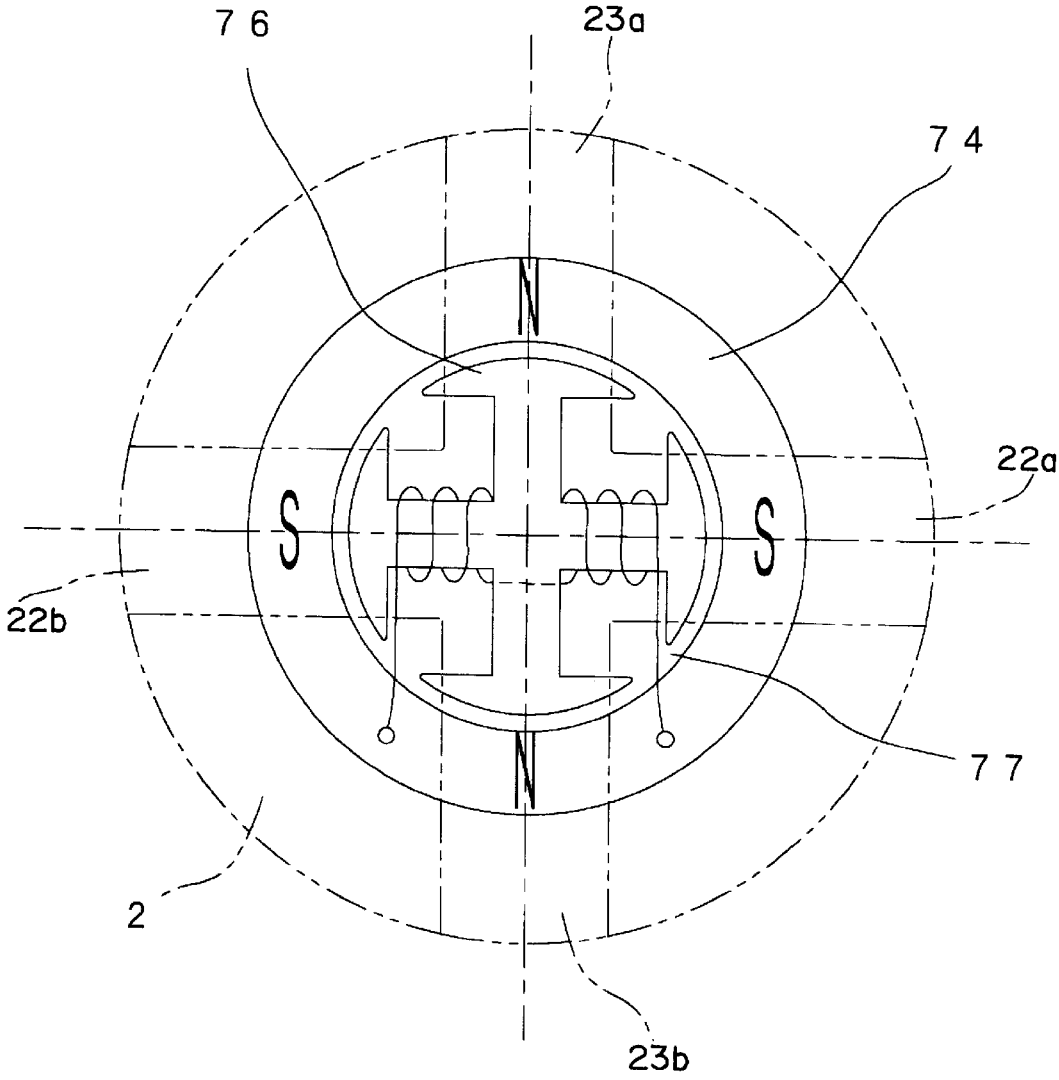
FIG. 39 is a view showing a positional relationship between a salient pole of a stator core, a central position of a magnetic pole of a magnet and the cylinder chamber of the fluid electric generator.

Incidentally, in this embodiment, as shown in FIG. 39, a center of a salient pole of the stator core 76, a central position of a magnetic pole (N or S pole) of the magnet 74, and a groove position which can be cylinder portions 22*a* to 23*b* are substantially matched with each other. That is because this structure can improve the mobility, and generation and activation of the maximum torque can be facilitated when the cylinder portions 22*a* to 23*b* stop. However, the present invention does not have to be restricted to the above positional relationship as long as this relationship generates no problem for use.

A piston holding member 5 is supported on an upper case 63 through a bearing 79 for simultaneously bearing the thrust direction and the radial direction. The upper case 63 is screwed to the lower case 64, and a space between these cases is sealed by an O ring 80. It is to be noted that the lightening holes in each of the casing 6, the pistons 3 and 4, the piston holding member 5, the rotary cylinder member 2 and others are made for shape stabilization and reduction in weight.

When a fluid is supplied to an inlet 61 for a fluid of the fluid electric generator 70, the rotary cylinder member 2 rotates with the same principle as the operation principle shown in FIG. 20, and the magnet 74 fixed to the rotary cylinder member 2 rotates with respect to the winding 77 wound around the stator core 76. Therefore, an electric current is produced to the winding 77, thereby performing electric generation. In this fluid electric generator 70, since the magnet 74 is arranged around the stator core 76 and the winding 77 which are provided on the inner side, the efficiency for electric generation is improved.

It is to be noted that a reverse rotation output may be obtained from an output shaft 21 by using the fluid outlet 62 as an inflow opening for the fluid and using the fluid inlet 61 as an outflow opening for the fluid.

Further, matching the lateral cross-sectional shape of each of the pistons 3 and 4 with the lateral cross-sectional shape of each of the cylinder portions 22*a* to 23*b* can provide a structure for preventing the fluid from leaking from the surrounding part of the pistons 3 and 4.

Figure 16B:
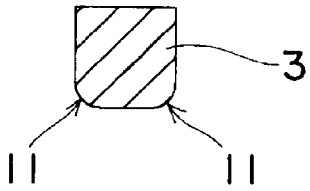
Figure 34A:
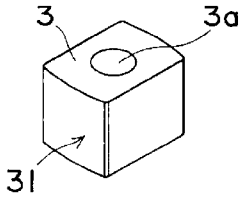
FIGS. 34A and 34B are a perspective view and a vertical cross-sectional view showing a seventh example of the shape of the piston.
Figure 34B:
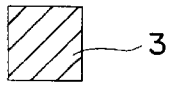

Furthermore, the shape of each of the pistons 3 and 4 and the lateral cross-sectional shape of each of the cylinder portions 22*a* to 23*b* is not restricted to that shown in FIG. 16. For example, they may have various different lateral cross-sectional shapes such as an angular U shape, a smooth U shape, a home-base-like shape, a trapezoidal shape or an inverted-triangular shape as shown in FIGS. 29A to 33B. Alternatively, they may have a square shape as shown in FIGS. 34A and 34B. In addition, they may have any other shape.

Figure 35:
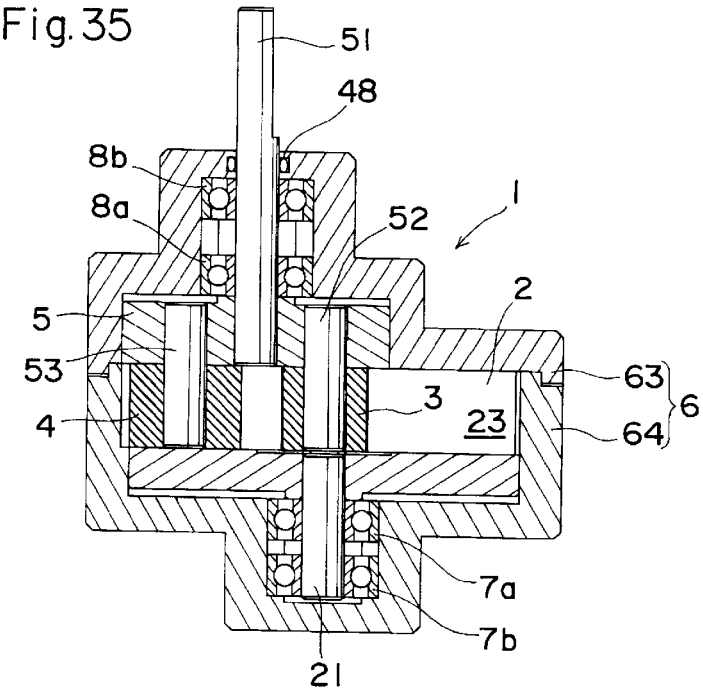
FIG. 35 is a vertical cross-sectional view showing a second embodiment in which the rotary cylinder apparatus according to the present invention is constituted as a fluid rotating machine.
Figure 36:
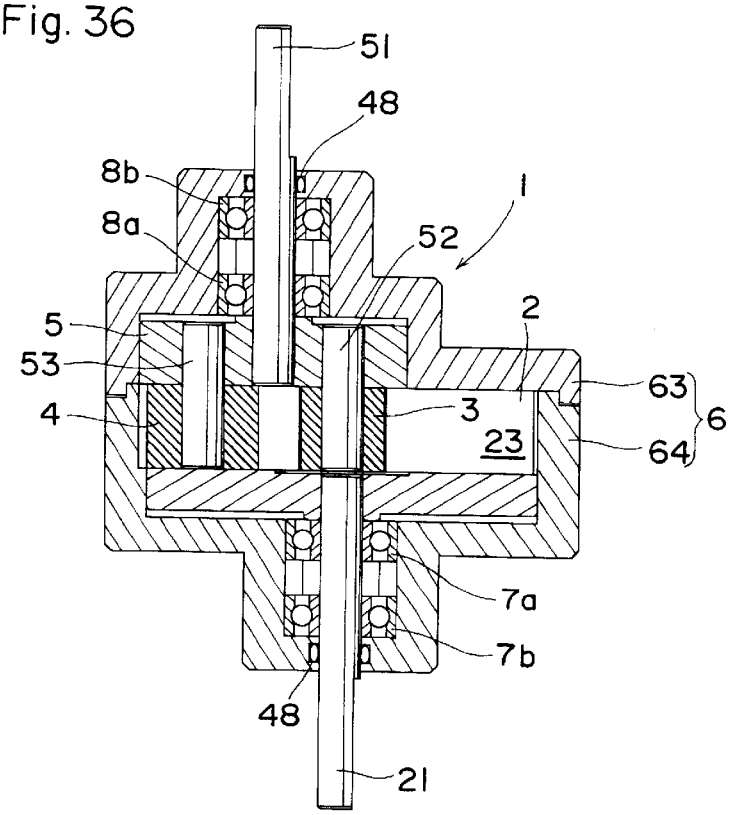
FIG. 36 is a vertical cross-sectional view showing a third embodiment in which the rotary cylinder apparatus according to the present invention is constituted as the fluid rotating machine.

Additionally, as shown in FIG. 36, the rotary shaft of the rotary cylinder portion 2 may be determined as the output shaft 21 and a shaft 51 on the piston holding member 5 side may be determined as an output shaft. That is, outputting rotation of at least either the rotary cylinder member 2 or the piston holding member 5 can suffice. It is to be noted that FIGS. 35 and 36 show the cross section at the same position as that in FIG. 13 and illustration of the inflow opening, the outflow opening and others is eliminated.

Further, although rolling bearing members 7*a* and 7*b* are used to support the rotary cylinder member 2 in the above description, a sliding bearing member may be used to support the rotary cylinder member 2. Furthermore, although rolling bearing members 8*a* and 8*b* are used to support the piston holding member 5, the sliding bearing member may be used to support the piston holding member 5.

Moreover, although the number of the cylinder chambers is two (the number of the cylinder portions is four) and the number of the pistons is two in the above description, the present invention is not restricted to the combination of these numbers. For example, the number of the cylinder chambers may be three (the number of the cylinder portions may be six) and the number of the pistons may be three. The operation principle in this case will now be briefly explained with reference to FIG. 37.

Figures 37A, 37B, 37C, 37D, 37E, 37F:
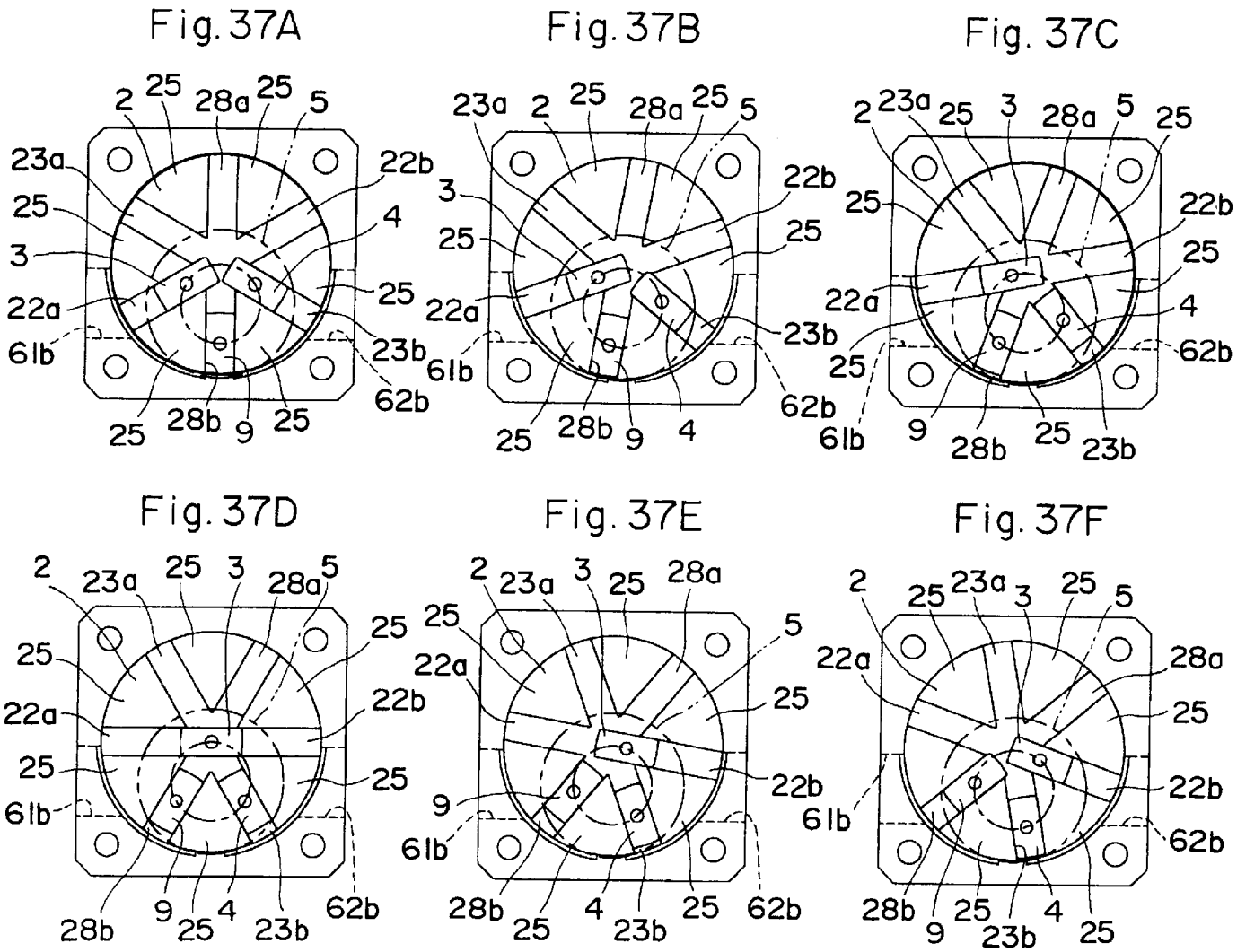
FIGS. 37A to 37F are views illustrating the operation of the fluid rotating machine according to a fourth embodiment of the rotary cylinder apparatus of the present invention, showing the state in which the rotary cylinder member is rotated every 10 degrees.

In the example shown in FIG. 37, the rotary cylinder member 2 including the six cylinder portions 22*a*, 22*b*, 23*a*, 23*b*, 28*a* and 28*b* and six sector-like base portions 25 is rotatably arranged in the casing 6. That is, in this example, the cylinder portions 22*a* and 22*b* and the hollow portion 24 form the cylinder chamber 22; the cylinder portions 23*a* and 23*b* and the hollow portion 24 form the cylinder chamber 23; and the cylinder portions 28*a* and 28*b* and the hollow portion 24 form the cylinder chamber 28. In addition, the piston holding member 5 is rotatably arranged at an eccentric position of the rotary cylinder member 2, and the three pistons 3, 4 and 9 are rotatably held by the piston holding member 5. As similar to the above-described case, in regard to a ratio of rotation of the rotary cylinder member 2 and rotation of the piston holding member 5 arranged in the casing 6 of this fluid rotating machine 1, the rotation number of the piston holding member 5 is 2, whereas the rotation number of the rotary cylinder member 2 is 1. The number of times of reciprocation of the pistons 3, 4 and 9 in the cylinder chambers 22, 23 and 28 is 1, and the rotation number of the piston relative to a non-illustrated shaft is also 1.

In this example, as similar to the case shown in FIG. 20, when the respective pistons 3, 4 and 9 rotate in the clockwise direction in the drawing by rotation of the piston holding member 5, the rotary cylinder member 2 also rotates in the same direction with this operation. As a result, the piston 3 seemingly reciprocates in the cylinder chamber 22, the piston 4 seemingly reciprocates in the cylinder chamber 23 and the piston 9 seemingly reciprocates in the cylinder chamber 23 while crossing the hollow portion 24, respectively.

It is to be noted that the dimension of each of the pistons 3, 4 and 9 in the longitudinal direction is such that it can engage with the inner walls of the cylinder chambers on both sides of the hollow chamber 24 when crossing the hollow portion 24. Therefore, when each of the pistons 3, 4 and 9 crosses the hollow portion 24, it is brought into contact simultaneously with the cylinder chambers on both of the sides. Incidentally, it is needless to say that each of the pistons 3, 4 and 9 is designed so as not to collide with any other piston 3, 4 or 9 when crossing the hollow chamber 24. As a result, in the example shown in FIG. 37, each of the pistons 3, 4 and 9 rotates and moves while constantly being guided by any cylinder chamber, and consequently the respective pistons 3, 4 and 9 assuredly move in or from the respective cylinder chambers 22, 23 and 28. The pressure of the fluid is used to perform the motor operation for rotating a non-illustrated output shaft. Meanwhile, if the operating fluid is a non-compressible fluid, although not shown, six shallow grooves which radially extend may be formed to the hollow portion 24 where the cylinder chambers 22, 23 and 28 intersect in some cases. That is, as the piston back-and-forth movement back pressure releasing means, non-illustrated grooves which equally and radially extend in six directions may be provided to the hollow portion 24.

It is to be noted that such a fluid rotating machine 1 having the three cylinder chambers 22, 23 and 28 and the three pistons 3, 4 and 9 as shown in FIG. 37 has less torque fluctuations.

FIGS. 40 to 44 illustrate an embodiment in which the rotary cylinder apparatus according to the present invention is constituted as a rotary compressor for compressing a fluid by input of turning force. Incidentally, a fluid to be pushed and supplied in this embodiment is not restricted to a liquid such as oil or water, and it may be a gaseous body such as air or gas. Further, like reference numerals denote parts having the same structure/principle as the structure described in the embodiments shown in FIGS. 1 to 4 and FIGS. 13 to 15, thereby omitting their explanation.

Pistons 3 and 4 in this embodiment are formed by, for example, sintered metal (sintered compact of powder of metal and the like). Therefore, the pistons 3 and 4 are porous, and they can be saturated in advance with lubrication oil, which is advantageous for lubrication of the sliding surfaces. However, it is needless to say that the pistons 3 and 4 may be formed by using any other material than the sintered metal.

Figure 41:
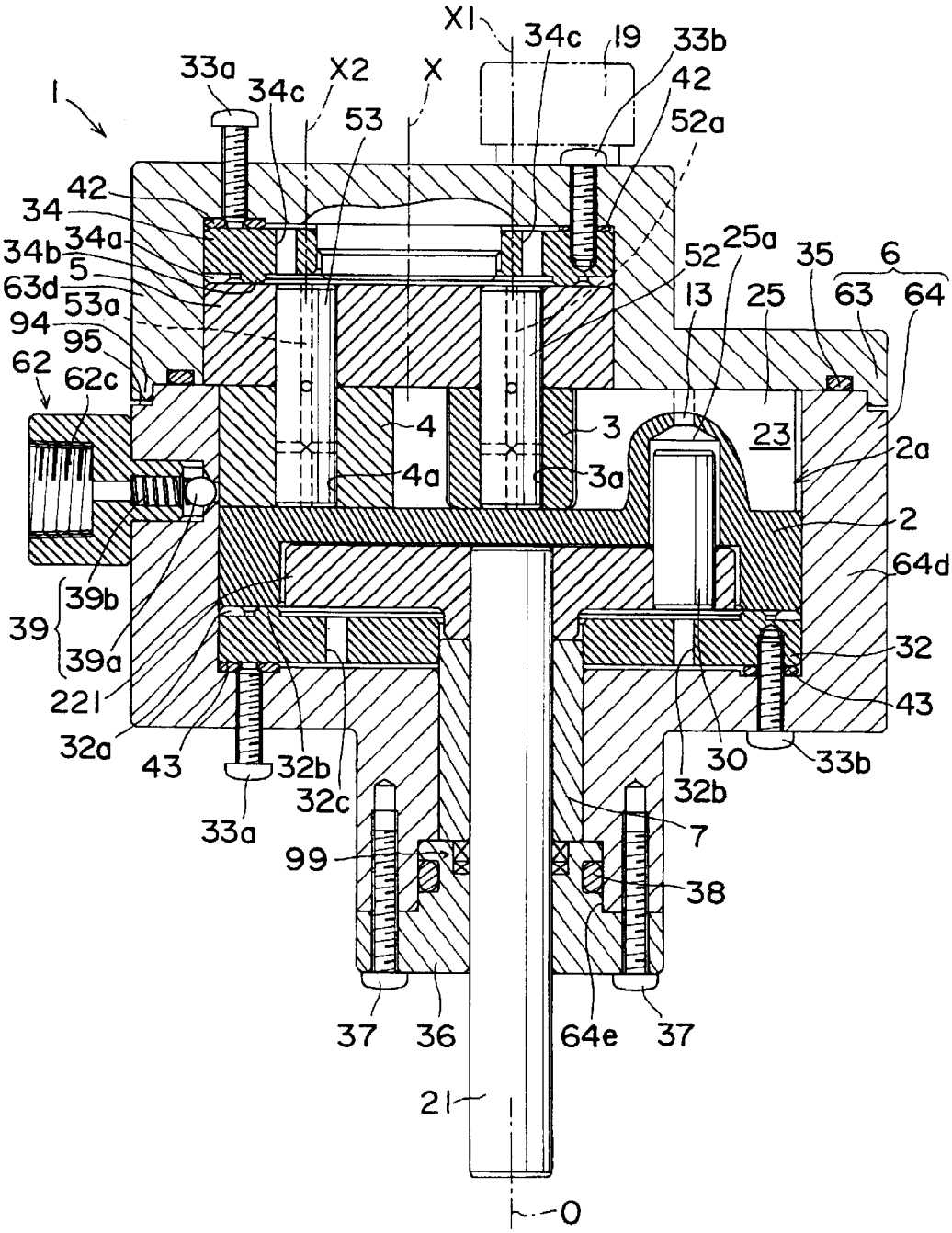
FIG. 41 is a vertical cross-sectional view of the rotary compressor illustrated in FIG. 40.
Figure 42:
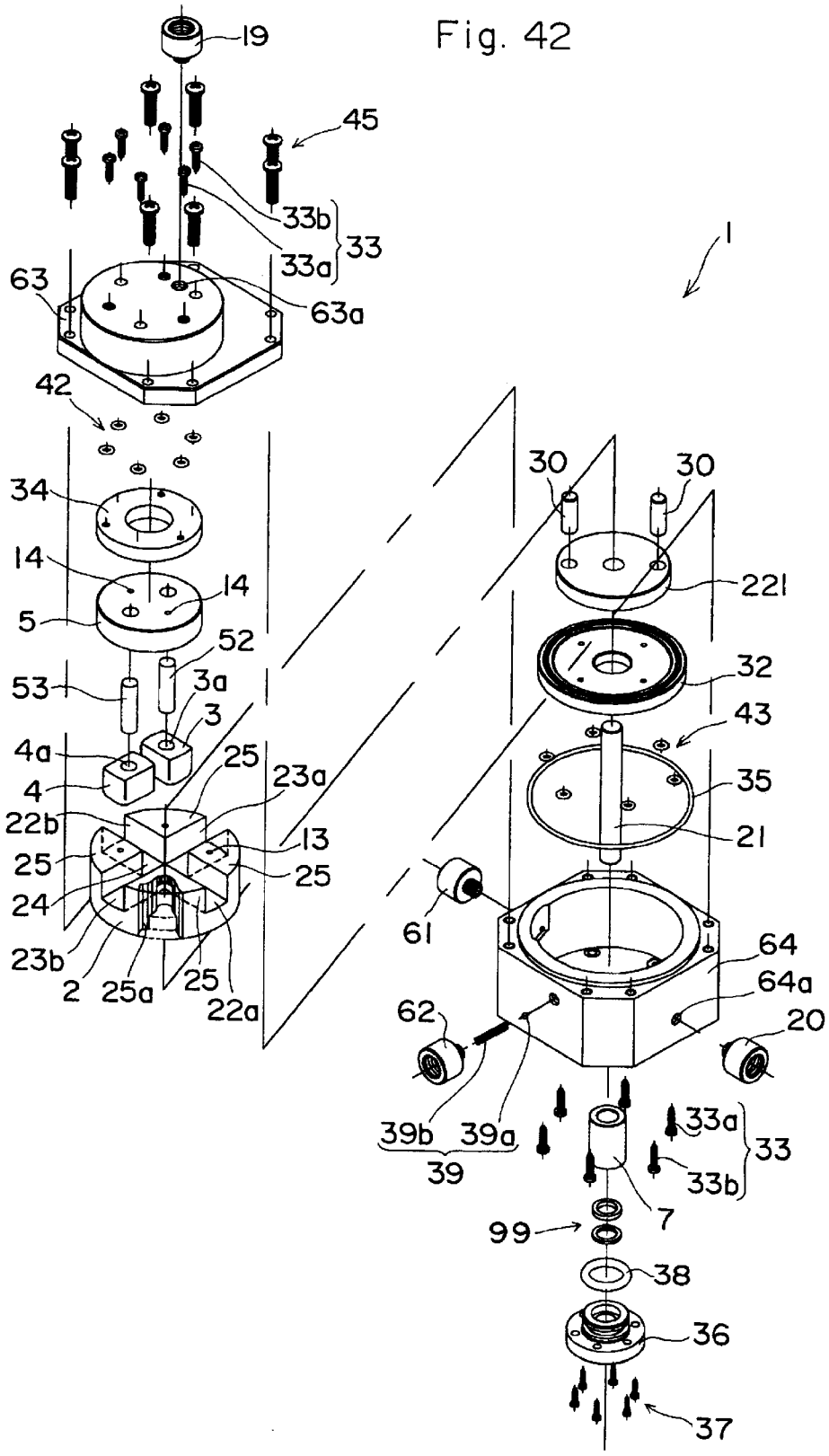
FIG. 42 is an exploded perspective view of the rotary compressor illustrated in FIG. 40.

In this embodiment, rotation of a shaft 21 as an input shaft is transmitted to a rotary cylinder member 2 through a carrier plate 221. Giving more specific description, large-diameter holes 25*a* which are opened on a surface on the opposite side of a surface opposed to a piston holding member 5, i.e., on a lower side surface in FIGS. 41 and 42 are formed in each base portion 25 of the rotary cylinder member 2. Further, among the respective large-diameter holes 25*a*, into two linearly arranged large-diameter holes 25*a* are inserted carrier shafts 30 erected and fixed on the carrier plate 221. With respect to the carrier shaft 30, the large-diameter hole 25*a* is formed so as to be slightly long in the axial center direction of cylinder portions 22*a*, 22*b*, 23*a* and 23*b*. Even if the rotation center of the rotary cylinder member 2 is deviated from that of the carrier plate 221, the large-diameter hole 25*a* can excellently transmit rotation of the carrier plate 221 to the rotary cylinder member 2 while absorbing this deviation. A clearance is provided between the carrier plate 221 and the rotary cylinder member 2, and this clearance enables adjustment of the inclination of the carrier plate 221 as will be described later.

An input shaft 21 is inserted and fixed into the rotary shaft center of the carrier plate 221 by press fitting. This input shaft 21 is rotatably supported by a sliding bearing member 7 at a central portion of the input shaft 21. Furthermore, an end of the input shaft 21 protrudes to the outside of the casing 6.

Figure 45:
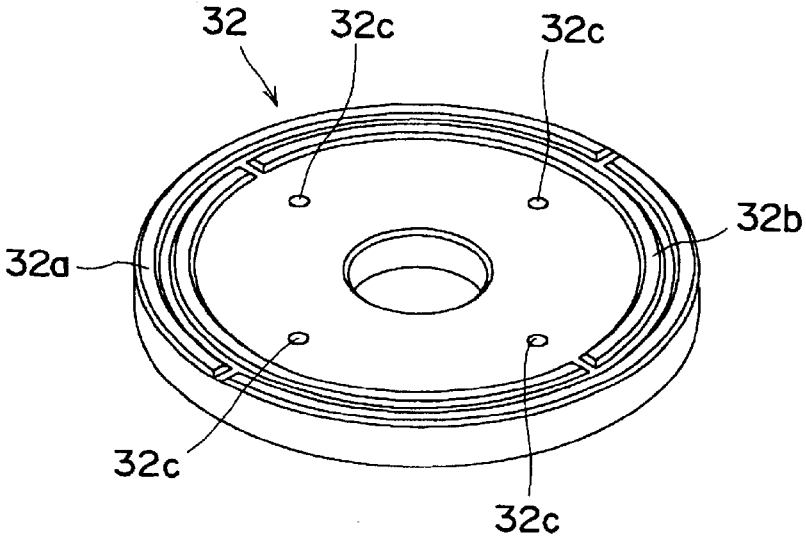
FIG. 45 is a perspective view showing a bearing plate of the rotary compressor depicted in FIG. 40.

The rotary cylinder member 2 is rotatably supported by a bearing plate 32. The bearing plate 32 is a member for rotatably bearing the rotary cylinder member 2 on a flat surface thereof and, as shown in FIG. 45, two projection portions 32*a* and 32*b* are formed on its bearing surface. The respective projection portions 32*a* and 32*b* are partially cut to facilitate circulation of the lubrication oil. Moreover, the cut portion of each of the projection portions 32*a* and 32*b* is arranged so as to be shifted 90 degrees with respect to the rotating direction of the rotary cylinder member 2, thereby avoiding the inclination of the rotary cylinder member 2. As described above, since the rotary cylinder member 2 can be bore by the flat surface in the vicinity of the outer periphery thereof, the rotation state of the rotary cylinder member 2 is stabled, and the inclination hardly occurs. In addition, the compression performance can be assured, and the reliability can be improved. Holes 32*c* for circulating the later-described lubrication oil are formed to the bearing plate 32.

The inclination of the bearing plate 32 can be adjusted by adjustment screws 33. The adjustment screws 33 are constituted by, for example, three pushing screws 33*a* and three drawing screws 33*b*, and they are alternately arranged in the circumferential direction. The pushing screw 33*a* partially moves the bearing plate 32 close to the rotary cylinder member 2, and the drawing screw 33*b* partially moves the bearing plate 32 away from the rotary cylinder member 2. Therefore, varying a quantity of screwing the pushing screw 33*a* and the drawing screw 33*b* can adjust the inclination of the bearing plate 32. Therefore, the component accuracy in the thrust direction can be alleviated. The space between the respective adjustment screws 33, the lower case 64 and the bearing plate 32 is sealed by O rings 43. In addition, holes 32*c* for circulating the lubrication oil are formed.

The piston holding member 5 is rotatably supported by a bearing plate 34 similar to the bearing plate 32 supporting the carrier plate 221. As similar to the bearing plate 32, two projection portions 34*a* and 34*b* are formed to the bearing plate 34 so that the piston holding member 5 can be bore on the flat surface in the thrust direction. Since the piston holding member 5 can be bore by the flat surface in the vicinity of the outer periphery thereof in this manner, the rotation state of the piston holding member 5 is stabilized, and the inclination hardly occurs. Furthermore, the compression performance can be assured, and the reliability can be improved. Moreover, holes 34*c* for circulating the lubrication oil are formed. The inclination of this bearing plate 34 can be adjusted by the adjustment screws 33 constituted by, e.g., three pushing screws 33*a* and three drawing screws 33*b*. Therefore, the component accuracy in the thrust direction can be alleviated. The space between the respective adjustment screws 33, the upper case 63 and the bearing plate 34 is sealed by O rings 42.

It is to be noted that the rotary cylinder member 2 is supported by a peripheral wall 64*d* of the lower case 64 and the piston holding member 5 is supported by a peripheral wall 63*d* of the upper case 63 with respect to the radial direction.

In-support-shaft passages 52*a* and 53*a* piercing in the axial direction and the radial direction of the respective support shafts 52 and 53 are formed to these shafts. The later-described lubrication oil partially flows through the in-support-shaft passages 52*a* and 53*a* and lubricates the sliding surfaces between the pistons 3 and 4 and the piston holding member 5 and the sliding surfaces between the support shafts 52 and 53 and the pistons 3 and 4.

Incidentally, although depending on the degree of lubrication, the in-support-shaft passages 52*a* and 53*a* may not be provided.

The upper case 63 and the lower case 64 are fixed by screws 45. Further, the space between the upper case 63 and the lower case 64 is sealed by an O ring 35.

An insertion hole 64*e* for inserting therethrough an input shaft 21 is provided on the bottom portion of the lower case 64. Further, a cap 36 is fixed to the bottom portion of the lower case 64 by screws 37. The space between the lower case 64 and the cap is sealed by an O ring 38. Moreover, the space between the input shaft 21 and the inside of the compressor is sealed by a double-stage mechanical seal 99.

A concave portion 61*a* of a suction opening 61 which is an inlet for a fluid is formed so as to extend from a position which is slightly close to the inner side from the outmost peripheral position to which these pistons 3 and 4 move with rotation of the rotary cylinder member 2 and to a position to which the pistons 3 and 4 move in the vicinity of the hollow portion 24. Furthermore, a concave portion 62*a* of a discharge opening 62 which is an outlet for a fluid is provided at a position which is slightly close to the front side from the position to which the pistons 3 and 4 move on the outmost periphery with rotation of the rotary cylinder member 2. As described above, the concave portion 62*a* is formed in a very narrow area with respect to the rotating direction of the rotary cylinder member 2 as compared with the concave portion 61*a*. Therefore, the cylinder portions 22*a*, 22*b*, 23*a* and 23*b* are not opposed to the concave portion 62*a* till the pressure in the cylinder portions 22*a*, 22*b*, 23*a* and 23*b* sufficiently increases, and the fluid in the cylinder portions 22*a*, 22*b*, 23*a* and 23*b* compressed by the pistons 3 and 4 can be discharged from the discharge opening 62 at a blast while maintaining its high pressure.

Figure 46:
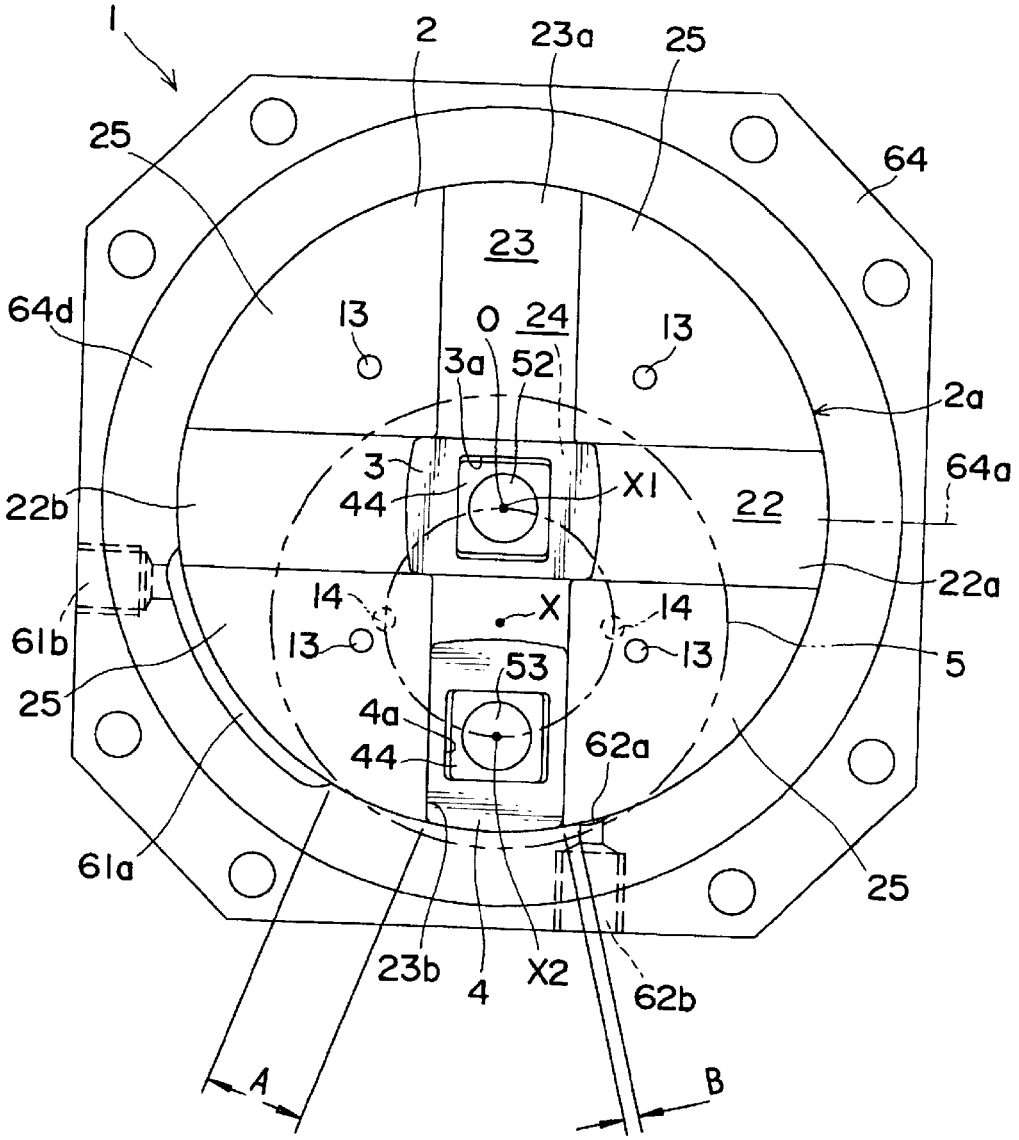
FIG. 46 is a view showing a positional relationship between a suction opening, a discharge opening and the cylinder chamber having the piston positioned at the outermost peripheral portion of the cylinder chamber.

It is to be noted that the pressure in the cylinder portions 22*a*, 22*b*, 23*a* and 23*b* becomes highest when the pistons 3 and 4 are at the outmost peripheral position (position of the cylinder portion 23*b* in FIG. 46). On the contrary, the pressure at the suction opening 61 is low. Thus, leakage of the fluid from the cylinder portions 22*a*, 22*b*, 23*a* and 23*b* which are at the outmost peripheral positions of the pistons 3 and 4 to the suction opening 61 can be considered. However, in this rotary compressor 1, sufficiently enlarging a partition portion (portion indicated by A in FIG. 46) between the outmost peripheral position of the pistons 3 and 4 and the concave portion 61*a* of the suction opening 61 prevents the fluid from leaking. Moreover, the pressure at the discharge opening 62 is substantially isobaric as compared with that at the cylinder portions 22*a*, 22*b*, 23*a* and 23*b* at the outmost peripheral positions of the pistons 3 and 4. However, when the rotary cylinder member 2 rotates from the outmost peripheral positions of the pistons 3 and 4, the volume of each of the cylinder portions 22*a*, 22*b*, 23*a* and-23*b* increases to cause reduction in pressure. Thus, the partition portion (portion indicated by B in FIG. 46) between the outmost peripheral positions of the pistons 3 and 4 and the concave portion 62*a* of the discharge opening 62 is similarly sufficiently enlarged in order to prevent the fluid from leaking.

In addition, a check valve 39 consisting of, e.g., a ball 39*a* and a spring 39*b* is provided at the discharge opening 62 to prevent the fluid from flowing backward. The check valve 39 is arranged at a position close to the concave portion 62*a* in order to decrease the capacity of the check valve 39 on the upstream side and increase the compression ratio.

This rotary compressor 1 also has back pressure releasing means. In this embodiment, the back pressure releasing means is constituted by, e.g., cylinder side back pressure releasing means 13 and piston holding member side back pressure releasing means 14.

Figure 47:
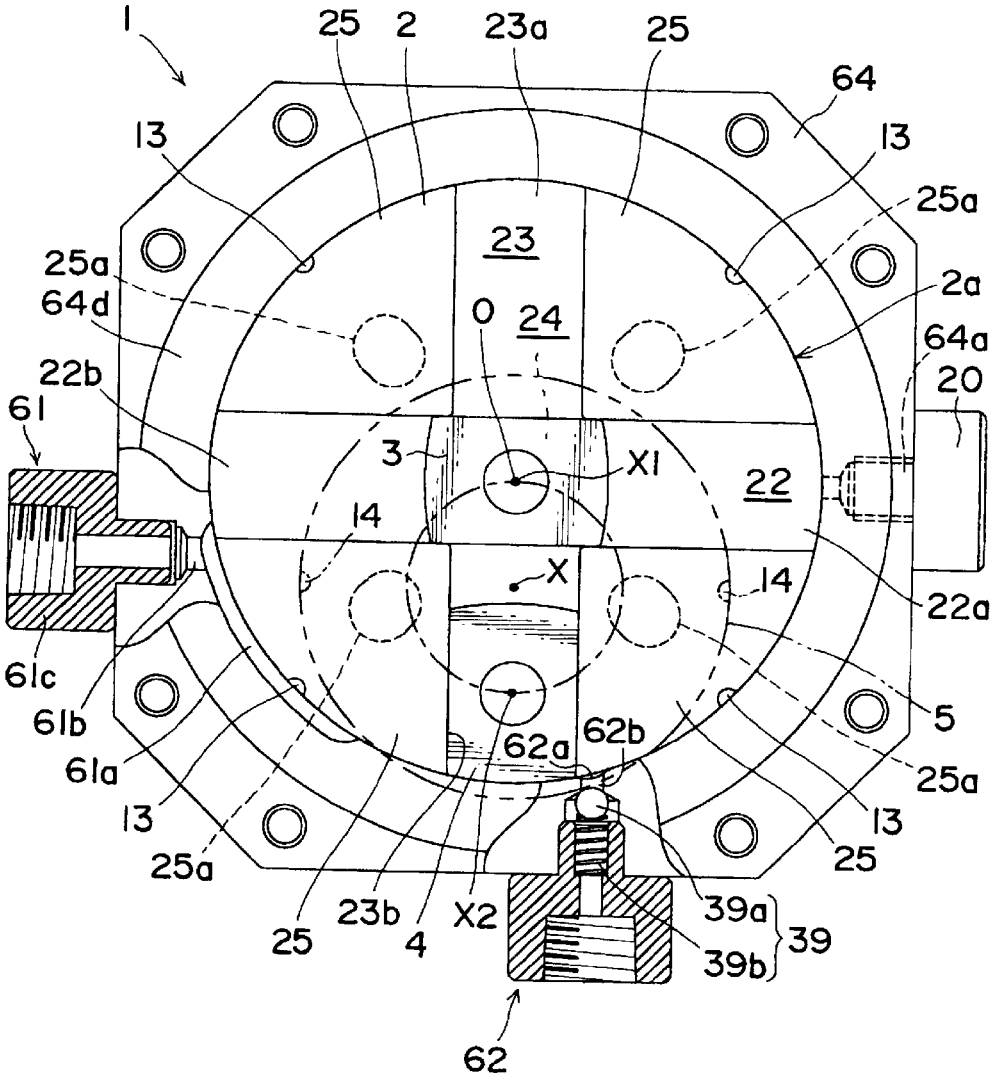
FIG. 47 is a plane view showing a second example of the back pressure releasing means of the rotary compressor from which the upper case and the piston holding member are removed.
Figure 48:
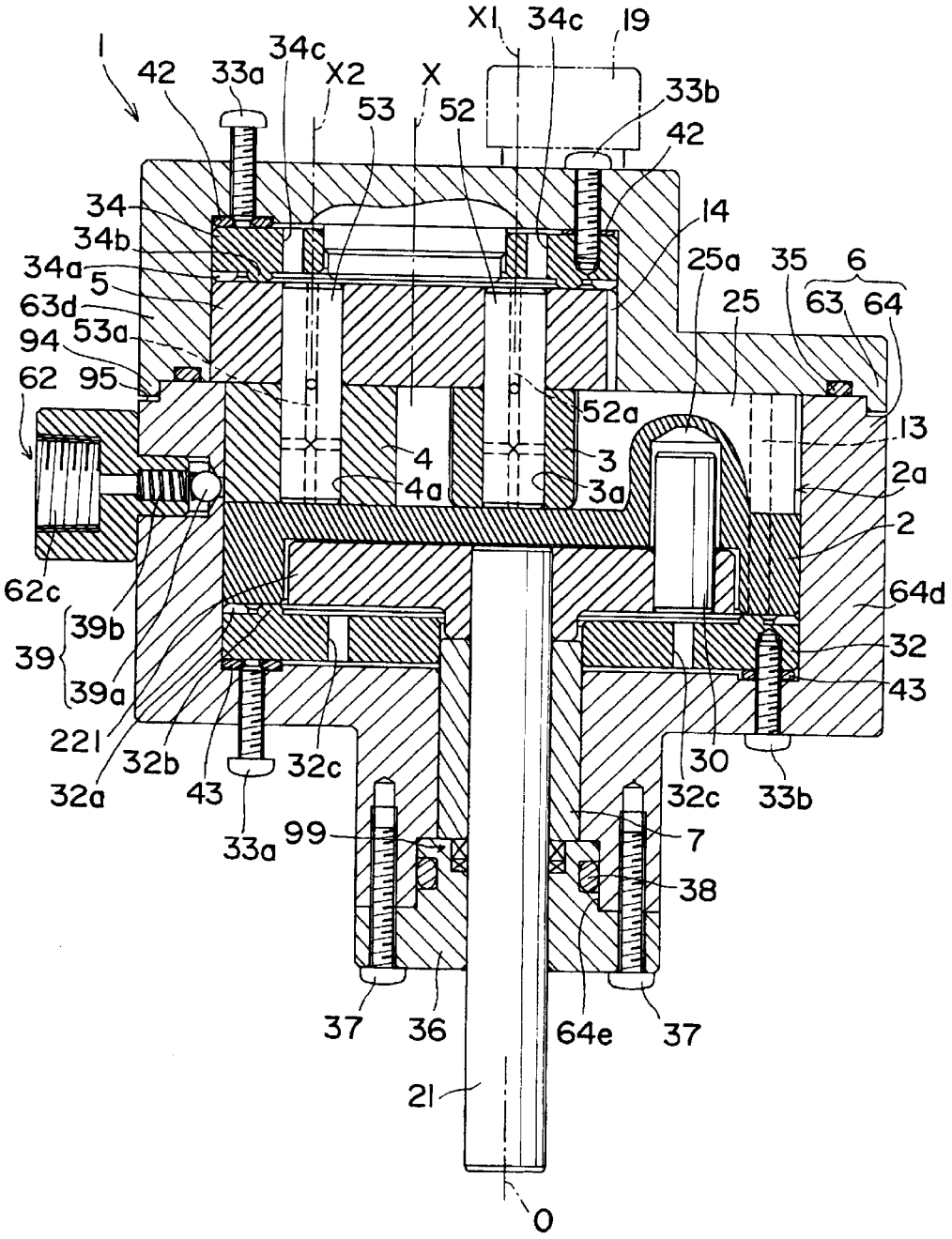
FIG. 48 is a cross-sectional view of FIG. 47.
Figure 52:
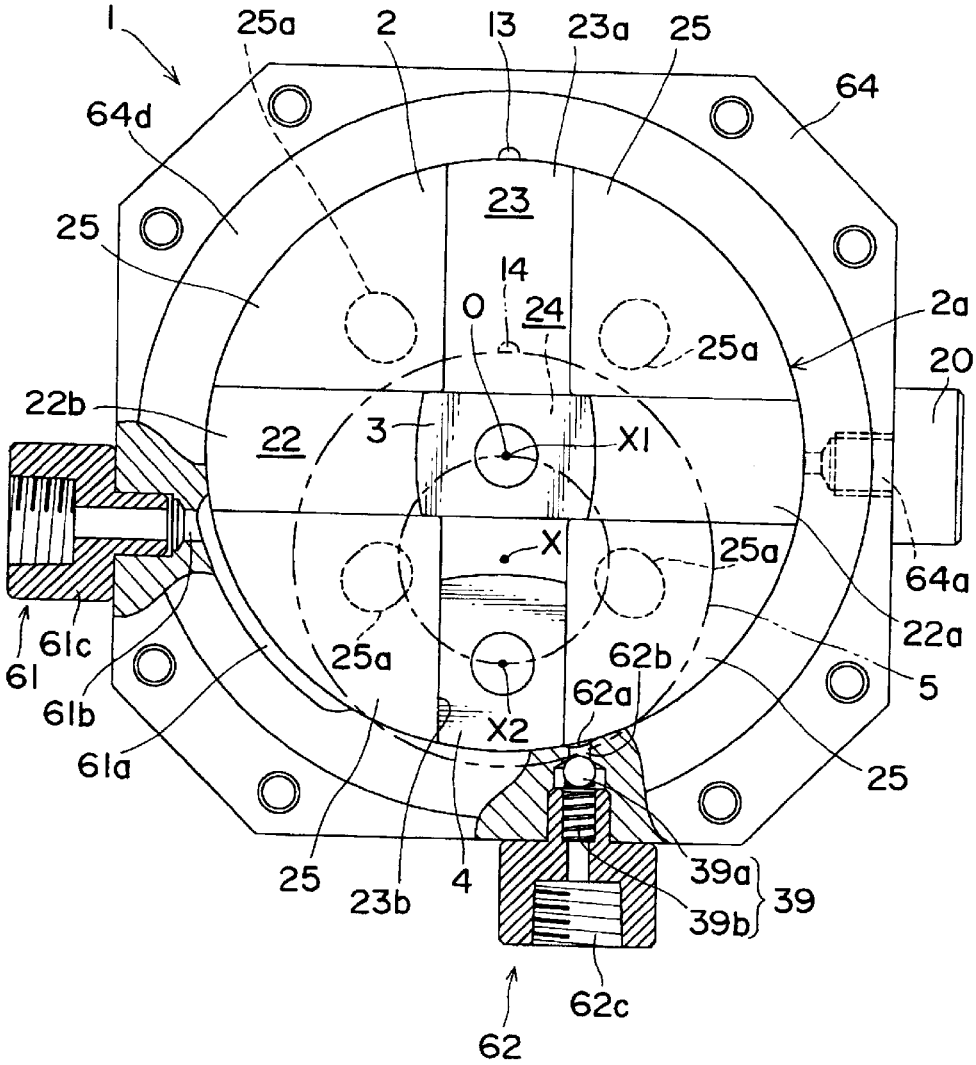
FIG. 52 is a plane view showing a third example of the back pressure releasing means of the rotary compressor from which the upper case and the piston holding member are removed.
Figure 53:
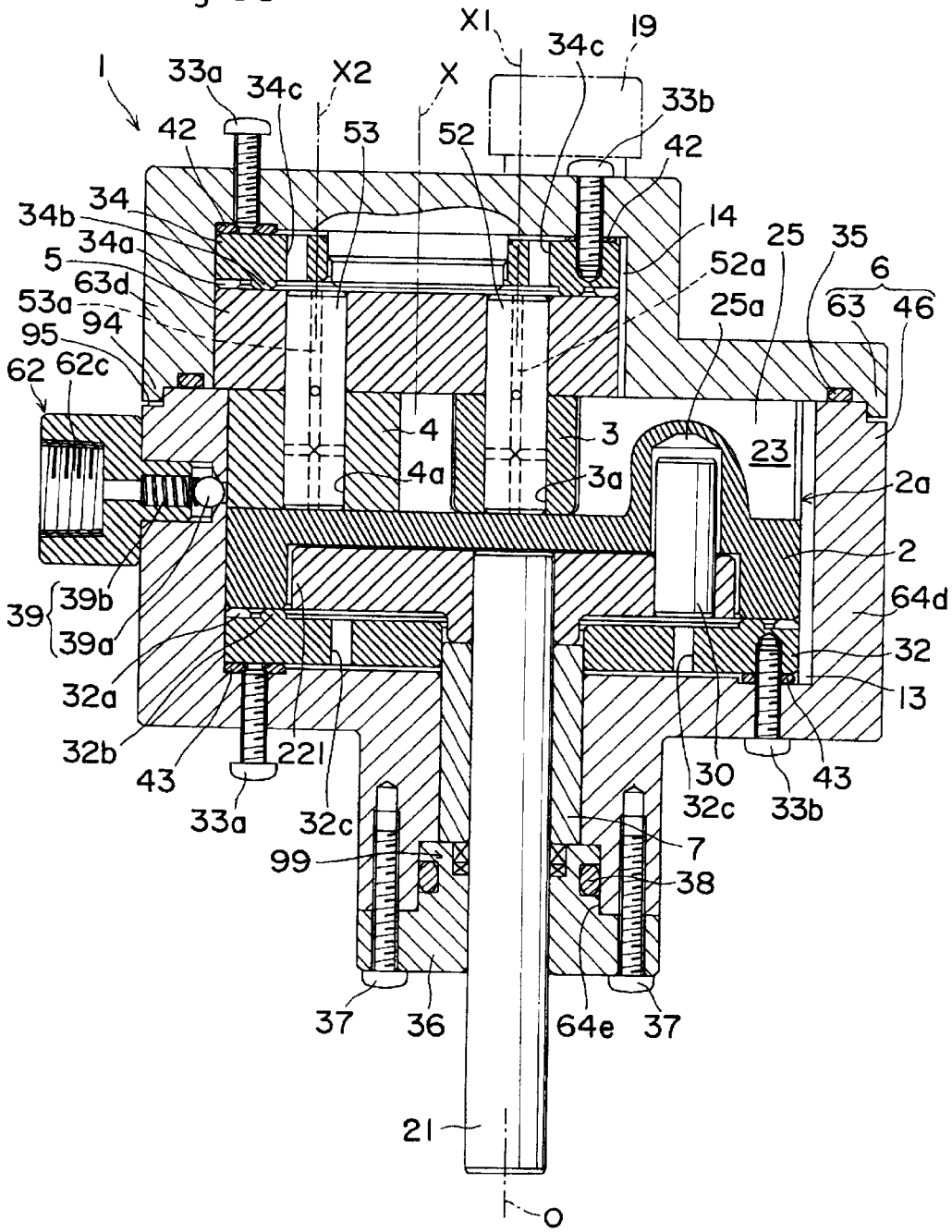
FIG. 53 is a cross-sectional view of the rotary compressor illustrated in FIG. 52.

The cylinder side back pressure releasing means 13 releases the back pressure generated between the rotary cylinder member 2 and the lower case 64 during the operation of the rotary compressor 1 and smoothes rotation of the rotary cylinder member 2 and others. The cylinder side back pressure releasing means 13 is, for example, a hole 13 piercing each of four base portions 25 to reach a large-diameter hole 25*a*. However, the cylinder side back pressure releasing means is not restricted to the hole 13 piercing the base portions 25. For example, it may be a groove 13 formed on the outer peripheral surface of the rotary cylinder member 2 as shown in FIGS. 47 and 48, or a groove 13 formed on the peripheral wall 64*d* of the lower case 64 as shown in FIGS. 52 and 53.

The piston holding member side back pressure releasing means 14 releases the back pressure generated between the piston holding member 5 and the upper case 63 during the operation of the rotary compressor 1 and smoothes rotation of the piston holding member 5. The piston holding member side back pressure releasing means 14 is, for example, a hole 14 piercing the piston holding member 5. However, the piston holding member side back pressure releasing means is not restricted to the hole 14 piercing the piston holding member 5. For example, the piston holding member side back pressure releasing means may be a groove 14 formed on an outer peripheral surface of the piston holding member 5 as shown in FIGS. 47 and 48, or a groove 14 formed on a peripheral wall 63*d* of the upper case 63 as shown in FIGS. 52 and 53.

Figure 43:
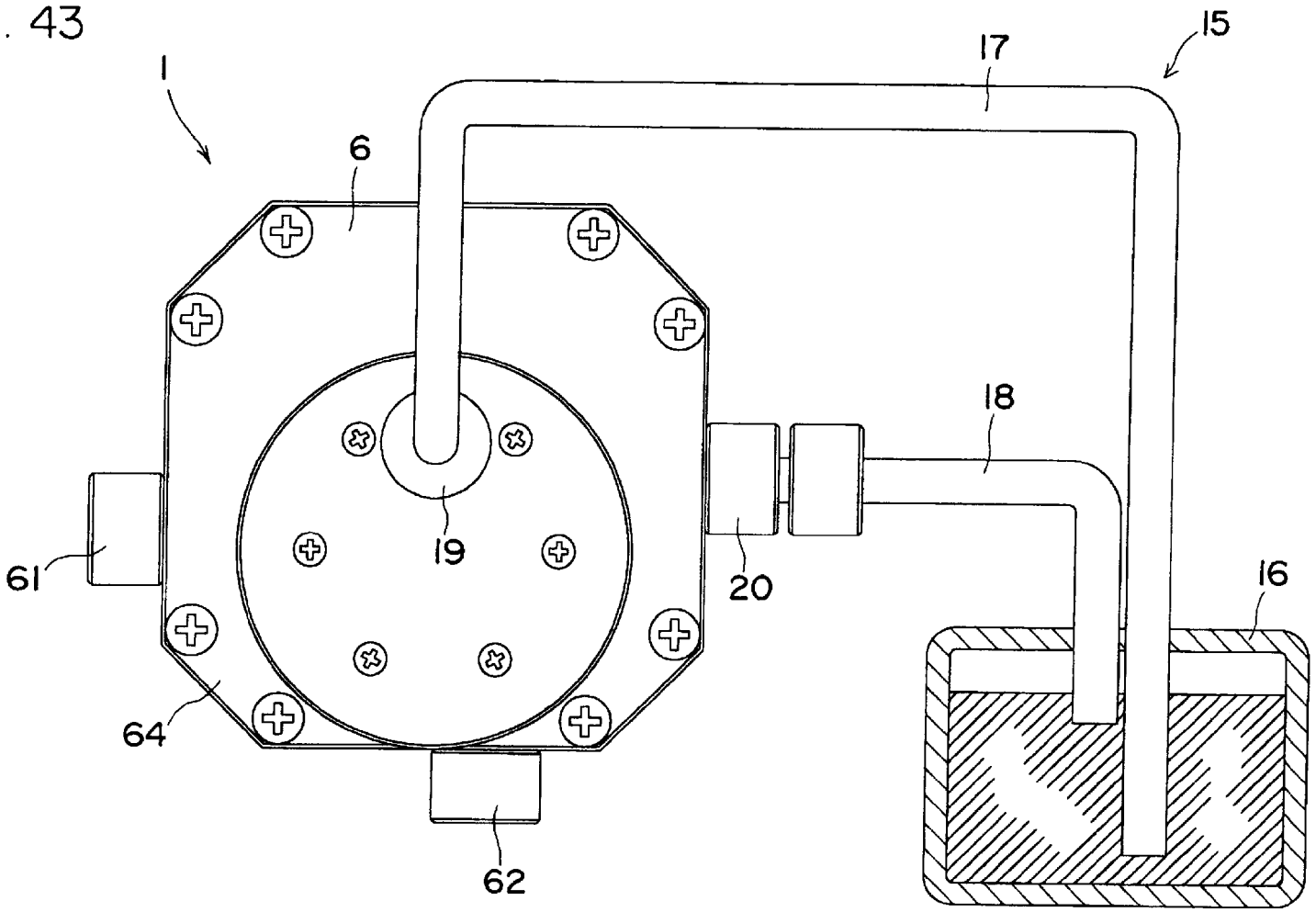
FIG. 43 is a schematic block diagram showing a lubricant oil circulation mechanism.
Figure 44:
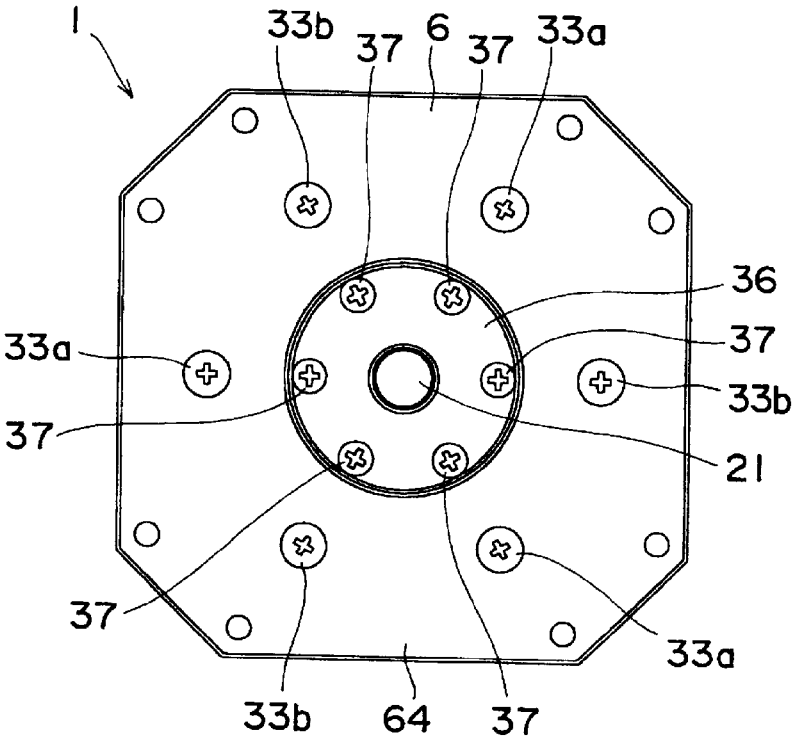
FIG. 44 is a bottom view of the rotary compressor depicted in FIG. 40.

The rotary compressor 1 is provided with a lubrication oil circulation mechanism 15. As shown in FIG. 43 for example, this lubrication oil circulation mechanism 15 is configured to include an oil tank 16, an oil inflow passage 17 for leading the oil from the oil tank 16 into a casing 6, and an oil outflow passage 18 for leading the oil from the inside of the casing 6 to the oil tank 16. A non-illustrated filter is provided in the middle of the oil inflow passage 17.

The oil inflow passage 17 is connected to a joint 19 attached to a port 63*a* of the upper case 63. The oil led from the joint 19 into the upper case 63 through the port 63*a* is transmitted through the gaps of the respective components in the casing 6, the cylinder side back pressure releasing means 13, the piston holding member side back pressure releasing means 14, the in-support-shaft passages 52*a* and 53*a*, holes 32*c* and 34*c* of the bearing plates 32 and 34 and others to lubricate the sliding surfaces. The oil then flows out from a joint 20 attached to a port 64*a* of the lower case 64 to the oil outflow passage 18 and is circulated to the oil tank 16. This oil circulates from the oil tank 16, the oil inflow passage 17, the joint 19, the port 63*a*, the inside of the casing 6, the port 64*a*, the joint 20, the oil outflow passage 18 and the oil tank 16 in the mentioned order by utilizing a difference in pressure generated by rotation of the rotary cylinder member 2 and the piston holding member 5.

Incidentally, in this embodiment, since the pistons 3 and 4 are formed by sintered metal, the lubrication oil penetrated in the pistons 3 and 4 leaches out from the pistons 3 and 4 by the back pressure generated by rotation of the piston holding member 5 and the like so that the lubrication oil lubricates the sliding surfaces between the pistons 3 and 4 and the piston holding member 5, the sliding surfaces between the pistons 3 and 4 and the cylinder portions 22*a*, 22*b*, 23*a* and 23*b*, and others.

In the rotary compressor 1 having the above-described structure, when the input shaft 21 is driven by a non-illustrated motor or the like, this turning force is transmitted from the input shaft 21 to the carrier plate 221, the carrier shaft 30, the rotary cylinder member 2, the pistons 3 and 4 and the piston holding member 5 in the mentioned order. As a result, the rotary cylinder member 2 and the piston holding member 5 relatively rotate and move the pistons 3 and 4 with respect to the cylinder chambers 22 and 23 in order to discharge from the discharge opening 62 the fluid sucked from the suction opening 61. That is, when the input shaft 21 is rotated, the piston holding member 5, the rotary cylinder member 2 and the like perform the rotary motion with the uniform angular velocity ratio and move the pistons 3 and 4. As a result, the capacity in the cylinder portions 22*a*, 22*b*, 23*a* and 23*b* is increased and decreased, thereby pushing and supplying the fluid.

The operation of the rotary compressor 1 will now be described with reference to FIGS. 49A to 49F. It is to be noted that FIGS. 49A to 49F show the rotary compressor 1 every 15 degrees of the rotary angle of the rotary cylinder member 2.

Figures 49A, 49B, 49C, 49D, 49E, 49F:
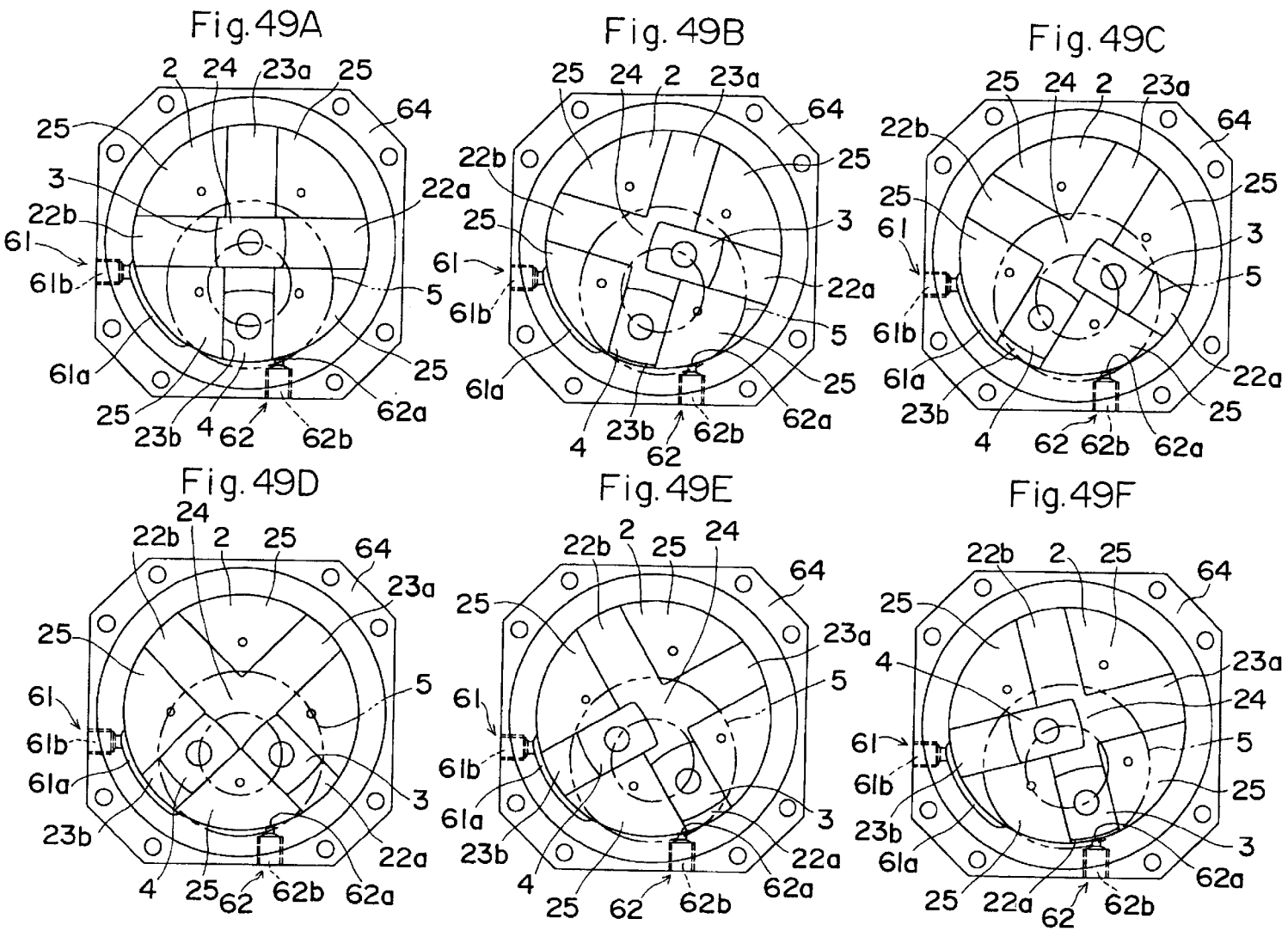
FIGS. 49A to 49F are views illustrating the operation of the rotary compressor depicted in FIG. 40, showing the state in which the rotary cylinder member is rotated every 15 degrees.

In this rotary compressor 1, when the respective cylinder portions 22*a*, 22*b*, 23*a* and 23*b* alternately repeat a suction stroke and a compression stroke, the fluid is compressed. The suction stroke will now be first described while paying attention to the cylinder portion 23*b*. When the rotary cylinder member 2 and the piston holding member 5 relatively rotate, the piston 4 moves from a dead point of the cylinder portion 23*b* shown in FIG. 49A toward the hollow portion 24 (FIG. 49B). Then, when the piston holding member 5 and the rotary cylinder member 2 rotate to the position shown in FIG. 49C, the cylinder portion 23*b* is opposed to (overlaps) the concave portion 61*a* of the suction opening 61, and hence the fluid is sucked from the suction opening 61 into the cylinder portion 23*b* by a negative pressure generated by movement of the piston 4 (FIGS. 49D to F). Subsequently, when the piston holding member 5 and the rotary cylinder member 2 further rotate, the cylinder portion 23*b* is deviated from the concave portion 61*a* of the suction opening 61, thereby terminating the suction stroke. Furthermore, when the cylinder portion 23*b* rotates to a position of the cylinder portion 22*a* shown in FIG. 49A, the compression stroke is started.

This compression stroke will now be described while paying attention to the cylinder portion 22*a*. When the piston holding member 5 rotates by rotation of the rotary cylinder member 2, the piston 3 enters the cylinder portion 22*a* from the position of the hollow portion 24 (FIGS. 49A and 49B). Then, the piston 3 moves toward the outer side position in the cylinder portion 22*a* by further rotation of the rotary cylinder member 2 and the piston holding member 5 (FIGS. 49C and 49D), thereby compressing the fluid in the cylinder portion 22*a*. Then, when the fluid is sufficiently compressed (FIG. 49E), the cylinder portion 22*a* overlaps the concave portion 62*a* of the discharge portion 62 (FIG. 49F) and the fluid in the cylinder portion 22*a* is pushed and supplied by bursting open the check valve 39.

Since the above-described operations are sequentially repeated with respect to the cylinder portions 22*a*, 22*b*, 23*a* and 23*b*, the pistons 3 and 4 sequentially compress and supply the fluid.

This rotary compressor 1 can be used as, for example, a compressor of a cooling circuit constituted by an evaporator, a condenser, a capillary tube, a radiator pipe and others. That is, it can be used for compressing and circulating refrigerant utilized for heat exchange. Furthermore, a motor for rotating the input shaft 21 may be accommodated in the casing 6.

Incidentally, in the embodiment shown in FIG. 41, the input shaft 21 is arranged on only the rotary cylinder member 2 side of the rotary cylinder member 2 and the piston holding member 5 so that rotation can be transmitted. However, rotation of the input shaft 21 may be transmitted to the piston holding member side 5.

Figure 40:
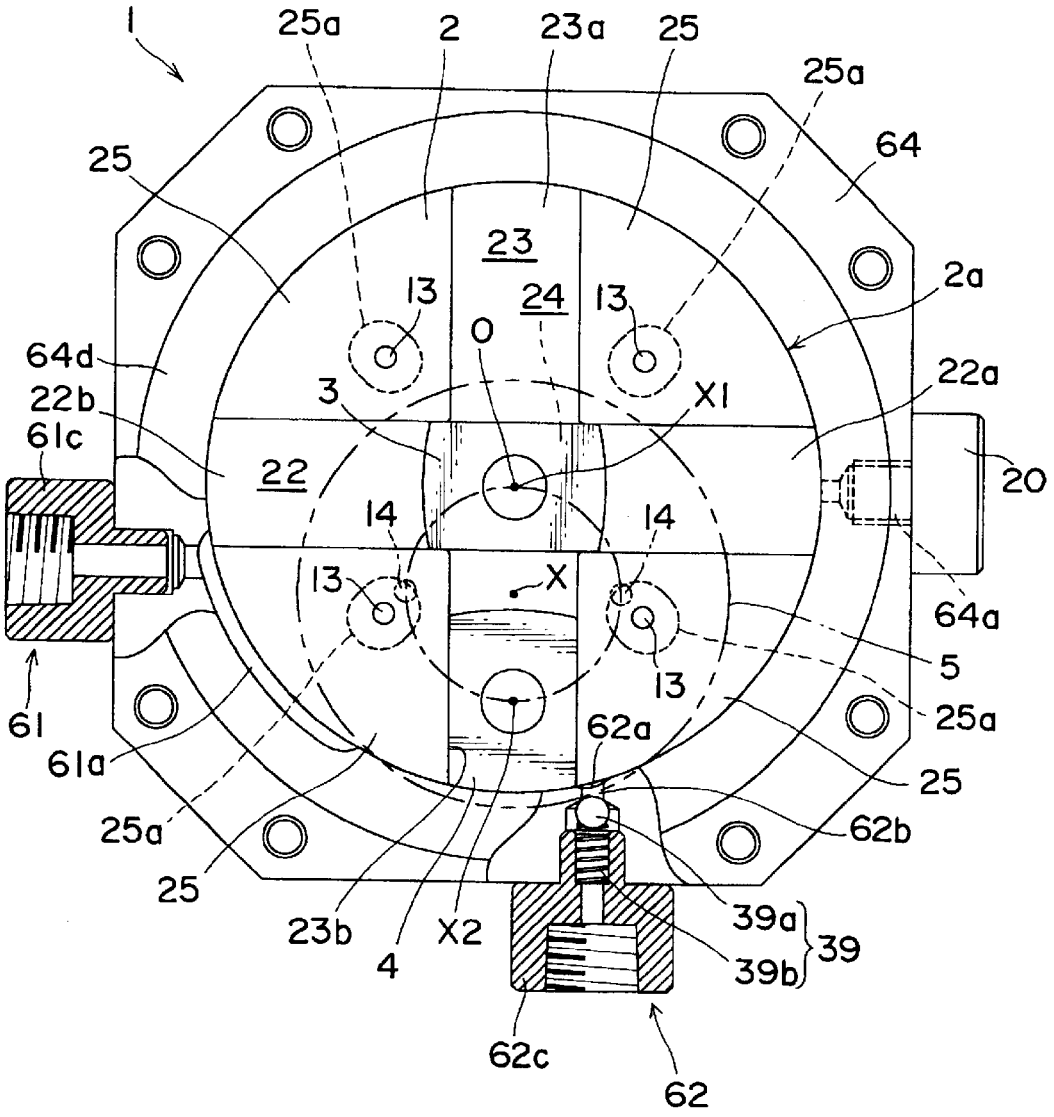
FIG. 40 is a plane view showing a first embodiment in which the rotary cylinder apparatus according to the present invention is constituted as a rotary compressor from which the upper case and the piston holding member are removed.

Moreover, in the embodiment shown in FIG. 40, the rotary cylinder member 2 and the piston holding member 5 are supported by the bearing plates 32 and 34 as the sliding bearings. However, the rolling bearing such as a ball bearing may be used to support the rotary cylinder member 2 and the piston holding member 5.

Figure 50:
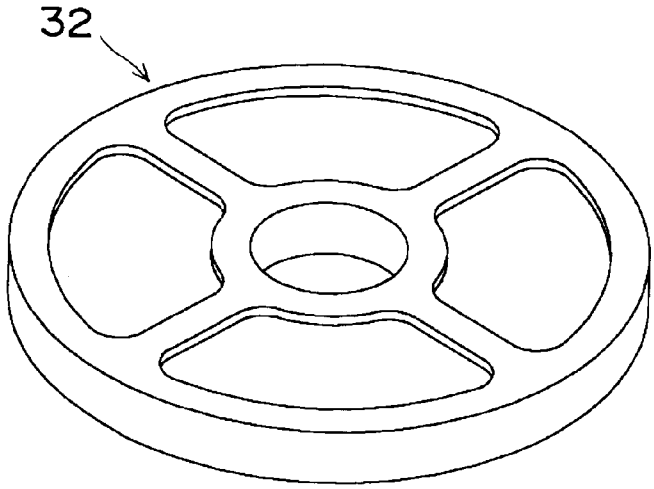
FIG. 50 is a perspective view showing a modification of the bearing plate.

In addition, as the bearing plates 32 and 34, one shown in FIG. 50 may be used.

Additionally, in the embodiment shown in FIG. 40, although the support shafts 52 and 53 are directly inserted into the holes 3*a* and 4*a* in the pistons 3 and 4, a guide piece 44 may be provided between them. The guide piece 44 is shown in FIG. 46. Slight jounce is provided between the guide piece 44 and the holes 3*a* and 4*a* of the pistons 3 and 4 in the piston widthwise direction. Therefore, even if the shaft center of each of the support shafts 52 and 53 is deviated from each of the autorotation central positions X1 and X2, the rotary motion of the pistons 3 and 4 can be performed around the rotation central position X while absorbing that deviation. Thus, the required processing accuracy of the components can be lowered, and the processing can be facilitated, thereby reducing the manufacturing cost.

Additionally, in the embodiment shown in FIG. 40, although the inclination of the bearing plates 32 and 34 is adjusted by the adjustment screws 33, the adjustment screws 33 can be eliminated when the component accuracy can be assured.

Further, in the embodiment shown in FIG. 40, although the carrier plate 221 and the carrier shaft 30 are provided between the input shaft 21 and the rotary cylinder member 2, the carrier plate 221 and the carrier shaft 30 can be eliminated and the input shaft 21 can be attached to the rotary cylinder member 2 if the component accuracy can be assured.

Furthermore, although the O ring is used as a sealing structure in the embodiment shown in FIG. 40, a mechanical seal and others may be used. Moreover, the drive motor may be directly connected to the input shaft, and setting these members in a non-illustrated pressure container can eliminate the O ring.

Figures 51A, 51B, 51C, 51D, 51E, 51F:
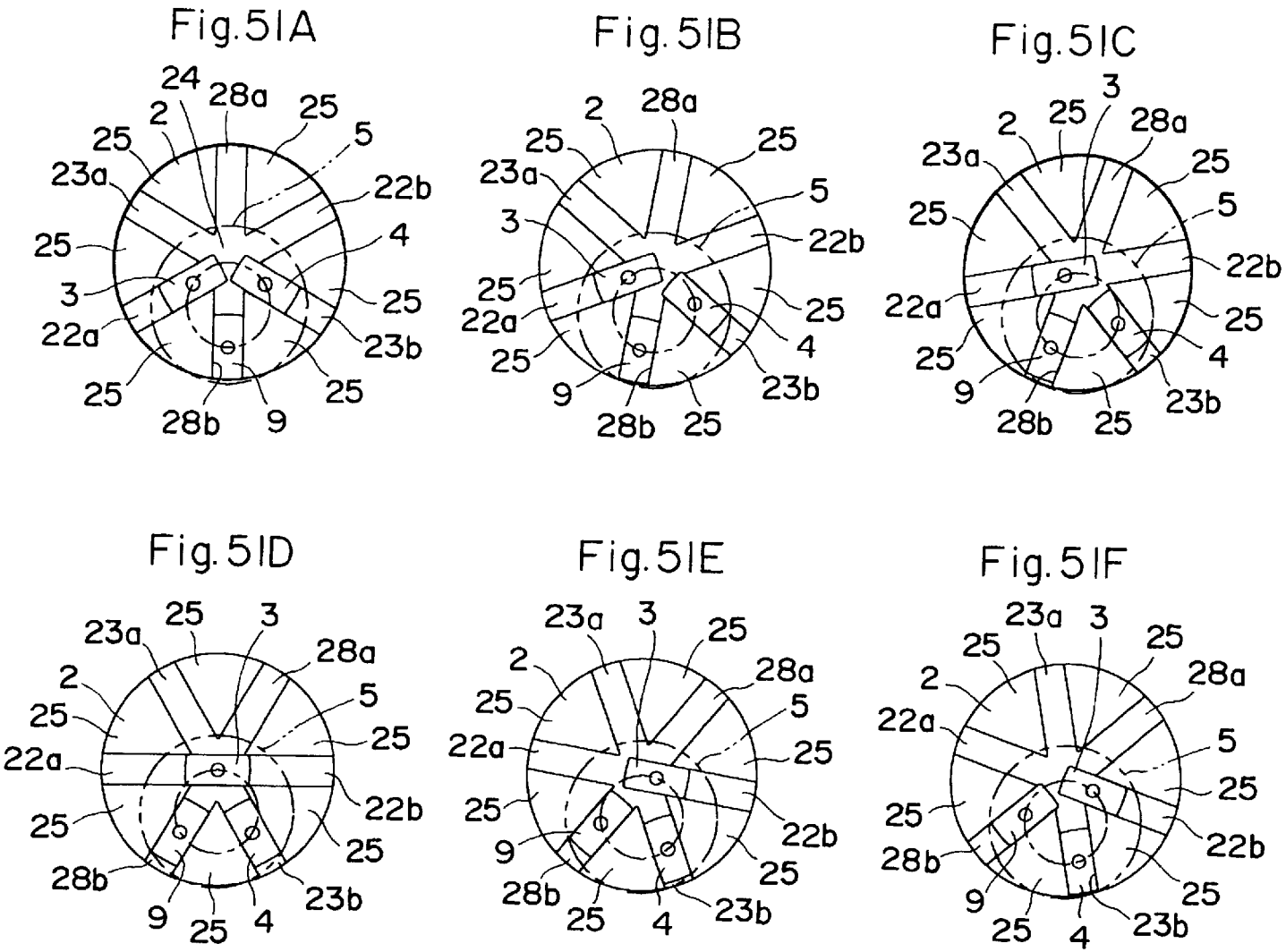
FIGS. 51A to 51F are views illustrating the operation of another embodiment of the rotary compressor, showing the state in which the rotary cylinder member is rotated every 10 degrees.

In addition, the number of the cylinder portions may be six and the number of the pistons may be three. That is, as shown in FIG. 51, the six cylinder portions 22*a*, 22*b*, 23*a*, 23*b*, 28*a* and 28*b* and the three pistons 3, 4 and 9 may be provided. It is to be noted that the relationship between the movement of the pistons 3, 4 and 9 and that of the cylinder chambers 22, 23 and 28 in this case is the same as that of the example shown in FIG. 37 and hence its explanation is omitted.

Additionally, a plurality of the rotary compressors 1 may be combined to provide a multi-stage type rotary compressor. Causing the compressed fluid to flow into the compressor 1 on the next stage can obtain the fluid having a higher pressure.

Figure 54:
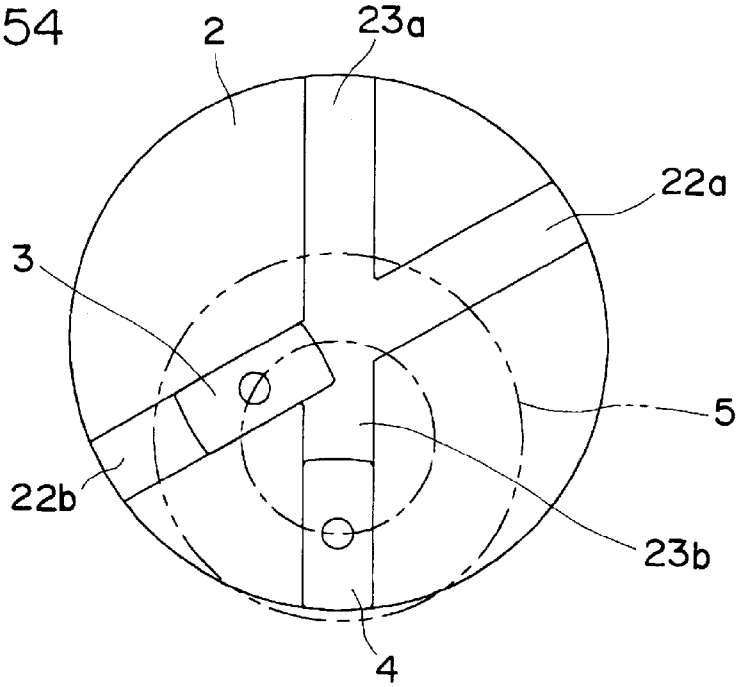
FIG. 54 is a conceptual view showing an example in which the cylinder chambers of the rotary cylinder member are not equally distributed with respect to the circumferential direction.

Incidentally, although the above has described the preferred embodiments according to the present invention, the present invention is not restricted thereto, and various modifications can be made without departing from the scope of the invention. For example, the cylinder portions do not have to be equally provided in the circumferential direction with respect to the rotary cylinder member 2. For example, as shown in FIG. 54, the cylinder portions 22*a*, 22*b*, 23*a* and 23*b* may not be equally provided in the circumferential direction with respect to the rotary cylinder member 2.

Figure 55:
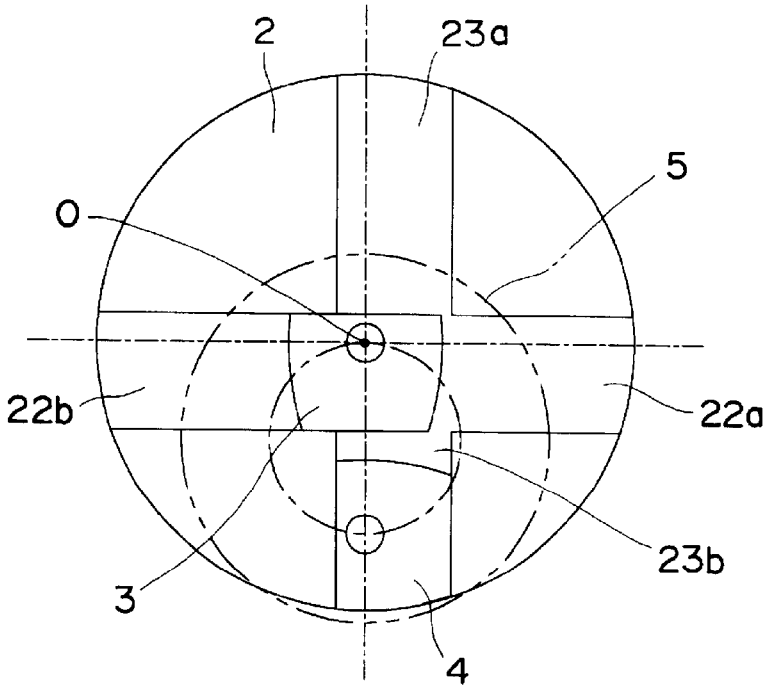
FIG. 55 is a conceptual view showing an example in which the cylinder chambers are offset and formed.

Further, as shown in FIG. 55, the cylinder portions 22*a*, 22*b*, 23*a* and 23*b* may be formed so as to be offset from the rotary shaft center O of the rotary cylinder member 2. Furthermore, although not shown, widths of the pistons may be different from each other.

Figure 56:
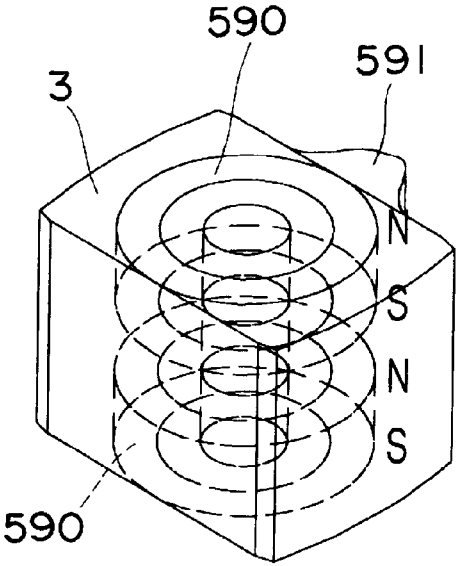
FIG. 56 is a perspective view showing an example in which magnets are arranged to the piston.

Moreover, magnets may be arranged to the pistons or the base portion of the rotary cylinder member so that the magnetic fluid can prevent the fluid from leaking from the gap between these members. The concept of such a structure is shown in, for example, FIG. 56. Magnets 590 are arranged in the piston 3, the magnetic fluid 591 is caused to adhere to the magnets 590. The magnets 590 are provided in the vicinity of the contact portion between the piston 3 and the cylinder chamber or, in this embodiment, at the center of the piston 3. With such a structure, each magnet 590 draws the magnetic fluid 591 to the piston 3 and holds it on the outer periphery thereof. As a result, the magnetic fluid 591 can be filled in the gap between the piston 3 and the rotary cylinder member 2, and the fluid can be prevented from leaking from this gap. It is to be noted that reference characters N and S denote magnetic poles of each magnet 590.

Figure 57:
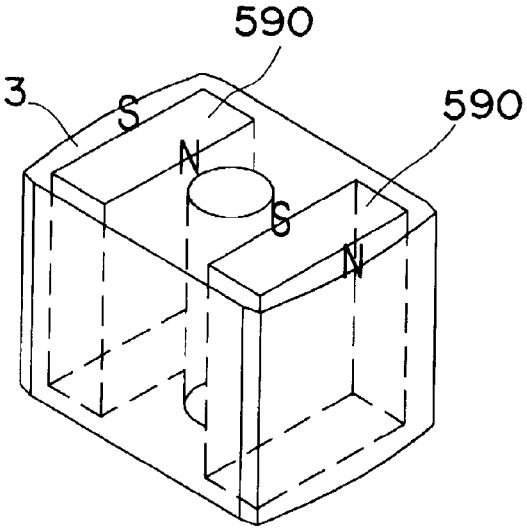
FIG. 57 is a perspective view showing another example in which the magnets are arranged to the piston.
Figure 59:
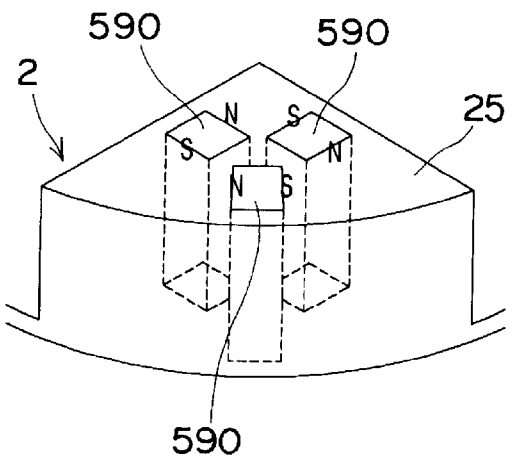
FIG. 59 is a perspective view showing another example in which the magnets are arranged to the rotary cylinder member.
Figure 58:
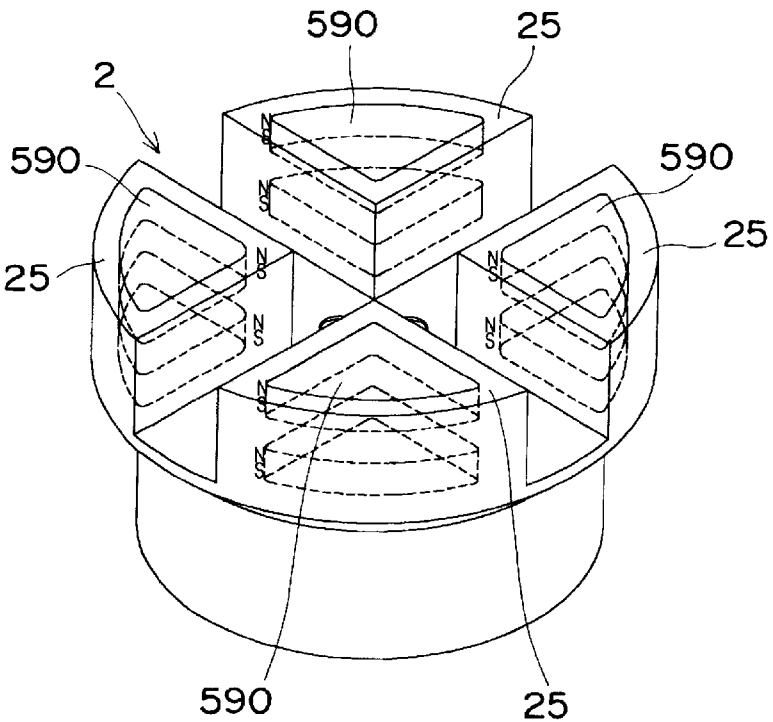
FIG. 58 is a perspective view showing an example in which the magnets are arranged to the rotary cylinder member.

Incidentally, the shape of the magnet 590 arranged in the piston 3 may be one shown in FIG. 57. Additionally, for example, as shown in FIG. 58 or 59, the magnets 590 may be arranged to the base portions 25 of the rotary cylinder member 2 in place of arranging the magnets 590 in the piston 3.

Figure 60:
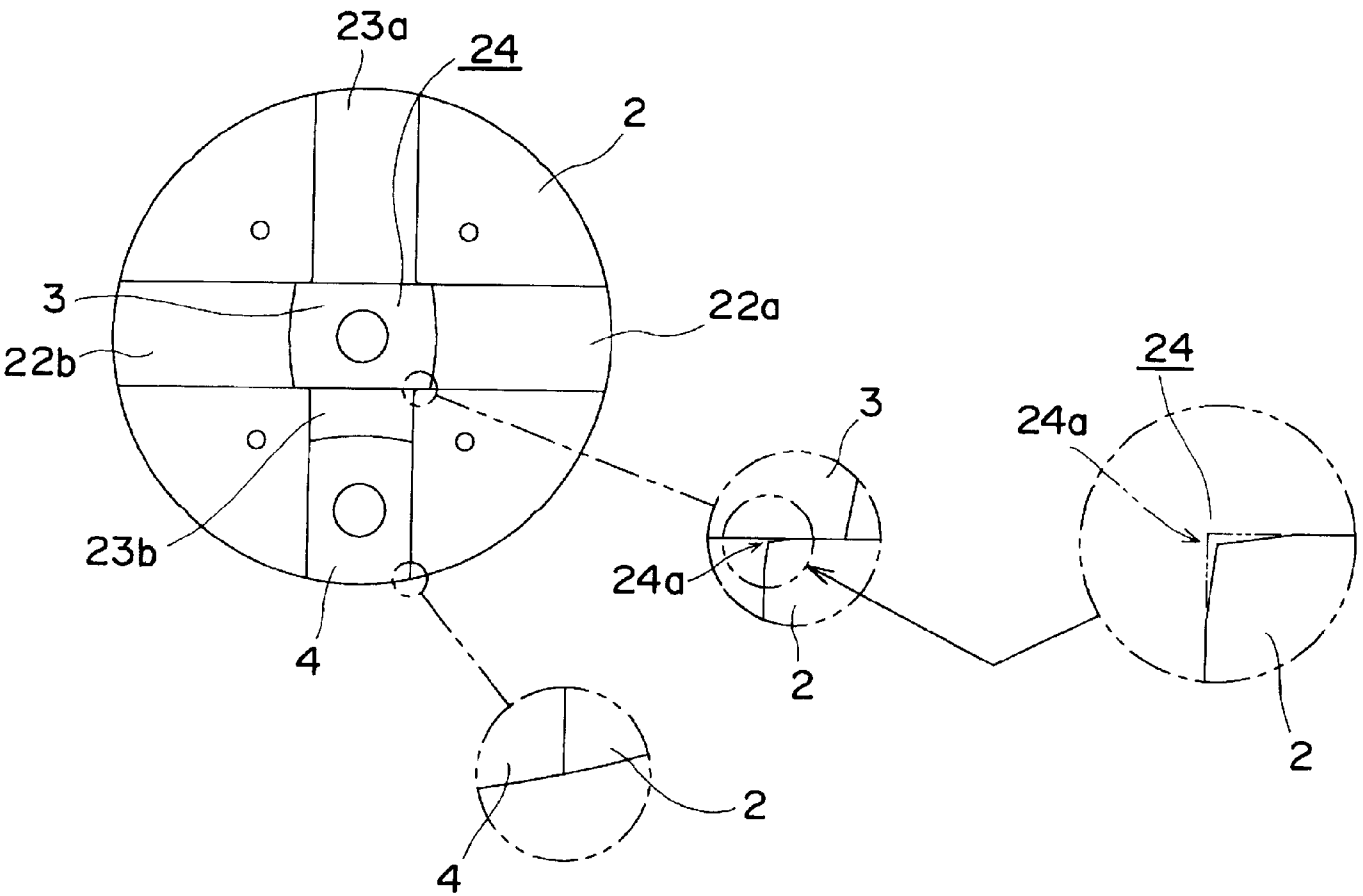
FIG. 60 is a conceptual view showing the state in which corners of the hollow portion of the rotary cylinder member are cut off.

Further, as shown in FIG. 60 for example, each corner 24*a* of the hollow portion 24 of the rotary cylinder member 2 may be chamfered. By chamfering in this manner, when the pistons 3 and 4 pass through the hollow portion 24 of the rotary cylinder member 2, they can smoothly move to the next cylinder chambers even if the orientation of the pistons 3 and 4 with respect to the proceeding direction is inclined. In this case, although the pistons 3 and 4 may be chamfered, chamfering on the rotary cylinder member 2 as shown in FIG. 60 is more desirable than chamfering on the pistons 3 and 4. If chamfering is carried out on the piston side, the chamfered portion becomes a gap even if the piston rotates to the outmost peripheral side of the rotary cylinder member, and the compressed fluid remains. This remaining fluid hangs over to the next stroke, thereby deteriorating the efficiency. In particular, when the rotary cylinder apparatus according to the present invention is applied to the compressor, not only the remaining fluid degrades the efficiency as the compressor, but the remaining compressed fluid suddenly expands when communicating with the inlet, which can be a factor for generating noises or vibrations. On the contrary, when chamfering is applied on the rotary cylinder member side and the pistons have corners, the remaining capacity of the fluid having the maximum pressure at the outmost peripheral position of the cylinder can be decreased, and the pistons can smoothly move without lowering the efficiency of the apparatus as the compressor.

Figure 61:
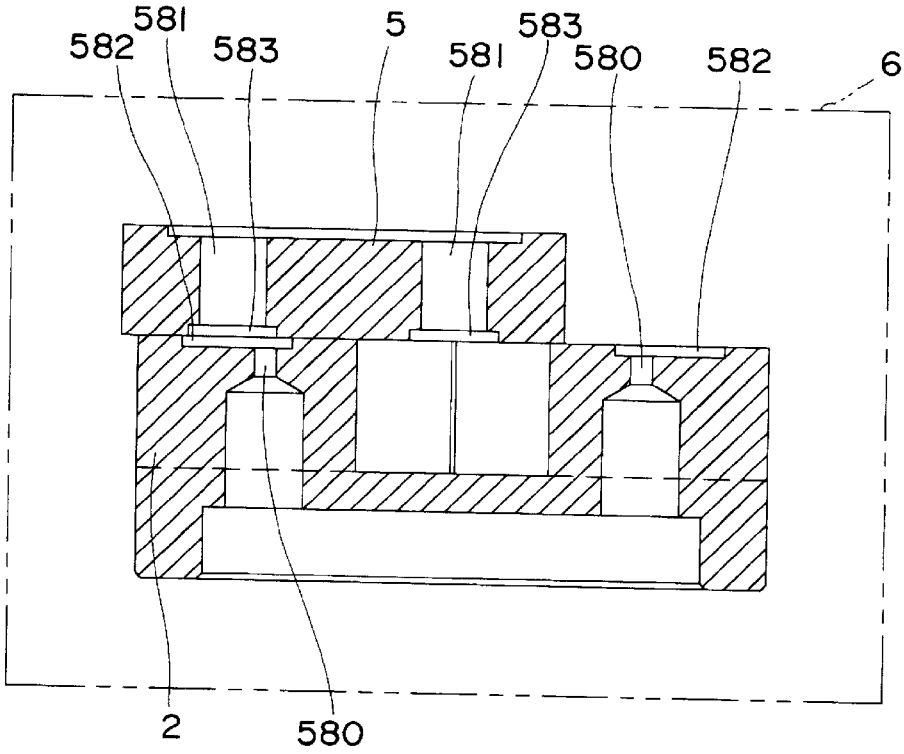
FIG. 61 is a cross-sectional view showing an example of the rotary cylinder member and the piston holding member to which a passage for releasing the back pressure is formed.
Figure 62:
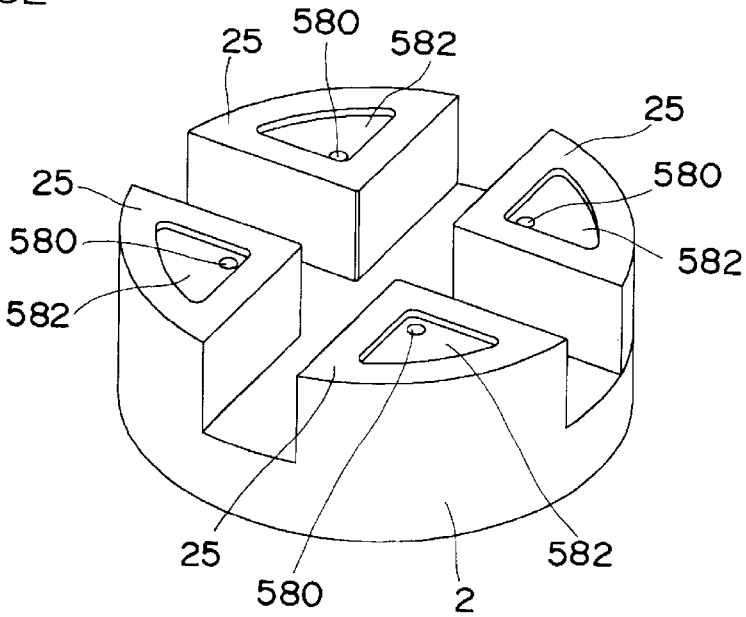
FIG. 62 is a perspective view showing the rotary cylinder member depicted in FIG. 61.
Figure 63B:
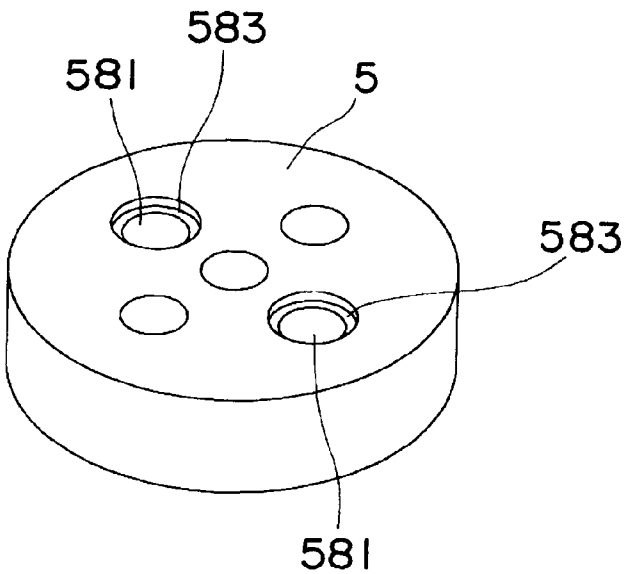
FIGS. 63A and 63B are a perspective view showing the piston holding member depicted in FIG. 61 from a side opposite to the rotary cylinder member and a perspective view showing the same from the rotary cylinder member side.
Figure 63A:
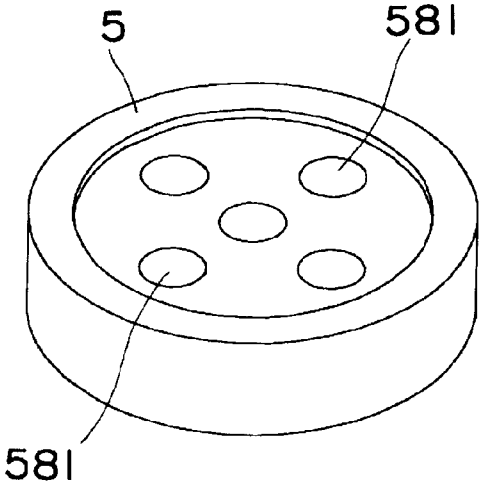

Furthermore, the back pressure releasing means may be passages 580 and 581 shown in FIGS. 61 to 63, for example. That is, as shown in FIGS. 61 to 63 for example, it is possible to form the passage 580 communicating both the front and back sides of the rotary cylinder member 2 and the passage 581 communicating both the front and back sides of the piston holding member 5. In this case, it is needless to say that the passages 580 and 581 are not restricted to a specific shape or dimension. Moreover, a recession 582 may be formed on the top surface of each base portion 25 of the rotary cylinder member 2 or a recession 583 may be formed around the opening portion of the passage 581 of the piston holding member 5. In this case, it is needless to say that the respective recessions 582 and 583 are not restricted to a specific shape or dimension.

Figure 64:
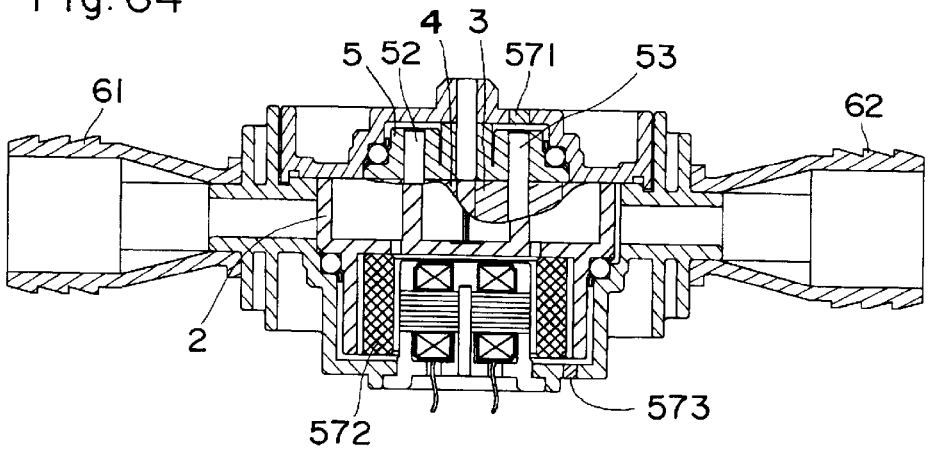
FIG. 64 is a cross-sectional view showing an example in which the rotary cylinder apparatus according to the present invention is constituted as the fluid electric generator having rotation number detecting means.

In addition, rotation number detecting means for detecting the rotation number of the rotary cylinder member 2 or the piston holding member 5 may be provided. For example, FIG. 64 shows an example in which the rotation number detecting means is provided to the fluid electric generator as the rotary cylinder apparatus. In this fluid electric generator, the piston support shafts 52 and 53 consist of, e.g., metal, and a metal sensor 571 is attached at a position of the piston holding member 5 opposed to the piston support shafts 52 and 53. Additionally, detection outputs of the piston support shafts 53 and 53 by the metal sensor 571 are counted by a counter. As a result, the rotation number of the fluid electric generator is detected. However, the present invention is not restricted to this method. For example, an MR element, a hall element 573 or the like for detecting rotation of the magnet 572 may be provided so that counting detection outputs from these elements by a counter can detect the rotation number of the fluid electric generator. Further, a non-illustrated voltage limiter may be provided and the rotation number of the fluid electric generator may be detected based on the sine waveform of the electric generation output. Furthermore, the rotation number of the fluid electric generator may be detected by providing a non-illustrated slit plate to the outer ring of the magnet 572, providing a non-illustrated photo-interrupter on the case side, detecting the light passing through the slit plate by the photo-interrupter and counting the detection value by a counter.

Figure 65:
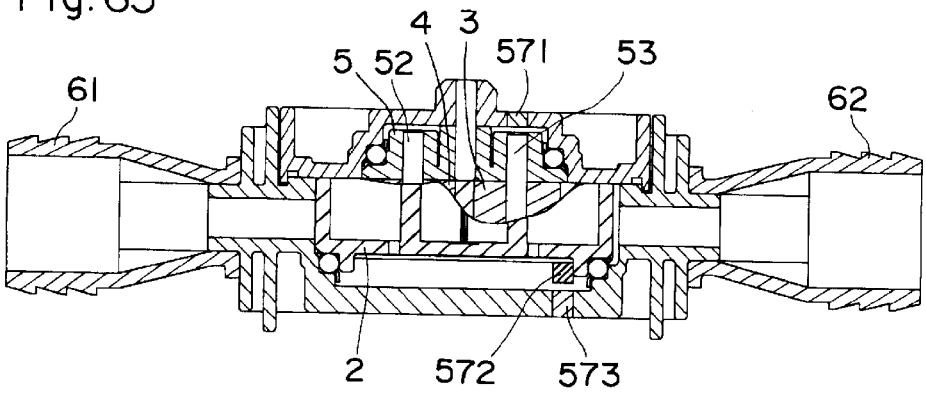
FIG. 65 is a cross-sectional view showing an example in which the rotary cylinder apparatus according to the present invention is constituted as a flow meter having rotation number detecting means.

Furthermore, as shown in, e.g., FIG. 65, providing the rotation number detecting means to the rotary cylinder apparatus can obtain, for example, a flow meter. As similar to the example shown in FIG. 64, in this example, the piston support shaft 52 and 53 may consist of, e.g., metal; a metal sensor 571 may be attached to a position of the piston holding member 5 opposed to the piston support shafts 52 and 53; and detection outputs of the piston support shafts 52 and 53 by the metal sensor may be counted by a counter. Moreover, the magnet 572 may be attached to the rotary cylinder member 2; an MR element, a hall element 573 or the like for detecting rotation of the magnet 572 may be provided; and outputs from these elements may be counted by a counter, thereby detecting the rotation number of the flow meter. In addition, the rotation number of the flow meter may be detected by: providing a non-illustrated slit plate to the outer ring of the magnet 572; providing a non-illustrated photo-interrupter to the case side; detecting the light passing through the slit plate by the photo-interrupter; and counting the detection value by a counter. Since a quantity of flow when the rotary cylinder member makes one turn is known in the volume type flow meter, a total quantity of flow can be measured by counting the rotation number by the counter.

That is, when the rotary cylinder apparatus according to the present invention is applied to the flow meter, providing the rotation number detecting means can electrically detect a quantity of flow of the fluid. Thus, based on the detected quantity of flow, for example, a solenoid-operated opening/closing valve provided in the flow passage can be controlled to be on/off, or an alarm can be given when a quantity of flow reaches a predetermined value.

Figure 66:
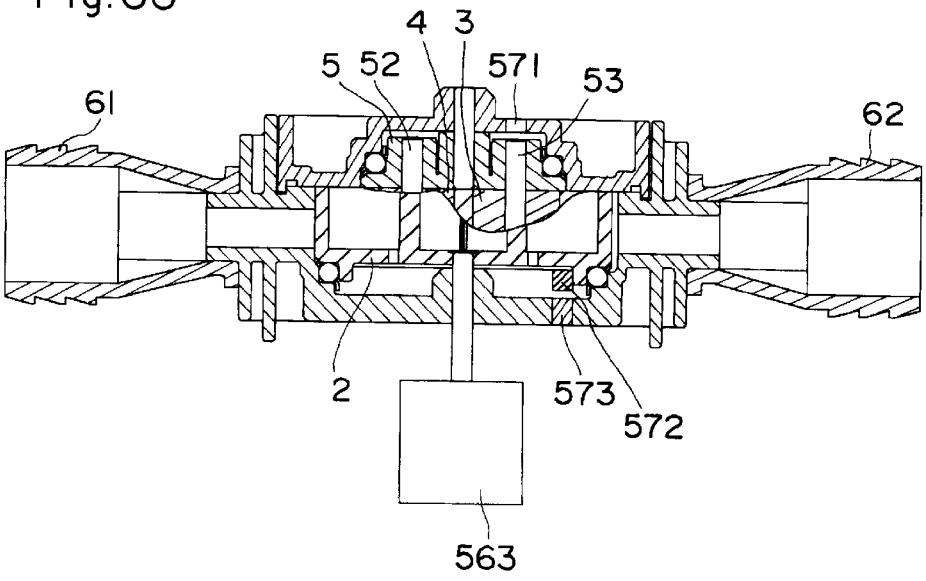
FIG. 66 is a cross-sectional view showing an example in which the rotary cylinder apparatus according to the present invention is constituted as a fluid pump having rotation number detecting means.
Figure 67:
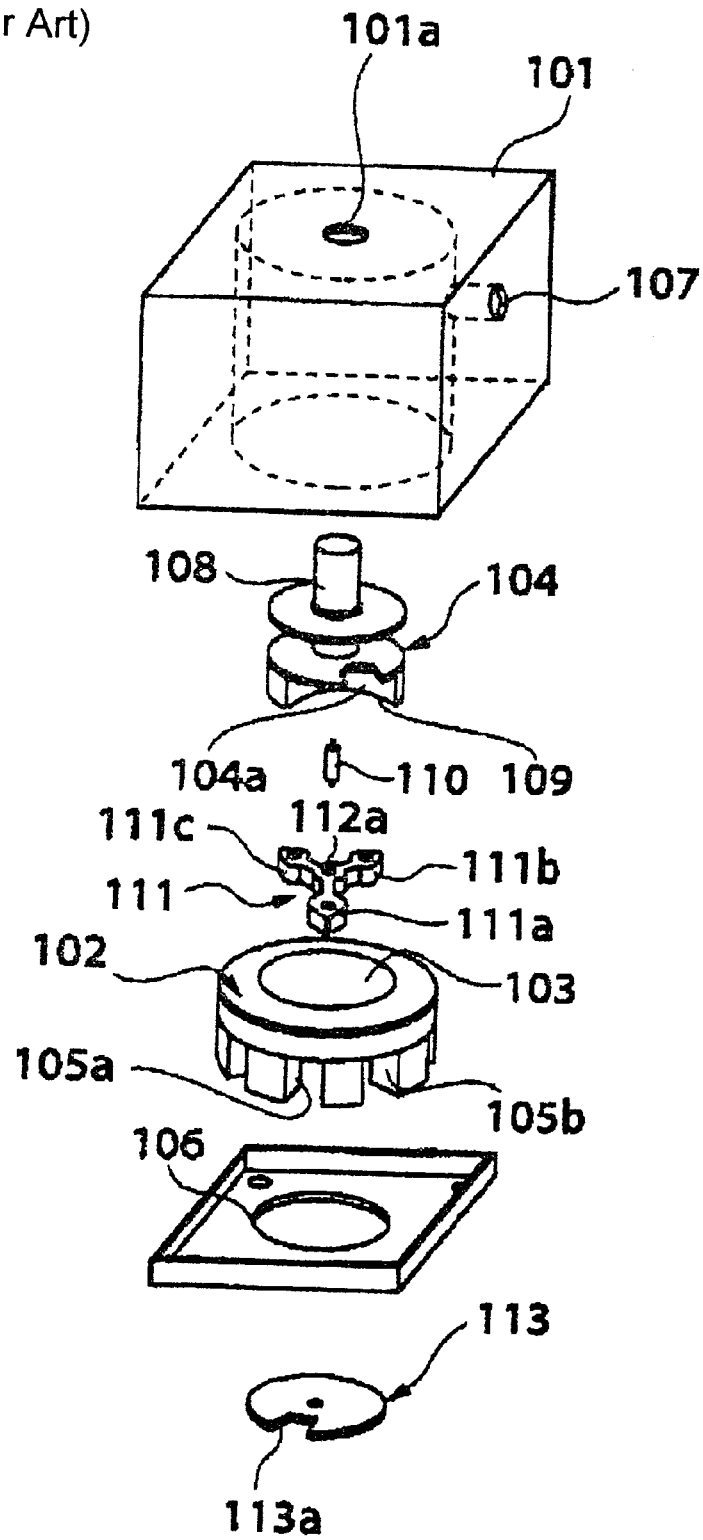
Fig. 67 (Prior Art)
FIG. 67 is an exploded perspective view showing a prior art rotary cylinder apparatus.
Figure 68A:
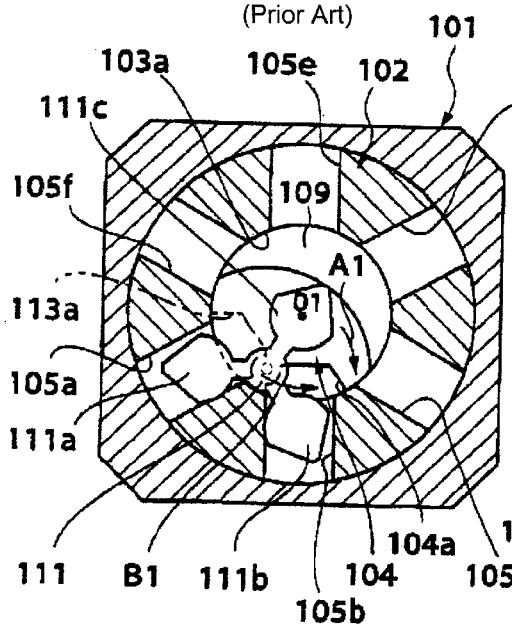
Fig.68A (Prior Art)
FIGS. 68A to 68D are views illustrating the operation of the rotary cylinder apparatus depicted in FIG. 67, showing the state in which a support member for supporting the rotary piston member is rotated every 30 degrees in the counterclockwise direction.
Figure 68B:
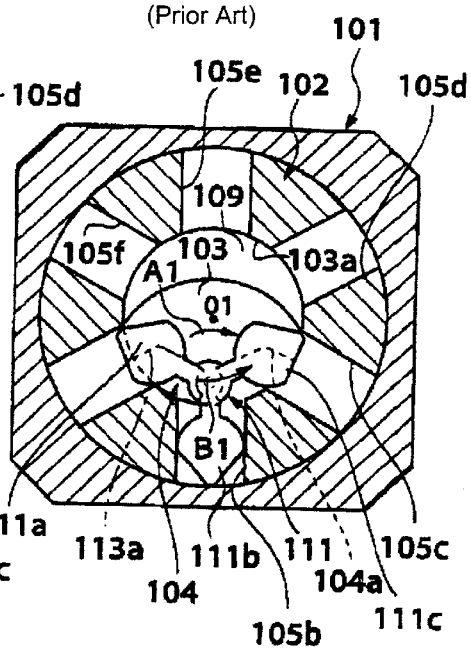
Fig.68B (Prior Art)
Figure 68C:
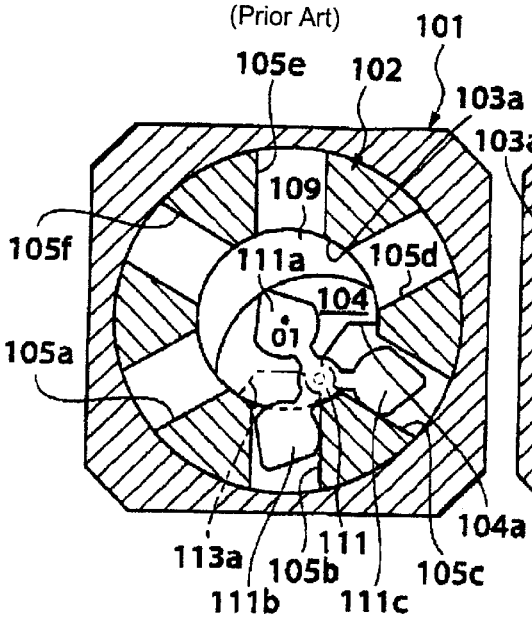
Fig.68C (Prior Art)
Figure 68D:
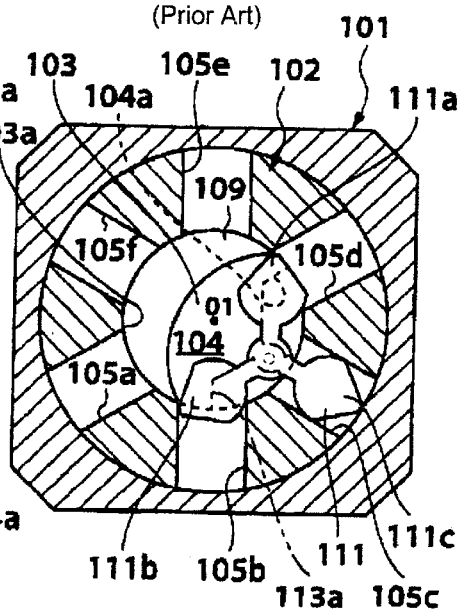
Fig.68D (Prior Art)

Furthermore, as shown in FIG. 66 for example, when the rotary cylinder apparatus according to.the present invention is used as a fluid pump, by providing the rotation number detecting means, the operation of the fluid pump can be subjected to the feedback control. That is, the rotation number may be detected by the method similar to that of the flow meter shown in FIG. 65, and the drive motor 563 may be controlled based on the count number obtained by a counter.

What is claimed is:

1. A rotary cylinder apparatus comprising:

a rotary cylinder member having a plurality of cylinder chambers formed thereto so as to pass through a rotary shaft center and rotating around said rotary shaft center;

a piston having reciprocating linear motion in surface contact with inside of said cylinder chambers, wherein said cylinder chambers intersect at said rotary shaft center of said rotary cylinder member, and a length of a portion where said cylinder chambers intersect in a moving direction of said piston is shorter than a length of said piston; and a piston holding member holding said piston and rotating around a rotation center eccentric from said rotary shaft center of said rotary cylinder member; and a casing rotatably supporting and accommodating said rotary cylinder member and said piston holding member and having at least one inlet for a fluid and at least one outlet for the fluid, wherein said piston is rotatably held at a position away from said rotation center of said piston holding member by a fixed distance.

2. A rotary cylinder apparatus according to claim 1, wherein a guide portion for guiding said piston in a sliding direction is formed to at least one of said cylinder chambers, and a guide engagement portion for engaging with said guide portion is formed to said piston.

3. A rotary cylinder apparatus according to claim 1, wherein said inlet is provided to said casing in one of two areas divided by a line connecting said rotary shaft center of said rotary cylinder member and said rotation center of said piston holding member so as to communicate with at least one of said cylinder chambers, and said outlet is provided to said casing in the other one of said areas so as to communicate with said cylinder chamber.

4. A rotary cylinder apparatus according to claim 1, wherein a surface of said piston opposed to said piston holding member is a flat surface.

5. A rotary cylinder apparatus according to claim 1, wherein a lateral cross-sectional shape of said piston and a lateral cross-sectional shape of at least one of said cylinder chambers are similar shapes which form a small gap for enabling sliding.

6. A rotary cylinder apparatus according to claim 1, wherein back pressure releasing means for reducing a back pressure is provided to sliding surfaces of said rotary cylinder member, said piston holding member and said piston.

7. A rotary cylinder apparatus according to claim 1, wherein said rotary cylinder member and said piston holding member are rotatably supported by a bearing member simultaneously bearing a thrust load and a radial load.

8. A rotary cylinder apparatus according to claim 1, wherein said rotary cylinder member is rotatably supported by a bearing plate, and said bearing plate is configured to be adjustable by an adjusting pushing screw and an adjusting drawing screw.

9. A rotary cylinder apparatus according to claim 1, wherein said piston holding member is rotatably supported by a bearing plate, and said bearing plate is configured to be adjustable by an adjusting pushing screw and an adjusting drawing screw.

10. A rotary cylinder apparatus according to claim 1, wherein a magnetic fluid is arranged in a gap formed between said piston and at least one of said cylinder chambers, and a magnet for holding said magnetic fluid in said gap is provided in a vicinity of a contact portion between said piston and said cylinder chamber.

11. A rotary cylinder apparatus according to claim 1, wherein at least one of said cylinder chambers is arranged to said rotary cylinder member at position equally distributed in a circumferential direction.

12. A rotary cylinder apparatus according to claim 1, wherein a chamfered portion is formed to a portion where said plurality of said cylinder chambers intersect.

13. A rotary cylinder apparatus comprising:

a rotary cylinder member having a cylinder chamber formed thereto so as to pass through a rotary shaft center and rotating around said rotary shaft center, said rotary cylinder member is rotatably supported by a bearing plate, said bearing plate is configured to be adjustable by an adjusting pushing screw and an adjusting drawing screw;

a piston demonstrating reciprocating linear motion in surface contact with inside of said cylinder chambers; and a piston holding member holding said piston and rotating around a rotation center eccentric from said rotary shaft center of said rotary cylinder member; and a casing rotatably supporting and accommodating said rotary cylinder member and said piston holding member and having at least one inlet for a fluid and at least one outlet for the fluid, wherein said piston is rotatably held at a position away from said rotation center of said piston holding member by a fixed distance.

14. A rotary cylinder apparatus according to claim 13, wherein a guide portion for guiding said piston in a sliding direction is formed to at least one of said cylinder chambers, and a guide engagement portion for engaging with said guide portion is formed to said piston.

15. A rotary cylinder apparatus according to claim 13, wherein said inlet is provided to said casing in one of two areas divided by a line connecting said rotary shaft center of said rotary cylinder member and said rotation center of said piston holding member so as to communicate with at least one of said cylinder chambers, and said outlet is provided to said casing in the other one of said areas so as to communicate with said cylinder chamber.

16. A rotary cylinder apparatus according to claim 13, wherein a surface of said piston opposed to said piston holding member is a flat surface.

17. A rotary cylinder apparatus according to claim 13, wherein a lateral cross-sectional shape of said piston and a lateral cross-sectional shape of at least one of said cylinder chambers are similar shapes which form a small gap for enabling sliding.

18. A rotary cylinder apparatus according to claim 13, wherein back pressure releasing means for reducing a back pressure is provided to sliding surfaces of said rotary cylinder member, said piston holding member and said piston.

19. A rotary cylinder apparatus according to claim 13, wherein said rotary cylinder member and said piston holding member are rotatably supported by a bearing member simultaneously bearing a thrust load and a radial load.

20. A rotary cylinder apparatus according to claim 13, wherein said rotary cylinder member is rotatably supported by a bearing plate, and said bearing plate is configured to be adjustable by an adjusting pushing screw and an adjusting drawing screw.

21. A rotary cylinder apparatus comprising:

a rotary cylinder member having a cylinder chamber formed thereto so as to pass through a rotary shaft center and rotating around said rotary shaft center;

a piston demonstrating reciprocating linear motion in surface contact with inside of said cylinder chambers;

a piston holding member holding said piston and rotating around a rotation center eccentric from said rotary shaft center of said rotary cylinder member; and a casing rotatably supporting and accommodating said rotary cylinder member and said piston holding member and having at least one inlet for a fluid and at least one outlet for the fluid, said piston holding member is rotatably supported by a bearing plate, and said bearing plate is configured to be adjustable by an adjusting pushing screw and an adjusting drawing screw, wherein said piston is rotatably held at a position away from said rotation center of said piston holding member by a fixed distance.

* * * * *